US005126235A

United States Patent [19]

Hioki

[11] Patent Number: 5,126,235

[45] Date of Patent: Jun. 30, 1992

[54] FULL COLOR RECORDING MATERIAL AND A METHOD OF FORMING COLORED IMAGES

[75] Inventor: Takanori Hioki, Kanagawa, Japan

[73] Assignee: Fuji Photo Film Co., Ltd., Kanagawa, Japan

[21] Appl. No.: 497,362

[22] Filed: Mar. 22, 1990

[30] Foreign Application Priority Data

Mar. 22, 1989 [JP] Japan ..... 1-70160

[51] Int. Cl.[5] ..... G03C 1/14; G03C 1/22; G03C 1/46

[52] U.S. Cl. ..... 430/505; 430/550; 430/576; 430/577; 430/582; 430/584; 430/944; 430/363

[58] Field of Search ..... 430/503, 576, 577, 582, 430/584, 944, 363, 505, 550

[56] References Cited

U.S. PATENT DOCUMENTS 4,619,892 10/1986 Simpson et al. ..... 430/505

*Primary Examiner*—Charles L. Bowers, Jr.
*Assistant Examiner*—Janet C. Baxter
*Attorney, Agent, or Firm*—Sughrue, Mion, Zinn Macpeak & Seas

[57] ABSTRACT

A full color recording material comprising a support having thereon at least three silver halide photosensitive emulsion layers which contain respectively couplers which form yellow, magenta and cyan colorations and which are sensitive to light of different wavelength regions, at least two of the said layers being spectrally sensitized selectively to match laser light beams of wavelengths of at least 670 nm, wherein the at least two layers aforementioned contain at least one type of cross-linking type spectrally sensitizing dye.

17 Claims, No Drawings

FULL COLOR RECORDING MATERIAL AND A METHOD OF FORMING COLORED IMAGES

FIELD OF THE INVENTION

The present invention concerns silver halide color photographic photosensitive materials and a method of rapidly forming full color images using these materials. More precisely, the invention concerns full color photosensitive materials which contain silver halide emulsions which have been spectrally sensitized by means of merocyanine dyes or cyanine dyes. For example, the dyes may have a specified structure and have crosslinking groups on their methine chain. The invention especially relates to photosensitive materials which are suitable for reproducing and recording soft image information as color images with gradation by means of a scanning exposure in which semiconductor laser beams are used, and to a method of image formation.

BACKGROUND OF THE INVENTION

Techniques for the production of a hard copy from soft information may be used because of recent progress which has been made with information processing and storage techniques and with techniques for image processing, and because of the availability of communication circuits. On the other hand, very high quality photographic prints can be made comparatively easily and inexpensively because of the progress which has been made with silver halide photosensitive materials and compact, rapid, simple development systems (for example, the mini-laboratory system). Furthermore, there is a great demand for an inexpensive hard copy which can be made easily from soft information with the high picture quality of photographic prints.

In the past, techniques for making hard copy from soft information have included those in which no photosensitive recording materials are used (such as those involved in the systems in which electrical signals and electromagnetic signals are used and ink jet systems) and those in which photosensitive materials, for example, silver halide photosensitive materials and electrophotographic materials, are used. In the latter category of techniques, there are systems in which recordings are made with an optical system which emits light under control in accordance with the image information. This enables not only optical system production, image resolution and binary recording but also multi-gradation recording to be achieved. These systems are useful for obtaining high image quality. The silver halide photosensitive materials are more convenient than systems in which electrophotographic materials are used since image formation is achieved chemically. On the other hand, systems in which silver halide photosensitive materials are used must have photosensitive wavelengths which match the optical system, stable photographic speeds, latent image stability, resolving power, separation of the three primary colors, and rapid and simple color development processing characteristics. Finally, attention must be given to cost.

In the past, copying machines and laser printers were used in which electrophotographic techniques were used. Color copying techniques include silver halide based heat developable dye diffusion systems, and "Pictography" (a trade name of Fuji Photo Film Co., Ltd.) in which LED's are used.

Color photographic materials comprising a support having thereon at least three silver halide emulsion layers which contain normal color couplers and which are not exposed to visible light, wherein at least two of the layers are sensitized to laser light in the infrared region, and the fundamental conditions for these materials, have been disclosed in the specification of JP-A-61-137149. (The term "JP-A" as used herein signifies an "unexamined published Japanese patent application".)

Full color recording materials are known which comprise a support having thereon a unit of at least three photosensitive layers which contain color couplers, wherein at least one layer is prepared so that it is photosensitive to a LED or a semiconductor laser light. They are spectrally sensitized so that the spectrally sensitized peak wavelength is longer than about 670 nm. With this material colored images can be obtained by means of a light scanning exposure and a subsequent color development process. A method of spectral sensitization which is stable and provides high speed, a method of using dyes and such a full color recording material have been disclosed in the specification of JP-A-63-197947.

A color photographic material color image recording system wherein yellow, magenta and cyan color formation is controlled with three light beams which have different wavelengths, for example green, red and infrared light beams respectively, has been disclosed in the specification of JP-A-55-13505.

The basic conditions for a continuous tone scanning type printer semiconductor laser output controlling mechanism have been described by S.H. Baek on pages 245–247 of the published papers in the *Fourth International Symposium on Non-impact Printing* (NIP) (SPSE).

However, there is no suggestion in the above-mentioned literature of sensitizing dyes which have the specified crosslinking structure of the present invention.

Means in which non-photosensitive recording materials are used to obtain hard copy from soft information are effective for low image quality results. But it is virtually impossible to obtain photographic print type picture quality with the A4 to B4 or smaller sizes which are normally used. Even though the cost per sheet is low, the cost is high when picture quality (for example, recording content—density×surface area) is taken into account. The image quality with electro-photographic systems is worse than that obtained with silver halide photosensitive material systems. Further, the image forming process is more complex mechanically, and it is difficult to obtain hard copies of high picture quality in a stable manner.

On the other hand, stable high picture quality is readily obtained with systems in which silver halide photosensitive materials are used. But the photosensitive materials themselves must be provided with photosensitive wavelengths which match the optical system, stable photographic speed, latent image stability, and separation of the three primary colors. Silver iodobromide emulsions, silver bromide emulsions and silver chlorobromide emulsions are known as silver halide emulsions which can be used in silver halide photographic materials which are to be written-in by laser light beams. The color development process of these full color recording materials is preferably rapid, taking not more than 60 seconds, in order to match the speed of write-in with an output device in which semiconductor laser beams are used. Silver halide emulsions which have a high silver chloride content are useful for this purpose. In general, infrared sensitization to wavelengths beyond 670 nm and especially to wavelengths longer than 750 nm is difficult. Furthermore, there are other difficulties with silver chlorobromide emulsions which have a high silver chloride content, especially those which have a silver chloride content of more than 95 mol%. First, they have poor photographic speed and stability during manufacture and storage. It is especially difficult to obtain a gradation which has good linearity at high photographic speeds. Furthermore, it is difficult to obtain a sharp spectral sensitivity distribution. Second, it is difficult to obtain high photographic speeds with short exposures times, for example with $10^{-6}-10^{-8}$ second exposures. Third, dissolution of the emulsion, loss of photographic speed with aging and the occurrence of fogging are likely to occur when absorption on the silver halide grains is poor, especially in the presence of color couplers, high concentrations of surfactants and organic solvents. Hence, the development of sensitive materials which have high speed and which have excellent latent image stability, even though infrared sensitized silver halide emulsions are being used, is desirable. Furthermore, the development of sensitive materials in which high silver chloride emulsions which can be processed rapidly are used is especially desirable.

SUMMARY OF THE INVENTION

One object of the present invention is to provide full color recording materials which are spectrally sensitized selectively to the wavelength region which conforms to laser light beams, and which have excellent photographic speed stability and latent image stability.

A second object of the invention is to provide full color recording materials which have excellent color separation of each photosensitive layer and which have excellent sharpness. A third object of the invention is to provide full color recording materials which are compatible with scanning exposure speeds and with which rapid, simple, continuous color development processing is possible. A fourth object of the invention is to provide a method for forming color images via a scanning exposure step essentially followed by a rapid color development of not more than 60 seconds, bleach-fixing and rinsing or stabilization in which the time elapsed from the beginning color development to the end of the rinsing or stabilization step is not more than 180 seconds.

Other objects of the invention will be clear from the disclosures made in the specification.

DETAILED DESCRIPTION OF THE INVENTION

The above-mentioned objects of the invention have been realized by means of a full color recording material comprising a support having thereon at least three silver halide photosensitive layers which contain respectively couplers which form yellow, magenta and cyan colorations and which are sensitive to light of different wavelength regions. At least two of the layers are spectrally sensitized selectively to match semiconductor laser light beams of wavelengths of at least 670 nm. Further, the at least two layers aforementioned contain at least one spectrally sensitizing dye selected from among those which can be represented by the general formulae (I-a), (I-b), (I-c), (I-d), (II-a) and (II-b), (II-c) indicated below.

Furthermore, each of the three aforementioned types of silver halide photosensitive layer preferably contains silver chlorobromide grains of which the average silver chloride content is at least 95 mol%.

(I-a)

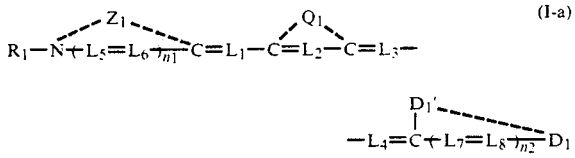

$(M_1)_{m1}$ (I-b)

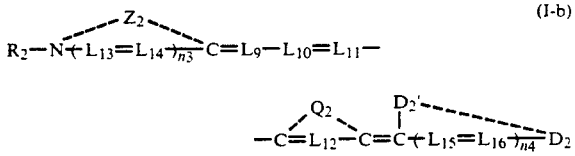

$(M_2)_{m2}$ (I-c)

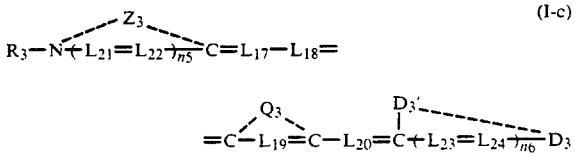

$(M_3)_{m3}$ (I-d)

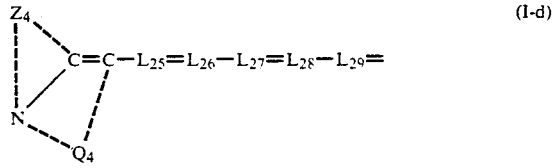

$(M_4)_{m4}$ (II-a)

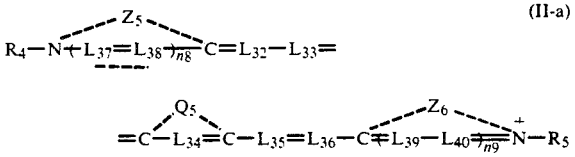

$(M_5)_{m5}$ (II-b)

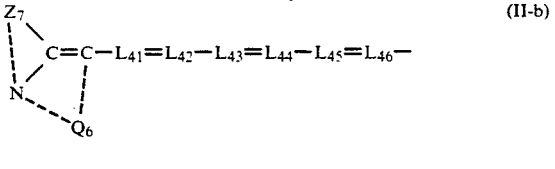

$(M_6)_{m6}$ (II-c)

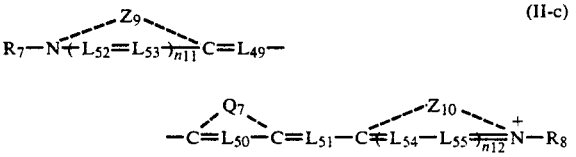

$(M_7)_{m7}$

In these formulae, $Z_1$, $Z_2$, $Z_3$, $Z_4$, $Z_5$, $Z_6$, $Z_7$, $Z_8$, $Z_9$ and $Z_{10}$ represent groups of atoms which are required to form 5- or 6-membered nitrogen containing heterocyclic rings. However, at least one of $Z_9$ and $Z_{10}$ is a 4-quinoline nucleus or a 4-pyridine nucleus.

$D_1$ and $D_1'$, $D_2$ and $D_2'$, $D_3$ and $D_3'$, and $D_4$ and $D_4'$ represent groups of atoms which are required to form non-cyclic or cyclic acidic nuclei.

$Q_1$, $Q_2$, $Q_3$, $Q_4$, $Q_5$, $Q_6$ and $Q_7$ represent groups of atoms which are required to form 5-, 6- or 7-membered rings. r $R_1$, $R_2$, $R_3$, $R_4$, $R_5$, $R_6$, $R_7$ and $R_8$, represent alkyl groups.

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$, $L_{30}$, $L_{31}$, $L_{32}$, $L_{33}$, $L_{34}$, $L_{35}$, $L_{36}$, $L_{37}$, $L_{38}$, $L_{39}$, $L_{40}$, $L_{41}$, $L_{42}$, $L_{43}$, $L_{44}$, $L_{45}$, $L_{46}$, $L_{47}$, $L_{48}$, $L_{49}$, $L_{50}$, $L_{51}$, $L_{52}$, $L_{53}$, $L_{54}$ and $L_{55}$ represent methine groups or substituted methine groups. They may also form rings with other methine groups, or they may form rings with an auxochrome.

Moreover, $n_1$, $n_2$, $n_3$, $n_4$, $n_5$, $n_6$, $n_7$, $n_8$, $n_9$, $n_{10}$, $n_{11}$ and $n_{12}$ represent 0 or 1.

$M_1$, $M_2$, $M_3$, $M_4$, $M_5$, $M_6$ and $M_7$ represent charge neutralizing counter ions, and $m_1$, $m_2$, $m_3$, $m_4$, $m_5$, $m_6$ and $m_7$ represent zero or larger integers which are required to neutralize the charge on the molecule.

The invention is described in more detail below.

Sensitizing Dyes

One of the distinguishing features of the constitution of the present invention is that at least one species selected from among the spectral sensitizing dyes which can be represented by the general formulae (I-a), (I-b), (I-c), (I-d), (II-a), (II-b) and (II-c) is included in at least two silver halide photosensitive layers.

It is possible by including these dyes in the photosensitive material to achieve a high photographic speed with respect to near infrared light, to render increased fog levels on storage at high temperatures and/or high humidity unlikely, and to minimize variation in photographic speed (i.e., to provide excellent storage properties).

The general formulae (I-a), (I-b), (I-c), (I-d), (II-a), (II-b) and (II-c) are described in detail below.

$R_1$, $R_2$, $R_3$, $R_4$, $R_5$, $R_6$, $R_7$ and $R_8$ are preferably unsubstituted alkyl groups which have not more than 18 carbon atoms (for example, methyl, ethyl, propyl, butyl, pentyl, octyl, decyl, dodecyl, octadecyl), or substituted alkyl groups (for example, alkyl groups which have not more than 18 carbon atoms which are substituted with carboxyl groups, sulfo groups, cyano groups, halogen atoms (for example, fluorine, chlorine, bromine), hydroxyl groups, alkoxycarbonyl groups which have not more than 8 carbon atoms (for example, methoxycarbonyl, ethoxycarbonyl, benzyloxycarbonyl, aryloxycarbonyl groups (for example, phenoxy carbonyl), alkoxy groups which have not more than 8 carbon atoms (for example, methoxy, ethoxy, benzyloxy, phenethyloxy), single ring aryloxy groups which have not more than 10 carbon atoms (for example, phenoxy, p-tolyloxy), acyloxy groups which have not more than 3 carbon atoms (for example, acetyloxy, propionyloxy), acyl groups which have not more than 8 carbon atoms (for example, acetyl, propionyl, benzoyl, mesyl), carbamoyl groups (for example, carbamoyl, N,N-dimethylcarbamoyl, morpholinocarbonyl, piperidinocarbonyl), sulfamoyl groups (for example, sulfamoyl, N,N-dimethylsulfamoyl, morpholino sulfonyl, piperidinosulfonyl) and aryl groups which have not more than 10 carbon atoms (for example, phenyl, 4-chlorophenyl, 4-methylphenyl, α-naphthyl).

They are most desirably unsubstituted alkyl groups (for example, methyl, ethyl, n-propyl, n-butyl, n-pentyl, n-hexyl, branched alkyl groups thereof), carboxyalkyl groups (for example, 2-carboxyethyl, carboxymethyl) or sulfoalkyl groups (for example, 2-sulfoethyl, 3-sulfopropyl, 4-sulfobutyl, 3-sulfobutyl).

$(M_1)m_1$, $(M_2)m_2$, $(M_3)m_3$, $(M_4)m_4$, $(M_5)m_5$, $(M_6)m_6$ and $(M_7)m_7$ are included in the formulae to indicate the presence or absence of cations and anions to the extent required to neutralize the ionic charge of a dye. Whether certain dyes are cations or anions, or whether they have a network of ionic charges, depends on the auxochrome and the substituent groups. Typical cations include inorganic or organic ammonium ions and alkali metal ions. The specific anions may be inorganic anions or organic anions, for example, halogen anions (for example, a fluorine ion, chlorine ion, bromine ion, or iodine ion), substituted arylsulfonate ions (for example, a p-toluenesulfonate ion, or p-chlorobenzenesulfonate ion), aryldisulfonate ions (for example, a 1,3-benzenedisulfonate ion, 1,5-naphthalenedisulfonate ion, or 2,6-naphthalenedisulfonate ion), alkyl sulfate ions (for example, methyl sulfate ion), sulfate ion, thiocyanate ion, perchlorate ion, tetrafluoroborate ion, picrate ion, acetate ion, or trifluoromethanesulfonate ion.

The ammonium ion, the iodine ion and the p-toluenesulfonate ion are preferred.

The rings which are formed by $Z_1$, $Z_2$, $Z_3$, $Z_5$, $Z_6$, $Z_7$, $Z_8$, $Z_9$ and $Z_{10}$ may be, for example, a thiazole type nucleus (a thiazole nucleus (for example, thiazole, 4-methylthiazole, 4-phenylthiazole, 4,5-dimethylthiazole, 4,5-diphenylthiazole), a benzothiazole nucleus (for example, benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothyiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethoxybenzothiazole, 5-hydroxy-6-methylbenzothiazole, tetrahydrobenzothiazole, 4-phenylbenzothiazole), a naphthothiazole nucleus (for example, naphtho[2,1-d]thiazole, naphtho[1,2-d]thiazole, naphtho[2,3-dthiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]-thiazole)], a thiazoline nucleus (for example, thiazoline, 4-methylthiazoline, 4-nitrothiazoline), an oxazole type nucleus {an oxazole nucleus (for example, oxazole, 4-methyloxazole, 4-nitro-oxazole, 5-methyloxazole, 4-phenyloxazole, 4,5-diphenyloxazole, 4-ethyloxazole), a benzoxazole nucleus (for example, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-di-methylbenzoxazole, 5-ethoxybenzoxazole), a naphthoxazole nucleus (for example, naphtho[2,1-d]oxazole, naphtho[1,2-d]oxazole, naphtho[2,3-d]oxazole, 5-nitronaphtho[2,1-d]oxazole)}, and oxazoline nucleus (for example, 4,4-dimethyloxazoline), a selenazole nucleus {a selenazole nucleus (for example, 4-methylselenazole, 4-nitroselenazole, 4-phenylselenazole), a benzoselenazole nucleus (for example, benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole), a naphthoselenazole (for example, naphtho[2,1-d]selenazole, naphtho[1,2-d]selenazole)}, a selenazoline nucleus (for example, selenazoline, 4-methylselenazoline), a tellurazole type nucleus {a tellurazole nucleus, (for example, tellurazole, 4-methyltellurazole, 4-phenyltellurazole), a benzotellurazole nucleus (for example, benzotellurazole, 5-chlorobenzotellurazole, 5-methylbenzotellurazole, 5,6-dimethylbenzotellurazole, 6-methoxybenzotellurazole), a naphthotellurazole nucleus (for example, naphtho[2,1-d]tellurazole, naphtho[1,2-d]tellurazole)}, a tellurazoline nucleus (for example, tellurazoline, 4-methyltellurazoline), a 3,3-dialkylindolenine nucleus (for example, 3,3-dimethylindolenine, 3,3-diethylindolenine, 3,3-dimethyl-5-cyanoindolenine, 3,3-dimethyl-6-nitroindolenine, 3,3-dimethyl-5 nitroindolenine, 3,3-dimethyl-5-methoxyindolenine, 3,3,5-trimethylindolenine, 3,3-dimethyl-5-chloroindolenine), an imidazole, 1-alkyl-4-phenylimidazole, 1-arylimidazole), a benzimidazole nucleus (for example, 1-alkylbenzimidazole, 1-alkyl-5-chlorobenzimidazole, 1 alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6 chloro-5-trifluoromethylbenzimidazole, 1-allyl-5,6-dichlorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl-5-methoxybenzimidazole, 1-5-cyanobenzimidazole), a naphthimidazole nucleus (for example, 1-alkylnaphtho[1,2-d]imidazole, 1-arylnaphtho[1,2-d]imidazole) (the alkyl groups referred to above have from 1 to 8 carbon atoms, being preferably unsubstituted alkyl groups (for example, methyl, ethyl, propyl, iso-propyl, butyl) or hydroxyalkyl groups (for example, 2-hydroxyethyl, 3-hydroxypropyl), and of these the methyl group and the ethyl group are especially desirable; moreover, the aforementioned aryl groups are phenyl groups, halogen (for example, chloro) substituted phenyl groups, alkyl (for example, methyl) substituted phenyl groups or alkoxy (for example, methoxy) substituted phenyl groups)}, a pyridine nucleus (for example, 2-pyridine, 4-pyridine, 5-methyl-2-pyridine, 3-methyl-4-pyridine), a quinoline type nucleus {a quinoline nucleus (for example, 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, 6-chloro-4-quinoline), an isoquinoline nucleus (for example, 6-nitro-1-isoquinoline, 3,4-dihydro-1-isoquinoline, 6-nitro-3-isoquinoline)}, an imidazo[4,5-b]quinoxaline nucleus (for example, 1,3-diethylimidazo[4,5-b]quinoxaline, 6-chloro-1,3-diallylimidazo[4,5-b]quinoxaline), an oxadiazole nucleus, a thiadiazole nucleus, a tetrazole nucleus or a pyrimidine nucleus.

Benzothiazole nuclei, naphthothiazole nuclei, benzoxazole nuclei, naphthoxazole nuclei and benzimidazole nuclei are preferred as the nuclei which are formed by $Z_1$, $Z_2$, $Z_3$, $Z_5$, $Z_6$, and $Z_8$.

At least one of the nuclei formed by $Z_9$ and $Z_{10}$ is a 4-quinoline nucleus or a 4-pyridine nucleus, and the other is preferably a benzothiazole nucleus, a naphthothiazole nucleus, a benzoxazole nucleus, a naphthoxazole nucleus or a benzimidazole nucleus.

$Z_4$ and $Z_7$ are the same as $Z_1$, $Z_2$, $Z_3$, $Z_5$, $Z_6$, $Z_8$, $Z_9$ and $Z_{10}$, but they may not be 4-quinoline nuclei or 4-pyridine nuclei. They are preferably benzothiazole nuclei, naphthothiazole nuclei, benzoxazole nuclei or naphthoxazole nuclei.

$D_1$, $D_1'$, $D_2$, $D_2'$, $D_3$, $D_3'$ and $D_4$, $D_4'$ represent groups of atoms which are required to form acidic nuclei, and these may take the form of any of the acidic nuclei generally found in merocyanine dyes. In the preferred form, $D_1$, $D_2$, $D_3$, and $D_4$ may be the same or different and are thiocarbonyl groups or carbonyl groups, and $D_1'$, $D_2'$, $D_3'$ and $D_4'$ are the remainders of the Of atoms required to form an acidic nucleus.

$D_1$ and $D_1'$, $D_2$ and $D_2'$, $D_3$ and $D_3'$ and $D_4$ and $D_4'$ can together form 5- or 6-membered heterocyclic rings comprised of carbon, nitrogen and chalcogen (typically oxygen, sulfur, selenium and tellurium) atoms. $D_1$ and $D_1'$, $D_2$ and $D_2'$, $D_3$ and $D_3'$ and $D_4$ and $D_4'$ together preferably form the following nuclei: 2-pyrazolidine-5-one, pyrazolidin-3,5-dione, imidazolin-5-one, hydantoin, 2- or 4-thiohydantoin, 2-imino-oxazolidin-4-one, 2-oxazoline-5-one, 2-thio-oxazolidin-2,4-dione, isooxazolin-5-one, 2-thiazolin-4-one, thiazolidin 4-one, thiazolidin-2,4-dione, rhodanine, thiazolidin-2,4-dithione, isorhodanine, indan-1,3-dione, thiophen-3-one, thiophen-3-one 1,1-dioxide, indolin-2-one, indolin-3-one, indazolin-3-one, 2-oxoindazolinium, 3-oxoindazolinium, 5,7-dioxo-6,7-dihydrothiazolo[3,2-a]pyrimidine, cyclohexan-1,3-dione, 3,4-dihydroisoquinolin-4-one, 1,3-dioxan-4,6-dione, barbituric acid, 2-thiobarbituric acid, chroman-2,4-dione, indazolin-2-one or pyrido[1,2-a]pyrimidin-1,3-dione nuclei.

A 3-alkylrhodanine nucleus, a 3-alkyl-2-thioxazolidin-2,4-dione nucleus and a 3-alkyl-2-thiohydantoin nucleus are especially desirable.

The substituent groups which are bonded to nitrogen atoms in these nuclei are preferably hydrogen atoms, alkyl groups which have 1 to 18, preferably 1 to 7, and most desirably 1 to 4 carbon atoms (for example, methyl, ethyl, propyl, isopropyl, butyl, iso-butyl, hexyl, octyl, dodecyl, octadecyl), substituted alkyl groups {for example, aralkyl groups (for example, benzyl, 2-phenethyl), hydroxyalkyl groups (for example, 2-hydroxyethyl, 3-hydroxypropyl), carboxyalkyl groups (for example, 2-carboxyethyl, 3-carboxypropyl, 4-carboxybutyl, carboxymethyl), alkoxyalkyl groups (for example, 2-methoxyethyl, 2-(methoxyethoxy)ethyl), sulfoalkyl groups (for example, 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl), sulfatoalkyl groups (for example, 3-sulfatopropyl, 4-sulfatobutyl), heterocyclic substituted alkyl groups (for example, 2-pyrrolidin-2-one-1-yl)ethyl, tetrahydrofurfuryl, 2-morpholinoethyl), 2-acetoxyethyl, carbomethoxymethyl 2-methanesulfonylaminoethyl}, allyl groups, aryl groups (for example, phenyl, 2-naphthyl), substituted aryl groups (for example, 4-carboxyphenyl, 4-sulfophenyl, 3-chlorophenyl, 3-methylphenyl), and heterocyclic groups (for example, 2-pyridyl, 2-thiazolyl).

These N-substituents are most desirably unsubstituted alkyl groups (for example, methyl, ethyl, n-propyl, n-butyl, n-pentyl, n-hexyl), carboxyalkyl groups (for example, carboxymethyl, 2-carboxyethyl), or sulfoalkyl groups (for example, 2-sulfoethyl), $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$, $L_{30}$, $L_{31}$, $L_{32}$, $L_{33}$, $L_{34}$, $L_{35}$, $L_{36}$, $L_{37}$, $L_{38}$, $L_{39}$, $L_{40}$, $L_{41}$, $L_{42}$, $L_{43}$, $L_{44}$, $L_{45}$, $L_{46}$, $L_{47}$, $L_{48}$, $L_{49}$, $L_{50}$, $L_{51}$, $L_{52}$, $L_{53}$, $L_{54}$ and $L_{55}$ represent methine groups or substituted methine groups {for example, groups substituted with substituted or unsubstituted alkyl groups (for example, methyl, ethyl, 2-carboxyethyl), substituted or unsubstituted aryl groups (for example, phenyl, o-carboxyphenyl), heterocyclic groups (for example, barbituric acid), halogen atoms (for example, chlorine, bromine), alkoxy groups (for example, methoxy, ethoxy), amino groups (for example, N,N-diphenylamino, N-methyl-N-phenylamino, N-methylpiperidino), alkylthio groups (for example, methylthio, ethylthio)}. They may form rings with other methine groups, or they may form rings with auxochromes.

$L_{19}$ and $L_{34}$ are preferably unsubstituted methine groups or methine groups which are substituted with unsubstituted alkyl groups (for example, methyl), alkoxy groups (for example, methoxy), amino groups (for example, N,N-diphenylamino) or halogen atoms (for example, chlorine), or methine groups substituted with acidic nuclei such as those described earlier in connection with D groups.

The other L groups are preferably unsaturated methine groups.

Other cyanine dyes, merocyanine dyes and complex merocyanine dyes, for example, can be used as spectrally sensitizing dyes in the present invention. Complex cyanine dyes, holopolar cyanine dyes, hemi-cyanine dyes, styryl dyes and hemi-oxonol dyes can also be used. Simple cyanine dyes, carbocyanine dyes, dicarbocyanine dyes and tricarbocyanine dyes can all be used as cyanine dyes.

At least two of the three types of silver halide photosensitive emulsion layers of the present invention are preferably selectively spectrally sensitized so as to match the wavelengths of semiconductor lasers in at least one of the wavelength bands 660 to 690 nm, 740 to 790 nm, 800 to 850 nm and 850 to 900 nm using at least one type of sensitizing dye selected from among the group comprises of compounds which can be represented by the general formulae (I-a), (I-b), (I-c), (I-d), (II-a), (II-b) and (II-c).

In the present invention, the expression "selectively spectrally sensitized so as to match the wavelengths of semiconductors in any of the wavelength bands 660 to 690 nm, 740 to 790 nm, 800 to 850 nm and 850 to 900 nm" signifies spectral sensitization such that with the principal wavelength of one laser light beam in any one of the above-mentioned wavelength bands, in comparison to the photographic speed at the principal wavelength of the said laser light beam of the photosensitive layer which has been spectrally sensitized to match the principal wavelength of the laser light beam, the photographic speed of the other photosensitive layers at the principal wavelength is in practice at least 0.8 (logarithmic representation) lower. For this reason, the principal sensitive wavelength of each photosensitive layer, corresponding to the principal wavelength of the semiconductor laser light beam which is to be used, is preferably established with a separation of at least 40 nm. Sensitizing dyes which give a high photographic speed at the principal wavelength and which has a sharp spectral sensitization distribution are used. Furthermore, the term "principal wavelength" as used herein relates to the true coherent light of a laser light beam. But since there is some variation in practice, consideration must also be given to the fact that the laser light beam principal wavelength has a certain band width.

Infrared sensitization is achieved using the M-band of the sensitizing dye and so in general the spectral sensitization distribution is broader than that obtained using the J-band. Consequently, the establishment of colored layers which contain dyes in the colloid layer on the photosensitive surface side of a prescribed photosensitive layer and modification of the spectral sensitization distribution is desirable. Because of a filter effect these colored layers are effective for preventing color mixing.

Typical examples of dyes which can be represented by the general formulae (I-a), (I-b), (I-c), (I-d), (II-a), (II-b) and (II-c) are indicated below, but these dyes are not limited by these examples. The following are specific examples of dyes which can be represented by the general formula (I-a):

(I-a-1)

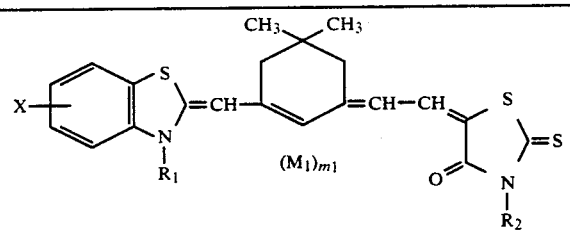

| Compound No. | $R_1$ | $R_2$ | X | $M_1$ | $m_1$ |
|---|---|---|---|---|---|
| (1) | $C_2H_5$ | $C_2H_5$ | H | — | — |
| (2) | $C_2H_5$ | $C_2H_5$ | 6,7-benzo | — | — |
| (3) | $C_2H_5$ | $C_2H_5$ | 4,5-benzo | — | — |
| (4) | $C_2H_5$ | $C_2H_5$ | 5,6-$(OCH_3)_2$ | — | — |
| (5) | $(CH_2)_4SO_3^{\ominus}$ | $C_2H_5$ | 6,7-benzo | $NH^{\oplus}(C_2H_5)_3$ | 1 |
| (6) | $C_2H_5$ | $(CH_2)_2SO_3^{\ominus}$ | 6,7-benzo | $NH^{\oplus}(C_2H_5)_3$ | 1 |
| (7) | $(CH_2)_4CH_3$ | $C_2H_5$ | 5,6-$(CH_3)_2$ | — | — |
| (8) | $(CH_2)_3CO_2H$ | $C_2H_5$ | 6-$CH_3$ | — | — |
| (9) | $(CH_2)_3CH_3$ | $CH_2CO_2H$ | 6,7-benzo | — | — |
| (10) | $(CH_2)_2OCH_3$ | $C_2H_5$ | 4,5-benzo | — | — |

-continued
11
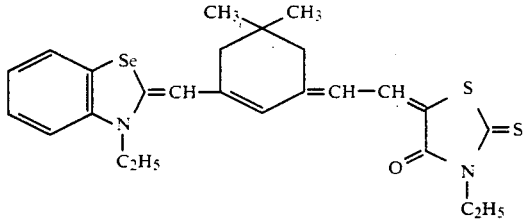
12
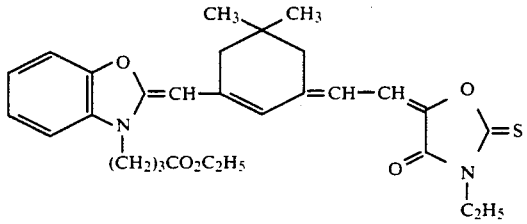
13
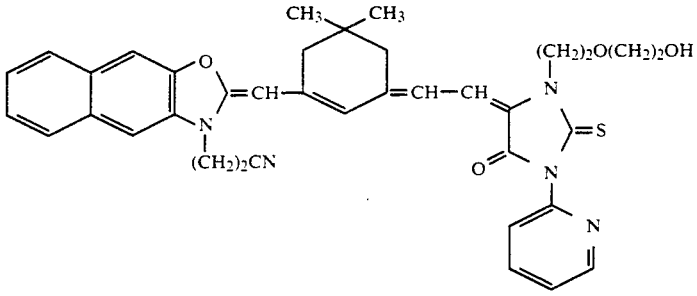
14
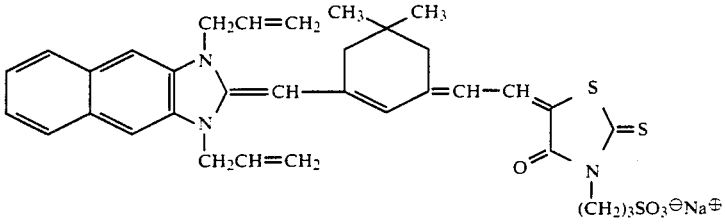
15
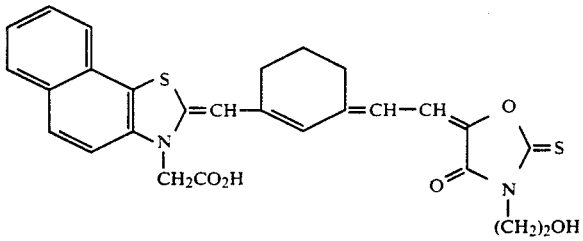
The following are specific examples of dyes which can be represented by the general formula (I-b):
(I-b-1)
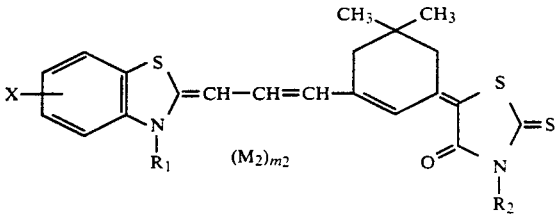
| Compound No. | $R_1$ | $R_2$ | X | $M_2$ | $m_2$ |
|---|---|---|---|---|---|

-continued
| | | | | | |
|---|---|---|---|---|---|
| (16) | $C_2H_5$ | $C_2H_5$ | 6,7-benzo | — | — |
| (17) | $C_2H_5$ | $C_2H_5$ | 4,5-benzo | — | — |
| (18) | $C_2H_5$ | $C_2H_5$ | 5,6-$(OCH_3)_2$ | — | — |
| (19) | $CH_2CO_2H$ | $(CH_2)_3CH_3$ | 5,6-$(CH_3)_2$ | — | — |
| (20) | $(CH_2)_3SO_3^{\ominus}$ | $CH_3$ | H | 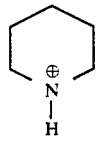 | 1 |
| (21) | $(CH_2)_5CH_3$ | $(CH_2)_2SO_3^{\ominus}$ | 6,7-benzo | $HN^{\oplus}(C_2H_5)_3$ | 1 |
| (22) | $(CH_2)_3CN$ | $CH_2CO_2H$ | 4,5-benzo | — | — |
| (23) | $(CH_2)_2OC_2H_5$ | $CH_2OCH_3$ | 6-Cl | — | — |
| (24) | $SO_3^{\ominus}$ \| $(CH_2)_2CHCH_3$ | $(CH_2)_2CH_3$ | 6-$CH_3$ | $K^{\oplus}$ | 1 |
| (25) | $(CH_2)_2SCH_3$ | $(CH_2)_3CO_2H$ | 6-$OCH_3$ | — | — |
26
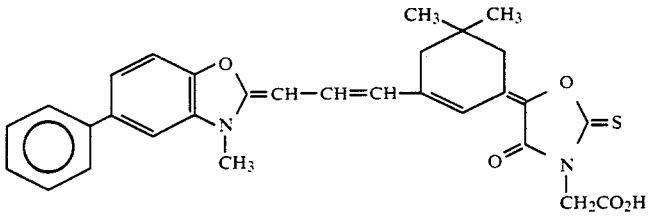
27
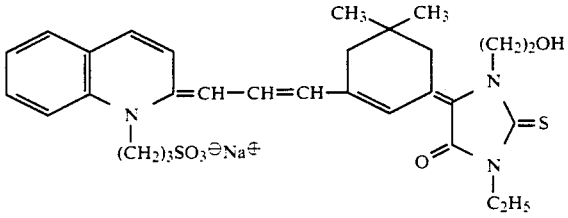
28
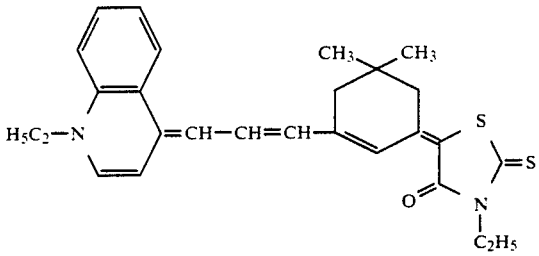
29
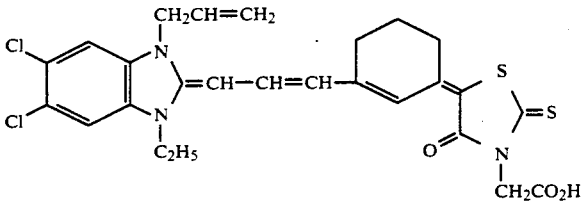
30
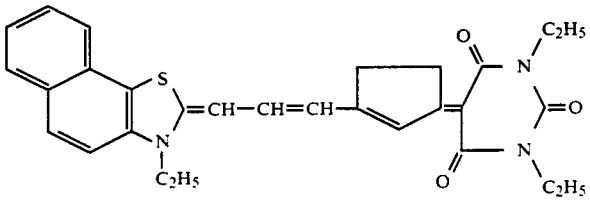

The following are specific examples of compounds represented by the general formula (I-c):
(I-c)
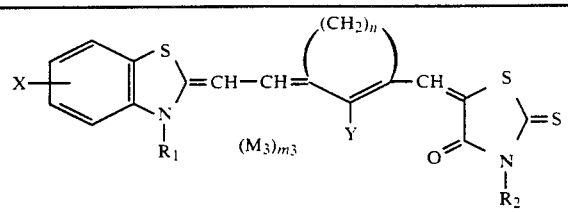
| Compound No. | $R_1$ | $R_2$ | Y | X | n | $M_3$ | $m_3$ |
|---|---|---|---|---|---|---|---|
| (31) | $C_2H_5$ | $C_2H_5$ | H | 6,7-benzo | 2 | — | — |
| (32) | $C_2H_5$ | $C_2H_5$ | H | 6,7-benzo | 3 | — | — |
| (33) | $CH_2CO_2H$ | $C_2H_5$ | Cl | 6,7-benzo | 3 | — | — |
| (34) | $(CH_2)_3SO_3^{\ominus}$ | $CH_3$ | diphenylamino group | 4,5-benzo | 2 | $HN^{\oplus}(C_2H_5)_3$ | 1 |
| (35) | $(CH_2)_2OCH_3$ | $CH_2CO_2H$ | H | 5,6-$(CH_3)_2$ | 4 | — | — |
| (36) | $(CH_2)_7OCH_3$ | $(CH_2)_2SO_3^{\ominus}$ | 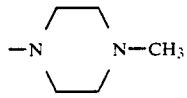 | 5,6-$(OCH_3)_2$ | 3 | $Na^{\oplus}$ | 1 |
| (37) | $(CH_2)_2OH$ | $CH_3$ | " | 6-$CH_3$ | 2 | — | — |
38
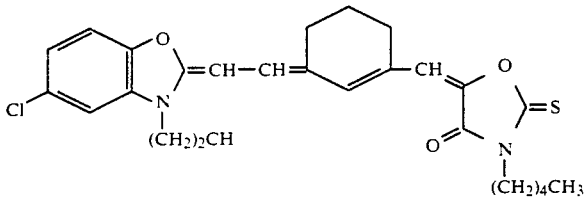
39
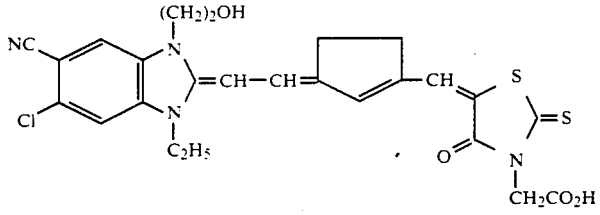
40
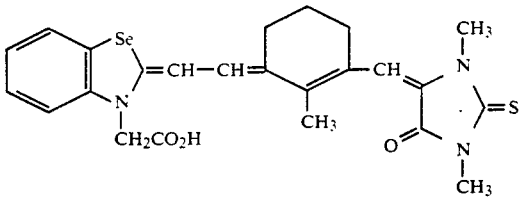
41
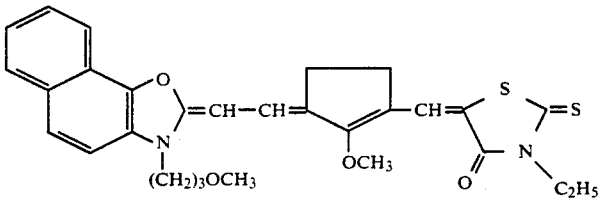
42
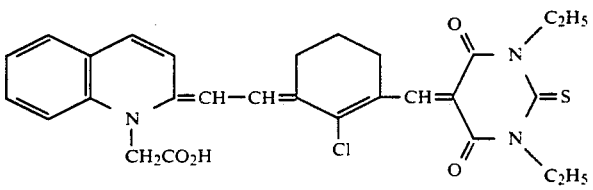

-continued
43
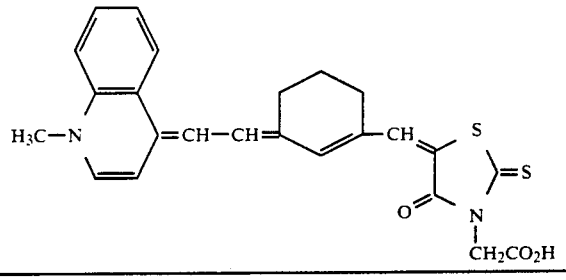
Compounds which can be represented by the general formula (I-d):
(I-d)
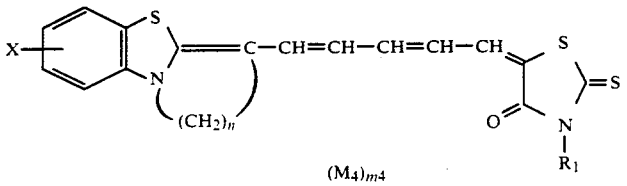
| Compound No. | $R_1$ | X | n | $M_4$ | $m_4$ |
|---|---|---|---|---|---|
| (44) | $C_2H_5$ | 6,7-benzo | 2 | — | — |
| (45) | $C_2H_5$ | 6,7-benzo | 3 | — | — |
| (46) | $C_2H_5$ | 6,7-benzo | 4 | — | — |
| (47) | $CH_2CO_2H$ | 4,5-benzo | 3 | — | — |
| (48) | $(CH_2)_4CH_3$ | $(CH_2)_2SO_3^{\ominus}$ | 3 | $HN^{\oplus}(C_2H_5)_3$ | 1 |
| (49) | $(CH_2)_2OH$ | H | 2 | — | — |
| (50) | $(CH_2)_3SO_3^{\ominus}$ | $CH_2CO_2H$ | 4 | $K^{\oplus}$ | 1 |
51
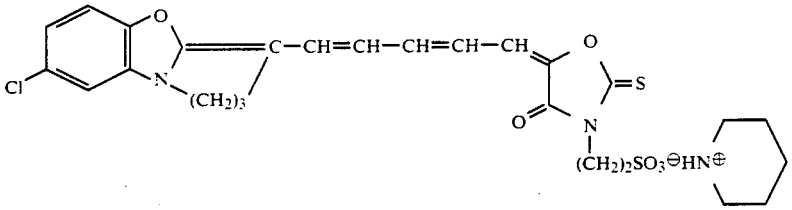
52
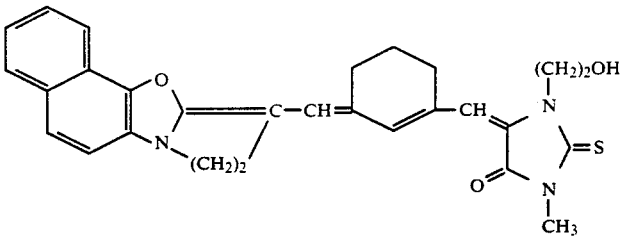
The following are specific examples of compounds represented by the general formula [II-a]:
(II-a)
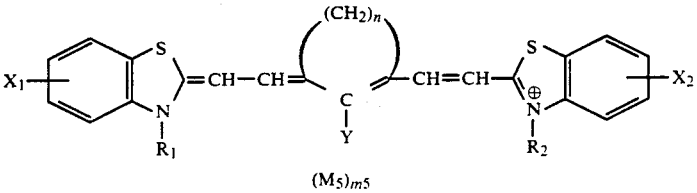
Compound -continued

| No. | $R_1$ | $R_2$ | $X_1$ | $X_2$ | Y | n | $M_5$ | $m_5$ |
|---|---|---|---|---|---|---|---|---|
| (53) | $C_2H_5$ | $C_2H_5$ | H | H | H | 2 | $I^{\ominus}$ | 1 |
| (54) | $C_2H_5$ | $C_2H_5$ | H | H | $N(CH_3)(ph)$ | 2 | $I^{\ominus}$ | 1 |
| (55) | $C_2H_5$ | $C_2H_5$ | H | H | Cl | 3 | $I^{\ominus}$ | 1 |
| (56) | $CH_2CO_2H$ | $C_2H_5$ | H | H | N-$ph_2$ | 2 | $Br^{\ominus}$ | 1 |
| (57) | $(CH_2)_3SO_3^{\ominus}$ | $C_2H_5$ | H | H | H | 2 | $Cl^{\ominus}$ | 1 |
| (58) | $(CH_2)_4CH_3$ | $C_2H_5$ | 6-$CH_3$ | H | H | 3 | $H_3C$—⟨benzene⟩—$SO_3^{\ominus}$ | 1 |
| (59) | $(CH_2)_4SO_3^{\ominus}$ | $(CH_2)_4SO_3^{\ominus}$ | H | H | $OCH_3$ | 3 | $HN(C_2H_5)_3^{\ominus}$ | 1 |
| (60) | $CH_3$ | $C_2H_5$ | 6,7-benzo | 5-$CH_3$ | $CH_3$ | 4 | $I^{\ominus}$ | 1 |

61

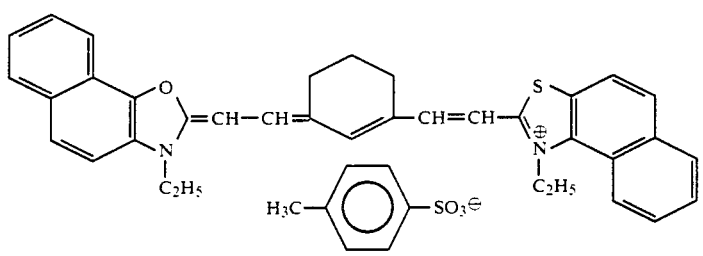

62

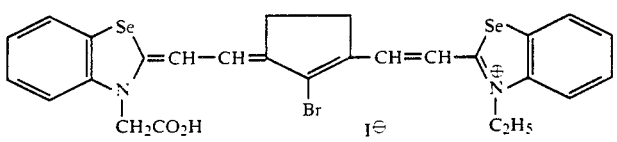

63

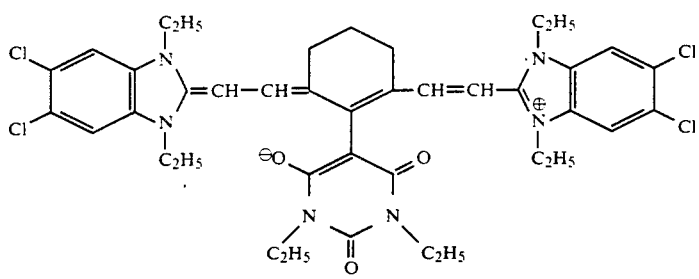

64

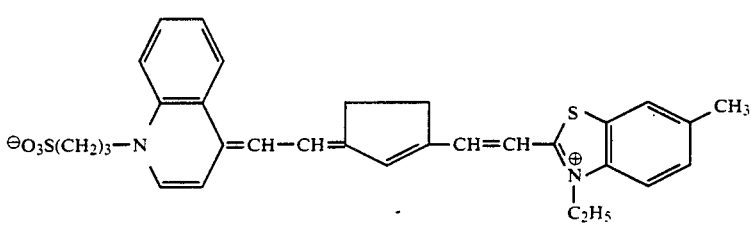

ph = phenyl group

The following are specific examples of compounds represented by general formula (II-b):

(II-b)

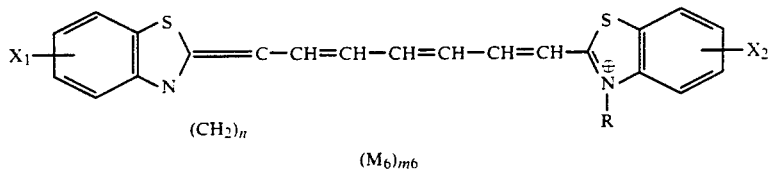

| Compound No. | R | $X_1$ | $X_2$ | n | $M_6$ | $m_6$ |
|---|---|---|---|---|---|---|
| (65) | $C_2H_5$ | 6,7-benzo | H | 2 | $I^{\ominus}$ | 1 |
| (66) | $(CH_2)_3SO_3^{\ominus}$ | 4,5-benzo | 4,5-benzo | 3 | — | — |
| (67) | $(CH_2)_2CO_2H$ | 6,7-benzo | 5,6-$(CH_3)_2$ | 4 | $I^{\ominus}$ | 1 |
| (68) | $(CH_2)_4CH_3$ | 5,6-$(CH_3)_2$ | 5-Cl | 3 | $Br^{\ominus}$ | 1 |
| (69) | $(CH_2)_2CH$ | H | H | 2 | 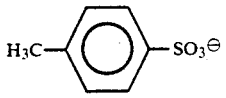 | 1 |

70

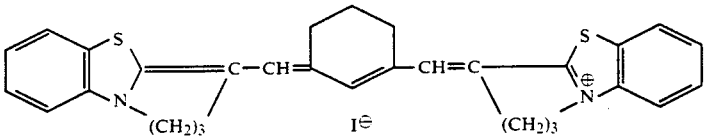

71

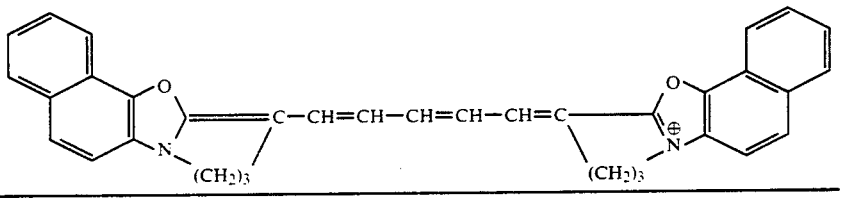

The following are specific examples of compounds represented by the general formula (II-c):

(II-c)

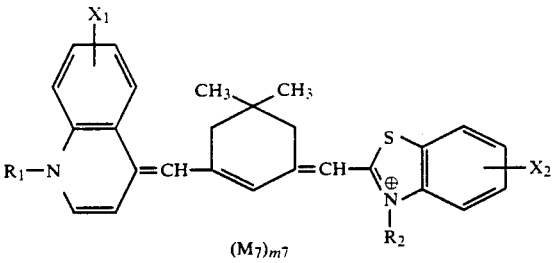

| Compound No. | $R_1$ | $R_2$ | $X_1$ | $X_2$ | $M_7$ | $m_7$ |
|---|---|---|---|---|---|---|
| (72) | $C_2H_5$ | $C_2H_5$ | H | H | $I^{\ominus}$ | 1 |
| (73) | $(CH_2)_4CH_3$ | $C_2H_5$ | 6-$CH_3$ | 4,5-benzo | $Br^{\ominus}$ | 1 |
| (74) | $(CH_2)_3SO_3^{\ominus}$ | $CH_3$ | 8-$OCH_3$ | 5,6-$(OCH_3)_2$ | — | — |
| (75) | $(CH_2)_3SO_3^{\ominus}$ | $(CH_2)_3SO_3^{\ominus}$ | H | 6,7-benzo | 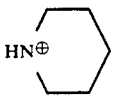 | 1 |
| (76) | $CH_2CO_2H$ | $CH_2CO_2H$ | 6-Cl | 5,6-$(CH_3)_2$ | $I^{\ominus}$ | 1 |
| (77) | $(CH_2)_2OCH_3$ | $(CH_2)_3CH_3$ | 6-Br | 5-Cl | $Cl^{\ominus}$ | 1 |

-continued

78

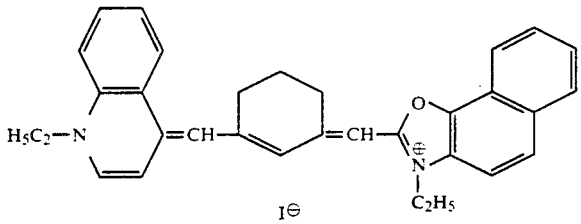

79

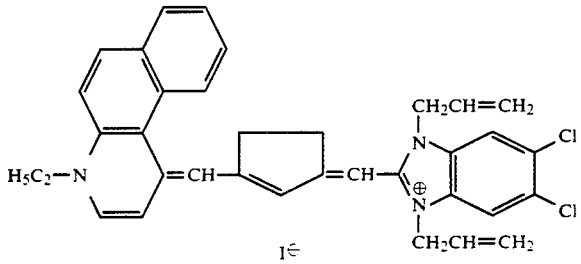

The dyes which are represented by general formulae (I-a), (I-b), (I-c), (I-d), (II-a), (II-b) and (II-c) which are used in the present invention are known compounds.

Compounds of general formula (I-a), (I-b) or (I-d) can be prepared on the basis of the methods disclosed on pages 511 to 611 in chapter XIV of publication (a) in literature list (1) below.

Compounds of general formula (II-b) can be prepared on the basis of the method disclosed on pages 244 to 269 in chapter VIII, or the method disclosed on pages 270 to 291, in chapter IX of publication (a), or on the basis of the method disclosed in publication (b) in literature list (1) below.

Compounds of general formula (II-c) can be prepared on the basis of the method disclosed on pages 200 to 243 in chapter VII, or the method disclosed on pages 270 to 291 in chapter IX, of publication (a), or using the method disclosed in publication (b) in literature list (1) below.

Compounds of general formulae (I-c) and (II-a) can be prepared on the basis of the methods disclosed in the literature in literature list (2) below.

Literature List (1):

(a) F. M. Hamer, *Heterocyclic Compounds—Cyanine Dyes and Related Compounds,* John Wiley & Sons, New York, London, 1964.

(b) D. M. Sturmer, *Heterocyclic Compounds—Special Topics in Heterocyclic Chemistry,* Chapter 8, section 4, pages 482–515 (John Wiley & Sons, New York London, 1977.

Literature List (2):

*Zh. Org. Khim.*, Vol. 17, No. 1, pages 167–169 (1981), ibid, Vol. 15, No. 2, pages 400–407 (1979), ibid. Vol. 14, No. 10, pages 2214–2221 (1978), ibid, Vol. 13, No. 11, pages 2440–2443 (1977), ibid, Vol. 19, No. 10, pages 2134–2142 (1983), *Ukr. Khim. Zh.*, Vol. 40, No. 6, pages 625–629 (1974), *Khim. Geterotsikl. Soedin.*, No. 2, pages 175–178 (1976), U.S. Ser. Nos. 420,643 and 341,823, JP-A-59-217761, U.S. Pat. Nos. 4,334,000, 3,671,648, 3,623,881 and 3,573,921, European Patents 288,261A1, 102,781A2 and JP-B-49-46930. (The term "JP-B" as used herein signifies an "examine Japanes patent publication".)

SYNTHESIS EXAMPLE OF SENSITIZING DYE OF THE PRESENT INVENTION

SYNTHESIS OF COMPOUND (70)

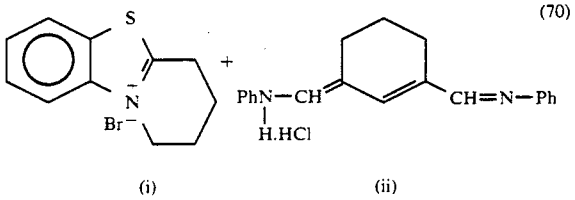

(70)

In 100 ml of methanol were dissolved 3.33 g of a compound of formula (i), 2 g of a compound of formula (ii), and 1.8 g of sodium iodide, and 5 ml of triethylamine was added thereto. The mixture was stirred at room temperature for 3 hours. The reaction mixture was purified by silica gel column chromatography (eluent: methanol/chloroform = $\frac{1}{4}$). Recrystallization from methanol gave 1.27 g (34%) of Compound (70) as bluish green crystals.

$\lambda_{max}^{MeOH} = 792$ nm ($\epsilon = 1.89 \times 10^5$)

Melting Point: 270°–272° C.

The sensitizing dyes used in the present invention are added to the silver halide photographic emulsion at a rate of from $5 \times 10^{-7}$ to $5 \times 10^{-3}$ mol, preferably at a rate of from $1 \times 10^{-6}$ to $1 \times 10^{-3}$ mol, and most desirably at a rate of from $2 \times 10^{-6}$ to $5 \times 10^{-4}$ mol, per mol of silver halide.

The sensitizing dyes used in the present invention can be dispersed directly in the emulsion. Furthermore, they can be dissolved in a suitable solvent, such as methyl alcohol, ethyl alcohol, methylcellosolve, acetone, water or pyridine, for example, or in a mixture of such solvents, and the resulting solution is added to the emulsion. Furthermore, ultrasonics can be used for dissolution purposes. Moreover, infrared sensitizing dyes can be added using a method in which the dye is dissolved in a volatile organic solvent, the solution so obtained is dispersed in a hydrophilic colloid and the dispersion so obtained is dispersed in the emulsion (disclosed, for example, in U.S. Pat. No. 3,469,987), a method in which a water insoluble dye is dispersed in a water soluble solvent in which it is insoluble and the dispersion is added to the emulsion (disclosed, for example, in JP-B-46-24185), a method in which the dye is dissolved in a surfactant and the solution so obtained is added to the emulsion (disclosed in U.S. Pat. No. 3,822,135), a method in which a solution is obtained using a compound which causes a red shift and in which the solution is added to the emulsion (disclosed in JP-A-51-74624), or a method in which the dye is dissolved in an essentially water free acid and the solution is added to the emulsion (disclosed in JP-A-50-80826). Furthermore, the methods disclosed, for example, in U.S. Pat. Nos. 2,912,343, 3,342,605, 2,996,287 and 3,429,835 can also be used for adding the dye to an emulsion. Furthermore, the abovementioned infrared sensitizing dyes can be uniformly dispersed in the silver halide emulsion prior to coating on a suitable support. Furthermore, the addition can be made prior to chemical sensitization or during the latter half of silver halide grain formation.

Super-sensitization with compounds which can be represented by the general formulae (III), (IV), (V), (VI), (VIIa), (VIIb) or (VIIc) which are indicated below in particular can be used for red to infrared M-band type sensitization in the present invention.

The super-sensitizing effect can be amplified specifically by using super-sensitizing agents represented by general formula (III) conjointly with supersensitizing agents represented by the general formulae (IV), (V), (VIIa), (VIIb) and (VIIc).

General Formula (III)

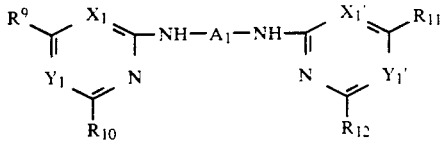

In this formula, $A_1$ represents a divalent aromatic residual group. $R_9$, $R_{10}$, $R_{11}$ and $R_{12}$ each represents a hydrogen atom, a hydroxyl group, an alkyl group, an alkoxy group, an aryloxy group, a halogen atom, a heterocyclic nucleus, a heterocyclylthio group, an arylthio group, an amino group, an alkylamino group, an arylamino group, an aralkylamino group, an aryl group or a mercapto group. These groups may be substituted with substituent groups.

However, at least one of the groups represented by $A_1$, $R_9$, $R_{10}$, $R_{11}$ and $R_{12}$ has a sulfo group. $X_1$ and $Y_1$, and $X_1'$ and $Y_1'$ each represents —CH= or —N=, but at least one of $X_1$ and $Y_1$ represents —N=, and at least one of $X_1'$ and $Y_1'$ represents —N=.

In general formula (III), —$A_1$— represents a divalent aromatic residual group. These groups may contain —$SO_3M$ groups (where M represents a hydrogen atom or a cation, for example, sodium potassium) which provide water solubility.

The —$A_1$— group is usefully selected from among those indicated, for example, under —$A_2$— and —$A_3$— below. However, when there is no —$SO_3M$ group in $R_9$, $R_{10}$, $R_{11}$ or $R_{12}$ then —$A_1$— is selected from among the —$A_2$— groups.

Example of —$A_2$— include:

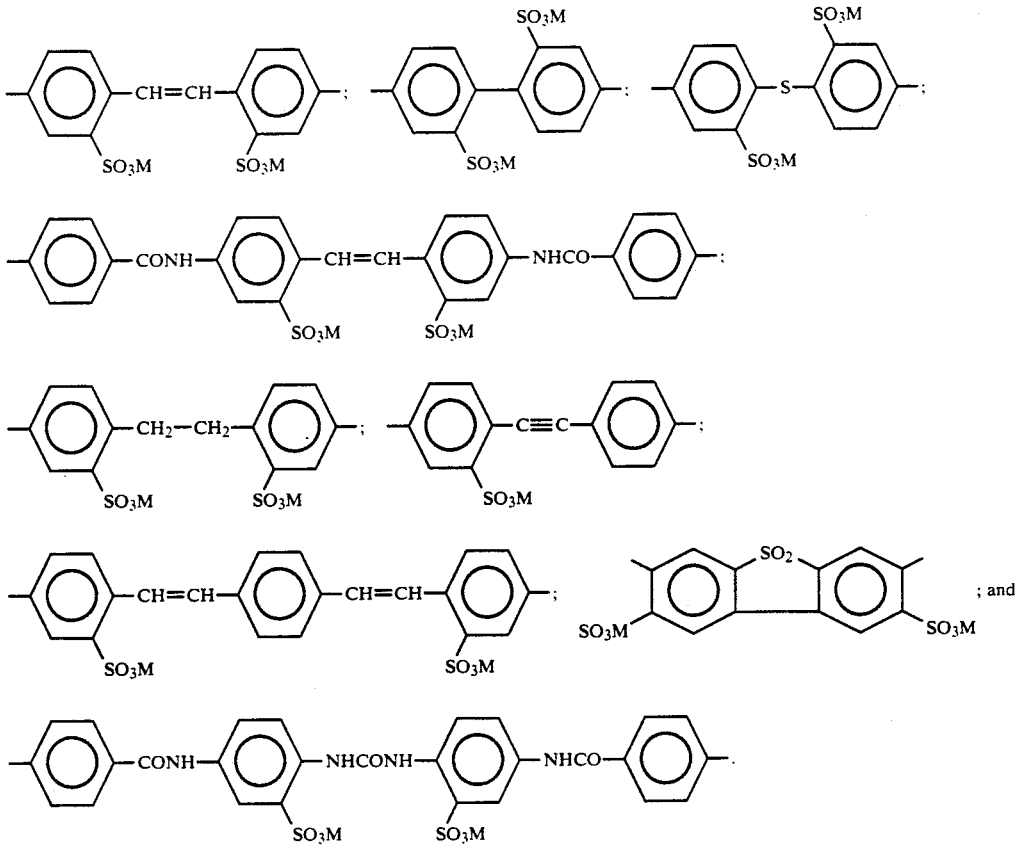

M in the above formulae represents a hydrogen atom or a cation which provides water solubility.

Example of —$A_3$— include:

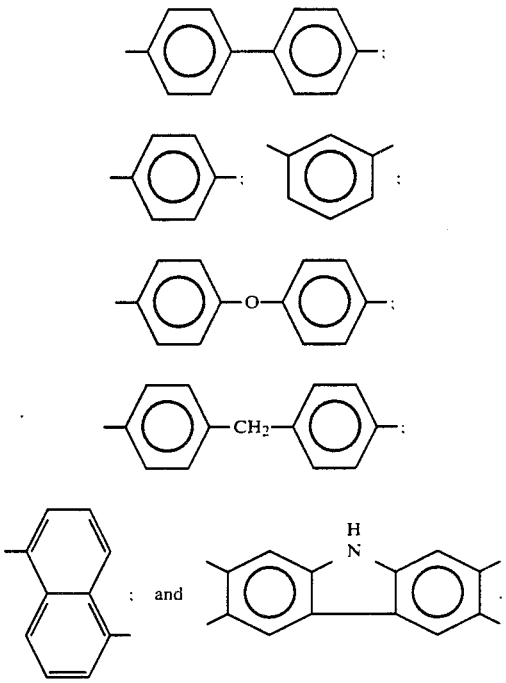

$R_9$, $R_{10}$, $R_{11}$ and $R_{12}$ each represents a hydrogen atom, a hydroxyl group, an alkyl group (which preferably has 1 to 8 carbon atoms, for example, methyl, ethyl, n-propyl, n-butyl), an alkoxy group (which preferably has 1 to 8 carbon atoms, for example, methoxy, ethoxy, propoxy, butoxy), an aryloxy group (for example, phenoxy, n-phthoxy, o-tolyloxy, p-sulfophenoxy), a halogen atom (for example, chlorine, bromine), a heterocyclic nucleus (for example, morpholinyl, piperidyl), an alkylthio group (for example, methylthio, ethylthio), a heterocyclylthio group (for example, benzothiazolylthio, benzimidazolylthio, phenyltetrazolylthio), an arylthio group (for example, phenylthio, tolylthio), an amino group, an alkylamino group or substituted alkylamino group (for example, methylamino, ethylamino, propylamino, dimethylamino, diethylamino, dodecylamino, cyclohexylamino, β-hydroxyethylamino-di-(β-hydroxyethyl)amino, β-sulfoethylamino), an arylamino group or substituted arylamino group (for example, anilino, o-sulfoanilino, m-sulfoanilino, p-sulfoanilino, o-toluidino, m-toluidino, p-toluidino, o-carboxyanilino, m-carboxyanilino, p-carboxyanilino, o-chloroanilino, m-chloroanilino, p-chloroanilino, p-aminoanilino, o-anisidino, m-anisidino, p-anisidino, o-acetaminoanilino, hydroxyanilino, disulfophenylamino, naphthylamino, sulfonaphthylamino), a heterocyclylamino group (for example, 2-benzothiazolylamino, 2-pyridylamino), a substituted or unsubstituted aralkylamino group (for example, benzylamino, o-anisylamino, m-anisylamino, p-anisylamino), an aryl group (for example, phenyl), or a mercapto group.

$R_9$, $R_{10}$, $R_{11}$ and $R_{12}$ may be the same or different. In those cases where —$A_1$— is selected from among the —$A_3$— groups, at least one of the groups $R_9$, $R_{10}$, $R_{11}$ and $R_{12}$ must have a sulfo group (which may be a free sulfo group or in the form of a salt). $X_1$ and $Y_1$, and $X_1'$ and $Y_1'$ represent —CH= or —N=, $X_1$ and $X_1'$ are preferably —CH= and $Y_1$ and $Y_1'$ are preferably —N=.

Specific examples of compounds encompassed by general formula (III) which can be used in the present invention are indicated below, but the invention is not limited to these compounds:

(III-1) 4,4'-Bis[2,6-di(2-naphthoxy)pyrimidin-4-ylamino]stilbene-2,2'-disulfonic acid, di-sodium salt;

(III-2) 4,4'-Bis[2,6-di(2-naphthylamino)pyrimidin-4-ylamino]stilbene-2,2'-disulfonic acid, di-sodium salt;

(III-3) 4,4'-Bis[2,6-dianilinopyrimidin-4-ylamino)-stilbene-2,2'-disulfonic acid, di-sodium salt (III-4) 4,4'-Bis[2-(2-naphthylamino)-6-anilinopyrimidin-4-ylamino]stilbene-2, 2'-disulfonic acid, di-sodium salt;

(III-5) 4,4'-Bis(2,6-diphenoxypyrimidin-4-ylamino)stilbene-2,2'-disulfonic acid, di-triethylammonium salt;

(III-6) 4,4'-Bis[2,6-di(benzimidazolyl-2-thio)pyrimidin-4-ylamino]stilbene-2,2'-disulfonic acid, di-sodium salt;

(III-7) 4,4'-Bis[4,6-di(benzothiazolyl-2-thio) pyrimidin-2-ylamino]stilbene-2,2-disulfonic acid, di-sodium salt;

(III-8) 4,4'-Bis[4,6 di(benzothiazolyl-2-amino)pyrimidin-2-ylamino]stilbene-2,2'-disulfonic acid, di-sodium salt;

(III-9) 4,4'-Bis[4,6-di(naphthyl-2-oxy)pyrimidin-2-ylamino]stilbene-2,2-disulfonic acid, di-sodium salt;

(III-10) 4,4'-Bis(4,6-diphenoxypyrimidin-2-ylamino)stilbene-2,2'-sulfonic acid, di-sodium salt;

(III-11) 4,4'-Bis(4,6-diphenylthiopyrimidin-2-ylamino) stilbene-2,2'-disulfonic acid, di-sodium salt;

(III-12) 4,4'-Bis(4,6-dimercaptopyrimidin-2-ylamino)-biphenyl-2,2'-disulfonic acid, di-sodium salt;

(III-13) 4,4'-Bis(4,6-dianilinotriazin-2-ylamino)stilbene-2,2'-disulfonic acid, di sodium salt;

(III-14) 4,4'-Bis(4-anilino-6-hydroxytriazin-2-ylamino)-stilbene-2,2'-disulfonic acid di-sodium salt;

(III-15) 4,4'-Bis[4,6-di(naphthyl-2-oxy)pyrimidin-2-yl amino]bibenzyl-2,2'-disulfonic acid, di-sodium salt;

(III-16) 4,4'-Bis(4,6-dianilinopyrimidin-2-ylthio)stilbene-2,2'-disulfonic acid, di-sodium salt;

(III-17) 4,4'-Bis[4-chloro-6-(2-naphthyloxy)pyrimidin-2-ylamino)biphenyl-2,2'-disulfonic acid, di-sodium salt;

(III-18) 4,4'-Bis[4,6-di(1-phenyltetrazolyl-5-thio)pyrimidin-2-ylamino]stilbene-2, 2'-disulfonic acid, di-sodium salt;

(III-19) 4,4'-Bis[4,6-di(benbimidazolyl-2-thio)pyrimidin-2-ylamino]stilbene-2,2'-disulfonic acid, di-sodium salt;

(III-20) 4,4'-Bis(4-naphthylamino-6-anilinotriazin-2-ylamino)stilbene-2,2'-disulfonic acid, di-sodium salt;

Among these specific examples, (III-1) to (III-6) are preferred, and (III-1), (III-2), (III-4), (III-5), (III-9), (III-15) and (III-20) are especially desirable.

The compounds represented by general formula (III) are used in amounts from 0.01 to 5 grams per mol of silver halide, and they are useful when used in amounts from 1/1 to 1/100, and preferably in amounts from ½ to 1/50, with respect to the sensitizing dye. The conjoint use of compounds which are represented by the general formula (IV) with these compounds formula (III) is preferred.

The compounds which can be represented by the general formula (IV) are described below.

General Formula (IV)

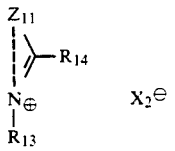

In this formula, $Z_{11}$ represents a group of non-metal atoms which is required to complete a 5- or 6-membered nitrogen containing heterocyclic ring. This ring may be condensed with a benzene ring or a naphthalene ring. Examples of such rings include thiazoliums (for example, thiazolium, 4-methylthiazolium, benzothiazolium, 5-methylbenzothiazolium, 5-chlorobenzothiazolium, 5-methoxybenzothiazolium, 6-methylbenzothiazolium, 6-methoxybenzothiazolium, naphtho[1,2-d]-thiazolium, naphtho[2,1-d]thiazolium), oxazoliums (for example, oxazolium, 4-methyloxazolium, benzoxazolium, 5-chlorobenzoxazolium, 5-phenylbenzoxazolium, 5-methylbenzoxazolium, naphtho[1,2-d]oxazolium), imidazoliums (for example, 1-methylbenzoimidazolium, 1-propyl-5-chlorobenzoimidazolium, 1-ethyl-5,6-dichlorobenzoimidazolium, 1-allyl-5-trifluoromethyl-6-chlorobenzoimidazolium) and selenazoliums (for example, benzoselenazolium, 5-chlorobenzoselenazolium, 5-methylbenzoselenazolium, 5-methoxybenzoselenazolium naphtho[1,2-d]-selenazolium). $R_{13}$ represents a hydrogen atom, an alkyl group (which preferably has not more than 8 carbon atoms, for example, methyl, ethyl, propyl, butyl, pentyl) or an alkenyl group (for example, allyl). $R_{14}$ represents a hydrogen atom or a lower alkyl group (for example, methyl, ethyl). $R_{13}$ and $R_{14}$ may also be example, $Cl^-$, $Br^-$, $I^-$, $ClO_4^-$,). $Z_{11}$ is preferably a thiazolium nucleus, and substituted or unsubstituted benzothiazolium or naphthothiazolium nuclei are especially desirable. Moreover, $Z_{11}$, $R_{13}$ and $R_{14}$ may have substituent groups.

Specific examples of compounds which can be represented by general formula (IV) are indicated below, but the invention is not limited to these compounds.

(IV-1)

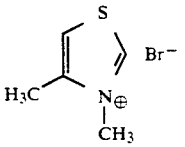

(IV-2)

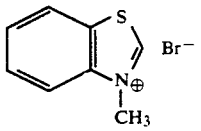

(IV-3)

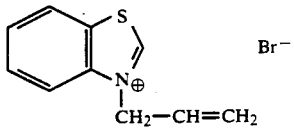

(IV-4)

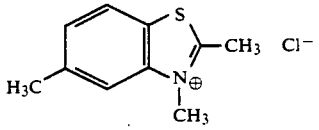

-continued (IV-5)

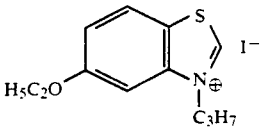

(IV-6)

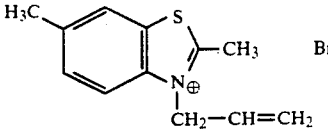

(IV-7)

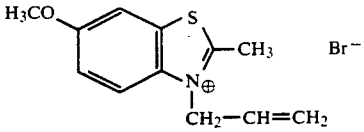

(IV-8)

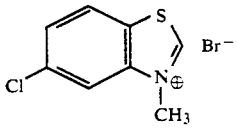

(IV-9)

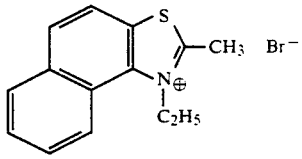

(IV-10)

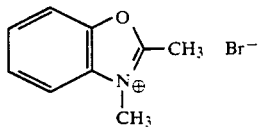

(IV-11)

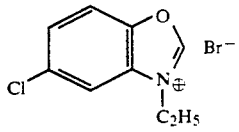

(IV-12)

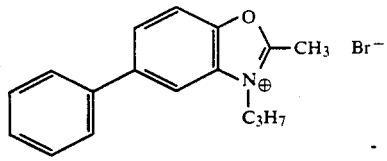

(IV-13)

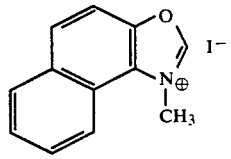

(IV-14)

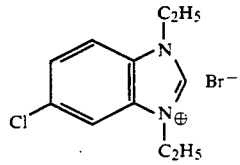

-continued (IV-15)

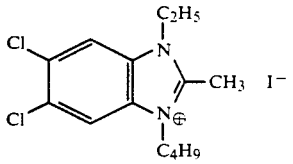

(IV-16)

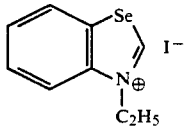

(IV-17)

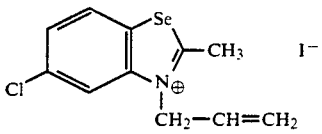

(IV-18)

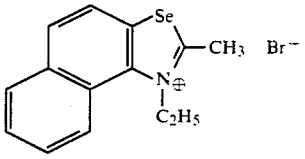

The compounds represented by general formula (IV) which are used in the present invention are conveniently added to the emulsion at a rate of 0.01 gram to 5 grams per mol of silver halide in the emulsion.

The ratio (by weight) of the infrared sensitizing dyes represented by the general formulae (I-a) to (II-c) and the compounds represented by general formula (IV) is within the range from 1/1 to 1/300, and preferably within the range from ½ to 1/50.

The compounds represented by general formula (IV) are used preferably in amounts from 1/10 to 10/1 by weight, more preferably from 1/1 to 2/1 by weight, with respect to the compounds represented by general formula (III).

The compounds represented by general formula (IV) used in the invention can be dispersed directly in the emulsion, or they can be dissolved in an appropriate solvent (for example, water, methyl alcohol, ethyl alcohol, propanol, methylcellosolve or acetone), or in a mixture of these solvents, and then added to the emulsion as a solution. Furthermore, they can be added to the emulsion in the form of a solution or dispersion in a colloid in accordance with known the methods used for adding sensitizing dyes.

The compounds represented by general formula (IV) may be added to the emulsion before the addition of the sensitizing dyes represented by general formula (I-a) to (II-c), or they may be added after the sensitizing dyes have been added. Furthermore, the compounds of general formula (IV) and the sensitizing dyes represented by general formulae (I-a) to (II-c) may be dissolved separately and the separate solutions can be added to the emulsion separately at the same time, or they may be added to the emulsion after mixing.

The use of combinations of infrared sensitizing dyes represented by the general formulae (I-a) to (II-c) of the present invention and compounds represented by the general formula (IV), and most desirably combinations with compounds represented by general formula (III), is convenient.

Latent image stability and a marked improvement in the processing dependence of the linearity of gradation, as well as high speeds and control of fogging, can be achieved by using heterocyclic mercapto compounds together with super-sensitizing agents represented by the general formula (III) or (IV) in the infrared sensitized high silver chloride emulsions of this invention.

For example, heterocyclic compounds which contain a thiazole ring, an oxazole ring, an oxazine ring, a thiazoline ring, a selenazole ring, an imidazole ring, an indoline ring, a pyrrolidine ring, a tetrazole ring, a thiadiazole ring, a quinoline ring or an oxadiazole ring, which is substituted with a mercapto group, can be used for this purpose. Compounds which also contain carboxyl groups, sulfo groups, carbamoyl group, sulfamoyl groups and hydroxyl groups are especially desirable. The use of mercaptoheterocyclic compounds with super-sensitizing agents has been disclosed in JP-B-43-22883. Especially pronounced anti-fogging and super-sensitizing effects can be achieved in this invention by conjoint use with compounds which can be represented by general formula (IV).

Those mercapto compounds which can be represented by general formulae (V) and (VI) indicated below are especially desirable.

General Formula (V)

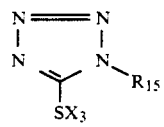

In this formula, $R_{15}$ represents an alkyl group, an alkenyl group or an aryl group. $X_3$ represents a hydrogen atom, an alkali metal atom, an ammonium group, or a precursor. The alkali metal atom is, for example, sodium or potassium, and the ammonium group is, for example, a tetramethylammonium group or a trimethylbenzyl-ammonium group. Furthermore, a precursor is defined as a group such that $X_3$ becomes H or an alkali metal under alkaline conditions, for example, an acetyl group, a cyanoethyl group or a methanesulfonylethyl group.

The alkyl and alkenyl groups represented by $R_{15}$ as described above include unsubstituted and substituted groups and alicyclic groups. The substituent groups of the substituted alkyl groups may be, for example, halogen atoms, nitro groups, cyano groups, hydroxyl groups, alkoxy groups, aryl groups, acylamino groups, alkoxycarbonylamino groups, ureido groups, amino groups, heterocyclic groups, acyl groups, sulfamoyl groups, sulfonamido groups, thioureido groups, carbamoyl groups, alkylthio groups, arylthio groups, heterocyclylthio groups, and the carboxylic acid and sulfonic acid groups or salts thereof.

The above-mentioned ureido groups, thioureido groups, sulfamoyl groups, carbamoyl groups and amino groups include unsubstituted groups, N-alkyl substituted groups and N-aryl substituted groups. A phenyl group and substituted phenyl groups, are examples of the aryl groups. These groups may be substituted with alkyl groups and the substituent groups for alkyl groups described above.

General Formula (VI)

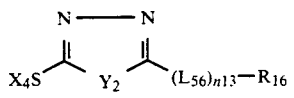

In this formula, $Y_2$ is an oxygen atom, a sulfur atom, =NH or =N-$(L_{57})_{n14}$—$R_{17}$, $L_{56}$ and $L_{57}$ represent divalent linking groups, and $R_{16}$ and $R_{17}$ represent hydrogen atoms, alkyl groups, alkenyl groups or aryl groups. The alkyl groups, alkenyl groups and aryl groups or $R_{16}$ or $R_{17}$ have the same meaning as $R_{15}$ in general formula (V). $X_4$ has the same meaning as $X_3$ in general formula (V).

Specific examples of the divalent linking groups represented by $L_{56}$ and $L_{57}$ include

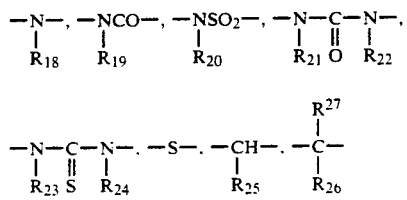

and combination thereof.

Moreover, $n_{13}$ and $n_{14}$ represent 0 or 1, and $R_{18}$, $R_{19}$, $R_{20}$, $R_{21}$, $R_{22}$, $R_{23}$, $R_{24}$, $R_{25}$ and $R_{26}$ each represents a hydrogen atom, an alkyl group or an aralkyl group.

These compounds may be included in any layer, which is to say in a photosensitive or a non-photosensitive hydrophilic colloid layer, in the silver halide color photographic material.

The amount of the compounds represented by general formula (V) or (VI) added is from $1\times10^{-5}$ to $5\times10^{-2}$ mol, and preferably from $1\times10^{-4}$ to $1\times10^{-2}$ mol. per mol of silver halide when they are included in a silver halide color photographic photosensitive material. Furthermore, they can be added to color development baths as anti-foggants at concentrations of $1\times10^{-6}$ to $1\times10^{-3}$ mol/liter, and preferably at concentrations of $5\times10^{-6}$ to $5\times10^{-4}$ mol/liter.

The compounds represented by formulae (III), (V), and (VI) are dispersed directly in an emulsion or one dissolved in an appropriate solvent (e.g., water, methyl alcohol, ethyl alcohol, propanol, methyl cellosolve, and acetone, or a mixture thereof and then incorporated into an emulsion. Also, they may be incorporated into an emulsion in the form of a solution or a colloidal dispersion in accordance with the mode of addition of sensitizing dyes.

Specific examples of compounds which can be represented by the general formulae (V) and (VI) are indicated below, but the invention is not limited by these examples. The compounds disclosed on pages 4 to 8 of the specification of JP-A-62-269957 can be cited and, of these, the compounds indicated below are especially desirable.

(V-1)

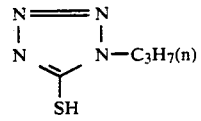

-continued (V-2)

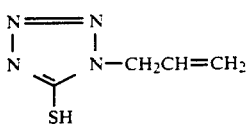

(V-3)

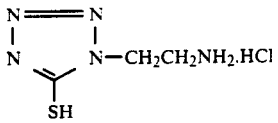

(V-4)

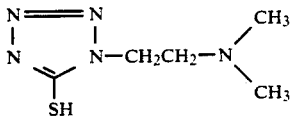

(V-5)

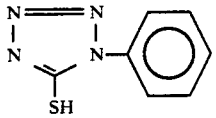

(V-6)

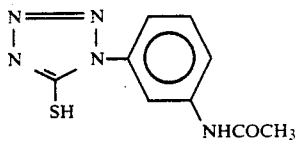

(V-7)

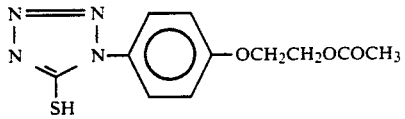

(V-8)

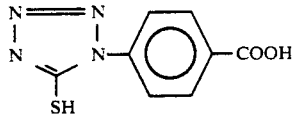

(V-9)

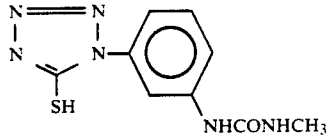

(V-10)

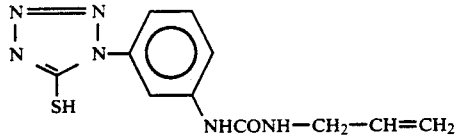

(VI-1)

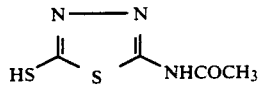

(VI-2)

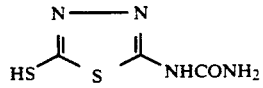

(VI-3)

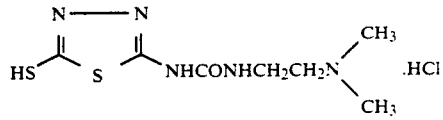

-continued (VI-4)

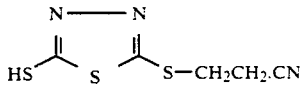

(VI-5)

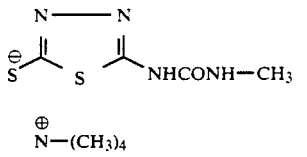

(VI-6)

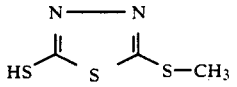

(VI-7)

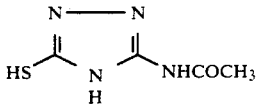

(VI-8)

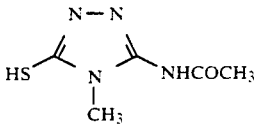

(VI-9)

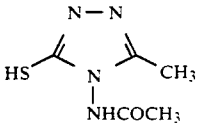

(VI-10)

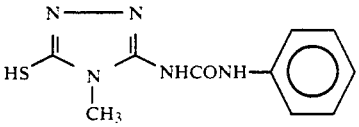

(VI-11)

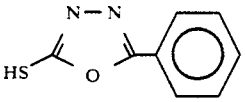

Moreover, substituted or unsubstituted polyhydroxybenzenes represented by the general formulae (VIIa), (VIIb) and (VIIc) below, and condensates with formaldehyde having two to ten condensed units can be used as super-sensitizing agents with red sensitization and infrared sensitization in accordance with the present invention. Furthermore, this is also effective for preventing regression of the latent image due to aging and for preventing loss of gradation.

General Formula (VIIa)

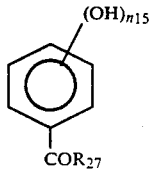

-continued

General Formula (VIIb)

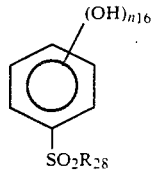

General Formula (VIIc)

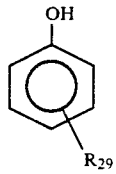

In these formulae, $R_{27}$, and $R_{28}$ each represents —OH, —OM', —$OR_{30}$, —$NH_2$, —$NH_{30}$, —$NH(R_{30})_2$, —$NHNH_2$ or —$NHNHR_{30}$.

$R_{30}$ represents an alkyl group (which has 1 to 8 carbon atoms), an aryl group or an aralkyl group.

M' represents an alkali metal or an alkaline earth metal.

$R_{29}$ represents —OH or a halogen atom.

Moreover, $n_{15}$ and $n_{16}$ each represents 1, 2 or 3.

Specific examples of substituted and unsubstituted polyhydroxybenzenes which form components for aldehyde condensates which can be used in the invention are indicated below, but they are not limited to these examples.

(VII-1) β-resorcylic acid
(VII-2) γ-resorcylic acid
(VII-3) 4-Hydroxybenzoic acid hydrazide
(VII-4) 3,5-Hydroxybenzoic acid hydrazide
(VII-5) p-Chlorophenol
(VII-6) Sodium hydroxybenzenesulfonate
(VII-7) p-Hydroxybenzoic acid
(VII-8) o-Hydroxybenzoic acid
(VII-9) m-Hydroxybenzoic acid
(VII-10) p-Dioxybenzene
(VII-11) Gallic acid
(VII-12) Methyl p-hydroxybenzoate
(VII-13) o-Hydroxybenzenesulfonic acid amide
(VII-14)N-Ethyl-o-hydroxybenzoic acid amide

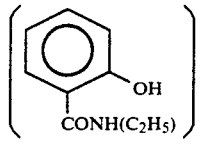

(VII-15)N-Diethyl-o-hydroxybenzoic acid amide

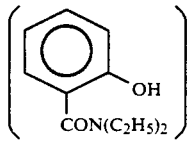

(VII-16)o-Hydroxybenzoic acid 2-methylhydrazide

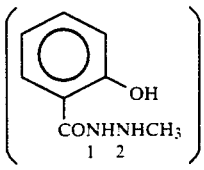

Moreover, in practical terms, they can be selected from among the derivatives of the compounds represented by general formulae (IIa), (IIb) and (IIc) disclosed in JP-B-49-49505

Silver Halide Emulsions

The silver halide emulsions which can be used in the present invention may contain silver bromide, silver iodobromides, silver iodochlorobromides, silver chlorobromides and silver chloride.

The silver halide grains may have a regular crystal structure, such as a cubic, octahedral, tetradecahedral or rhombo-dodecahedral form, or they may have an irregular crystal form, such as a spherical or plate-like form, or they may have a crystal form which is a composite of these crystal forms. They may also be comprised of mixtures of grains of various crystal forms.

The aforementioned plate-like grains are preferably tabular grains of a thickness of not more than 0.5 microns, and preferably of not more than 0.3 microns. They have a diameter preferably of at least 0.6 microns, with grains having an average aspect ratio of at least 5 accounting for at leat 50% of the total projected area.

The silver halide grains may be such that the interior and surface layer consist of different phases, or they may be comprised of a uniform phase. Furthermore, they may be grains such that the latent image is formed principally on the surface of the grains (for example, a negative type emulsion) or they may be of the type with which the latent image is formed within the grains (for example, an internal latent image type emulsion).

The silver halide emulsions preferably used in the present invention are described in detail below.

The silver halide emulsions in the present invention are spectrally sensitized in the infrared region and have a high photographic speed and excellent stability, especially latent image stability, as a result of the structure of the silver halide grains, and especially as a result of the establishment of a local phase at the surface of the grains. Super-sensitizing techniques can be used conjointly in the present invention, and a tolerable latent image stability can be realized even with high silver chloride emulsions. This is an unexpected feature.

The halogen composition of the silver halide grains in the present invention is preferably that of an essentially silver iodide free silver chlorobromide in which at least 95 mol% of all the silver halide from which the silver halide grains are constructed is silver chloride. Here, the term "essentially silver iodide free" signifies that the silver iodide content is not more than 1.0 mol%. The preferred halogen composition of the silver halide grains is that of an essentially silver iodide free silver chlorobromide in which from 95 mol% to 99.9 mol% of all the silver halide from which the silver halide grains are constructed is silver chloride.

The silver halide grains of the present invention preferably have a local phase which has a different silver bromide content from that contained in the substrate in at least some of interior and surface parts. The silver halide grains in this invention preferably have a local phase in which the silver bromide content is at least 15 mol%. The arrangement of this local phase in which the silver bromide content is higher than that of the surroundings can be provided freely, in accordance with the intended purpose. It may be in the interior of the silver halide grains or at the surface or in the sub-surface region, or it may be divided between the interior and the surface or sub-surface regions. Furthermore, the local phase may form a layer like structure which surrounds the silver halide or it may have a discontinuous isolated structure, within the grain or at the grain surface. In a preferred arrangement of the local phase in which the silver bromide content is higher than that of the surroundings, a local phase in which the silver bromide content exceeds 15 mol% is grown epitaxially and locally on the surface of the silver halide grains.

The silver bromide content of the said local phase preferably exceeds 15 mol%, but if it is too high then characteristics undesirable in a photographic photosensitive material, such as desensitization which may occur when pressure is applied to the photosensitive material, and large variations in speed and gradation due to changes in the composition of the processing baths, for example, are likely to occur. In consideration of these facts, the silver bromide content of the said local phase is preferably within the range from 20 to 60 mol%, and most desirably within the range from 30 to 50 mol%, and the remainder is most desirably silver chloride. The silver bromide content of the said local phase can be measured, for example, using an X-ray diffraction method (for example, that described in the Japanese Chemical Society Publication entitled *New Experiments Chemistry Course* 6, *Structure Analysis,* published by Maruzen), or the XPS method (for example, that described *Surface Analysis, The Application of IMA, Auger Electron—Photoelectron Spectroscopy,* published by Kodansha). The local phase preferably contains from 0.1 to 20%, and most desirably from 0.5 to 7%, of all the silver from which the silver halide grain is formed in the present invention.

The boundary between such a local phase which has a high silver bromide content and another phase may be a distinct boundary, or there may be a short transition zone in which the halogen composition changes gradually.

Various methods can be used to form such a local phase which has a high silver bromide content. For example, a local phase can be formed by reacting a soluble halide with a soluble silver salt using a single sided mixing procedure or a simultaneous mixing procedure. Moreover, the local phase can be formed using a so-called conversion method which includes a process in which a silver halide which has been formed is converted to a silver halide which has a lower solubility product. Alternatively, the local phase can be formed by recrystallization at the surface of silver chloride grains, which is brought about by the addition of fine silver bromide grains.

In the case of silver halide grains which have a discontinuous isolated local phase at the surface, the grain substrate and the local phase are both present on essentially the same surface of the grain. Consequently, they both function at the same time during exposure and development processing. The invention is useful for increasing photographic speed, for latent image formation and for rapid processing, and it is especially useful in terms of the gradation balance and the efficient use of the silver halide. In the present invention, the increase in sensitivity, the stabilization of photographic speed and the stability of the latent image which usually present problems with infrared sensitized high silver chloride emulsions are markedly improved overall by the establishment of the local phase, and the distinguishing features of silver chloride emulsions in connection with rapid processing can be maintained.

Furthermore, anti-foggants, and sensitizing dyes etc. can be adsorbed on the grain substrate and on the local phase with the functions separated. Further, it is possible to achieve chemical sensitization, to suppress the occurrence of fogging and to achieve rapid development easily.

Those cases in which the silver halide grains included in the silver halide emulsions of this invention are cubic or tetradecahedral grains which have a (100) plane, and in which the local phase is at, or in the vicinity of, the corners of the cube and on the surface of a (111) plane are preferred. A discontinuous isolated local phase on the surface of these silver halide grains can be formed by halogen conversion by supplying bromide ions to an emulsion which contains the substrate grains while controlling the pAg and pH values, the temperature and the time. It is desirable that the halide ions should be supplied at a low concentration, and the organic halogen compounds or halogen compounds which have been covered with a semipermeable membrane as a encapsulating film can be used, for example, for this purpose. Furthermore, a "local phase" can be formed by growing silver halide locally by supplying silver ions and halide ions to an emulsion which contains the substrate grains, while controlling the pAg value and growing silver halide locally, or by mixing a fine grain silver halide, for example, fine grains of silver halide (for example, silver iodobromide, silver bromide, silver chlorobromide or silver iodochlorobromide), of a size smaller than that of the substrate grains with an emulsion which contains the substrate grains and carrying out a recrystallization. A small amount of a silver halide solvent can be used in this case, as required. Furthermore, the CR-compounds disclosed in European Patents 273,430 and 273,429, and in Japanese Patent Applications Nos. 62-86163, 62-86165, 62-86252 and 62-152330 can be used conjointly. The end point of local phase formation can be assessed easily by observing the form of the silver halide in the ripening process and comparing this with the form of the substrate silver halide grains. The composition of the local phase silver halide can be measured using the XPS (X-ray photoelectron spectroscopy) method, using an ESCA 750 type spectrometer made by the Shimadzu Dupont Co. for example. Practical details have been described by Y. Someno in *Surface Analysis,* published by Kodansha, 1977. Of course, it can also be determined by calculation from the production details. The silver halide composition, for example, the silver bromide content, of the local phase at the surface of silver halide grains in the present invention can be measured using the EDX (energy dispersive X-ray analysis) method with an EDX spectrometer fitted to a transmission type electron microscope, and an accuracy of some 5 mol% can be achieved in the measurements by using an aperture of diameter from about 0.1 to 0.2 μm. Practical details have been disclosed by H. Soejima in *Electron Beam Microanalysis,* published by Nikkan Kogyo Shinbunsha, 1987).

The average size (the average value of the corresponding sphere diameters) of the grains in the silver halide emulsions used in the present invention is preferably not more than 2 μ but at least 0.1 μ. An average grain size of not more than 0.4 μ but of at least 0.15 μ is especially desirable.

A narrow grain size distribution is best, and mono-disperse emulsions are preferred. Mono-disperse emulsions which have a regular form are especially desirable in the present invention. Emulsions in which at least 85%, and preferably at least 90%, of all the grains in terms of the number of grains or in terms of weight are within ±20% of the average grain size are especially desirable.

The photographic emulsions used in the invention can be prepared using the methods disclosed, for example, by P. Glafkides in *Chimie et Physique Photographique,* published by Paul Montel, 1967, by G. F. Duffin in *Photographic Emulsion Chemistry, published by Focal Press,* 1966, and by V. L. Zelikmann et al. in *Making and Coating Photographic Emulsions,* published by Focal Press, 1964. That is to say, they can be prepared using acidic methods, neutral methods and ammonia methods for example, but the acid methods are preferred. Furthermore, a single sided mixing procedure, a simultaneous mixing procedure, or a combination of such procedures, can be used for reacting the soluble silver salt with the soluble halide. Simultaneous mixing methods are preferred for obtaining the mono-disperse emulsions which are preferred in the present invention. Methods in which the grains are formed under conditions of excess silver ion (so called reverse mixing methods) can also be used. The method in which the silver ion concentration in the liquid phase in which the silver halide is being formed is held constant, which is to say the so-called controlled double jet method, can be used as one type of simultaneous mixing method. It is possible to obtain mono-disperse emulsions with a regular crystalline form and a narrow grain size distribution which are ideal for the present invention when this method is used. It is desirable that grains such as those described above which are preferably used in the present invention should be prepared on the basis on a simultaneous mixing method.

It is possible to obtain mono-disperse silver halide emulsions which have a regular crystalline form and a narrow grain size distribution if physical ripening is carried out in the presence of a known silver halide solvent (for example, ammonia, potassium thiocyanate, or the thioether compounds and thione compounds disclosed, for example, in U.S. Pat. Nos. 3,271,157, JP A-51-12360, JP-A-53-82408, JP-A-53-144319, JP-A-54-100717 and JP-A-54-155828) and this is preferred.

Noodle washing, flocculation precipitation methods and ultra-filtration can be used, for example, to remove the soluble salts from the emulsion after physical ripening.

The silver halide emulsions used in the present invention can be chemically sensitized by sulfur sensitization or selenium sensitization, reduction sensitization or precious mental sensitization, for example, either independently or in combination. That is to say, sulfur sensitization methods in which active gelatin or compounds which contain sulfur which can react with silver ions (for example, thiosulfates, thiourea compounds, mercapto compounds and rhodanine compounds) are used, reduction sensitization methods in which reducing substances (for example, stannous salts, amines, hydrazine derivatives, formamidinesulfinic acid and silane derivatives) are used, and precious metal sensitization methods in which metal compounds (for example, gold complex salts. and complex salts of the metals of group VIII of the periodic table, such as Pt, Ir, Pd, Rh and Fe) are used can be performed either independently or in combination. Furthermore, complex salts of metals of groups VIII of the periodic table, for example, Ir, Rh, Fe, can be used separately or conjointly in the substrate and the local phase. The use of sulfur sensitization or selenium sensitization is especially desirable with the mono-disperse silver chlorobromide emulsions which can be used in the present invention, and the presence of hydroxyazaindene compounds during the sensitization is preferred.

Light Sources

The light beam outputting devices used in the present invention are described below.

Semiconductor lasers are preferred for the lasers which are used in the present invention, and specific examples of these include those in which materials such as $In_{1-x}Ga_xP$ (up to 700 nm), $GaAs_{1-x}P_x$ (610–900 nm), $Ga_{1-x}Al_xAs$ (690–900 nm), InGaAsP (1100–1670 nm) and AlGaAsSb (1250–1400 nm), for example, are used. The light which is directed onto the color photosensitive material in the present invention may be the light emitted by the above-mentioned semiconductor lasers or it may be light from a YAG laser (1064 nm) in which an Nb:YAG crystal is excited by means of a $GaAs_xP_{(1-x)}$ light emitting diode. The use of light selected from among the semiconductor laser light beams of wavelength 670, 680, 750, 780, 810, 830 and 880 nm is preferred.

Furthermore, devices with which the wavelength of laser light is halved using a non-linear optical effect with a second harmonic generator element (SHG element), for example those in which CD*A and KD*P are used as non-linear optical crystals, can be used in the present invention (see pages 122–139 of the Laser Society publication *Laser Handbook,* published December 15th, 1982). Furthermore, $LiNbO_3$ optical wave guide elements in which the optical wave guides have been formed by exchanging $Li^+$ ions in an $LiNbO_3$ crystal with $H^+$ ions can be used (*Nikkei Electronics,* 14th July, 1986 (No. 399), pages 89–90).

The output device disclosed in the specification of Japanese Patent Application No. 63-226552 can be used in the present invention.

Method of Processing

The photographic processing of photosensitive materials made using the present invention can be carried out using the known methods (color photographic processing) and processing baths for forming dye images, such as those disclosed in *Research Disclosure,* No. 176, pages 28–30 (RD-17643).

Examples of the preferred color development processing operations and processing baths which can be used with photosensitive materials of the present invention are described below.

The color photographic photosensitive materials of the present invention are preferably subjected to color development, bleach-fixing and a water washing process (or stabilization process). Bleaching and fixing can be carried out separately rather than in a single bath.

The known primary aromatic amine color developing agents can be included in the color development baths which are used in the present invention. The p-phnylenediamine derivatives are preferred, and typical example of these are indicated below, but the developing agent is not limited to these examples:

(D-1) N,N-Diethyl-p-phenylenediamine
(D-2) 2-Amino-5-diethylaminotoluene
(D-3) 2-Amino-5-(N-ethyl-N-laurylamino)toluene
(D-4) 4-[N-ethyl- N-β(hydroxyethyl)amino]aniline
(D-5) 2-Methyl-4-[N-ethyl-N-(β-hydroxyethyl-)amino]aniline
(D-6) 4-Amino-3-methyl-N-ethyl-N-(β-methanesulfonamido)ethyl]aniline
(D-7) N-(2-Amino-5-diethylaminophenylethyl)methanesulfonamide
(D-8) N,N-Dimethyl-p-phenylenediamine
(D-9) 4-Amino-3-methyl-N-ethyl N-methoxyethylaniline
(D-10) 4-Amino-3-methyl-N-ethyl-N-β-ethoxyethylaniline
(D-11) 4-Amino-3-methyl-N-ethyl-N-β-butoxyethylaniline Among the above-mentioned p-phenylenediamine derivatives, 4-amino-3-methyl-N-ethyl N [β-(methanesulfonamido)ethyl]aniline (illustrative compound D-6) is preferred.

Furthermore, these p-phenylenediamine derivatives may take the form of salts, such as sulfates, hydrochlorides sulfites or p-toluenesulfonates for example. The amount of the said primary aromatic amine developing agent used is preferably from about 0.1 to about 20 grams, and most desirably from about 0.5 to about 10 grams, per liter of development bath.

The use of an essentially benzyl alcohol free development bath is preferred for the execution of the present invention. Here, the term "essentially benzyl alcohol free" signifies that the benzylalcohol concentration is preferably not more than 2 ml/l, more desirably that the benzyl alcohol concentration is not more than 0.5 ml/l, and most desirably that the development bath contains no benzyl alcohol at all.

The development baths used in the present invention are preferably essentially sulfite ion free. The sulfite ion has a silver halide dissolving action and a function of reducing the efficiency with which dyes are formed, by a reaction with the oxidized form of the developing agent as well as functioning as a preservative for the developing agent. It can be determined that effects of this type are one of the causes of the large changes which occur in photographic performance during continuous processing. The term "essentially sulfite ion free" means that the sulfite ion concentration is preferably not more than $3.0\times10^{-3}$ mol/liter, and most desirably that the bath contains no sulfite ion at all. However, small amounts of sulfite ion such as those used to prevent oxidation in processing kits in which the developing agent is in a concentrated form prior to dilution for use are not necessarily excluded from this invention.

The development baths used in the present invention are preferably essentially sulfite ion free, but more desirably they are essentially hydroxylamine free. This is because hydroxylamine itself has a silver developing activity as well as functioning as a preservative and it is thought that changes in the hydroxylamine concentration will have a marked effect on photographic characteristics. Here, the term "essentially hydroxylamine free" means hydroxylamine concentration preferably of not more than $5.0\times10^{-3}$ mol/liter, and most desirably that the development bath contains no hydroxylamine at all.

The development baths used in the present invention most desirably contain organic preservatives in place of the aforementioned hydroxylamine and sulfite ion.

Here, an "organic preservative" means an organic compound which, when added to a processing bath for color photographic photosensitive materials, reduces the rate of deterioration of the primary aromatic amine color developing agent. That is to say, they are organic compounds which have the function of preventing the aerial oxidation of color developing agents, for example. Among these compounds, the hydroxylamine derivatives (except hydroxylamine, same hereinafter), hydroxamic acids, hydrazines, hydrazides, phenols, α-hydroxyketones, α-aminoketones, sugars, mono-amines, di-amines, poly-amines, quaternary ammonium salts, nitroxy radicals, alcohols, oximes, diamido compounds and condensed ring amines, for example, are especially effective organic preservatives. These have been disclosed, for example, in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020 and JP-B-48-30496.

The various metals disclosed in JP-A-57-44148 and JP-A-57-53749, the salicylic acids disclosed in JP A-59-180588, the alkanolamines disclosed in JP-A-54-3532, the polyethyleneimines disclosed in JP-A-56-94349, and the aromatic polyhydroxy compounds disclosed, for example, in U.S. Pat. No. 3,746,544, etc. can also be included, as required, as preservatives. The addition of alkanolamines such as triethanolamine, dialkylhydroxylamines such as diethylhydroxylamine, hydrazine derivatives or aromatic polyhydroxy compounds is especially desirable.

Among the aforementioned organic preservatives, the hydroxylamine derivatives and hydrazine derivatives (hydrazine derivatives and hydrazone derivatives) are especially desirable, and details have been disclosed, for example, in Japanese Patent Application Nos. 62-255270, 63-9713, 63-9714 and 63-11300.

Furthermore, the conjoint use of amines with the aforementioned hydroxylamine derivatives or hydrazine derivatives is desirable for increasing the stability of the color development bath and for increasing stability during continuous processing.

The aforementioned amines may be amines such as the cyclic amines disclosed in JP-A-63-239447, the amines disclosed in JP-A-63-128340 or others amines such as those disclosed in Japanese Patent Application Nos. 63-9713 and 63-11300.

The inclusion of $3.5\times10^{-2}$ to $1.5\times10^{-1}$ mol/liter of chloride ion in the color development bath is desirable in the present invention. The inclusion of $4\times10^{-2}$ to $1\times10^{-1}$ mol/liter is especially desirable. There is a disadvantage in that development is retarded if the chloride ion concentration is greater than $1.5\times10^{-1}$ to $10^{-1}$ mol/liter. This is undesirable from the point of view of attaining a high maximum density quickly, which is one of the objects of the present invention. Furthermore, the presence of less than $3.5\times10^{-1}$ mol/liter is undesirable from the point of view of preventing the occurrence of fogging.

Bromide ion is preferably included at a rate of $3.0\times10^{-5}$ mol/liter to $1.0\times10^{-3}$ mol/liter in the color development bath in this present invention. It is most desirably included at a rate of $5.0\times10^{-5}$ to $5\times10^{-4}$ mol/liter. Development is retarded and there is a reduction in maximum density and photographic speed when the bromide ion concentration exceeds $1\times10^{-3}$ mol/liter, and fogging cannot be prevented satisfactorily if the bromide ion concentration is less than $3.0\times10^{-5}$.

The chloride ion and the bromine ion may be added directly to the development bath, or they may be dissolved out of the photosensitive material into the development bath during development processing.

Sodium chloride, potassium chloride, ammonium chloride, lithium chloride, nickel chloride, magnesium chloride, manganese chloride, calcium chloride and cadmium chloride can be used as chlorine ion supplying substances in the case of direct addition to the color development bath. Of these, sodium chloride and potassium chloride is preferred.

Furthermore, the chloride ion can be supplied from a fluorescent whitener which is to be added to the development bath.

Sodium bromide, potassium bromide, ammonium bromide, lithium bromide, calcium bromide, magnesium bromide, manganese bromide, nickel bromide, cadmium bromide, cerium bromide and thallium bromide can be used as the bromide ion supplying substances. Of these, potassium bromide and sodium bromide are preferred.

When these ions are dissolved out from the photosensitive material during development processing, the chloride and bromide ions may be supplied from the emulsion or from a source other than the emulsion.

Further, other known development bath component compounds can be included in therein.

The color development baths used in the present invention preferably have a pH from 9 to 12, and most desirably a pH from 9 to 11.

The use of various buffers is desirable for maintaining the above-mentioned pH levels. Thus, carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyric acid salts, 2-amino-2-methyl-1,3-propanediol salts, valine salts, proline salts, trishydroxyaminomethane salts and lysine salts, for example, can be used as buffers. Carbonates, phosphates, quaternary ammonium salts, and hydroxybenzoates have the advantage of providing excellent solubility and buffering capacity in the high pH range of pH 9.0 and above, of not having an adverse effect on photographic performance (fogging for example) even when added to a color development bath, and of being inexpensive. The use of these buffers is especially desirable.

Specific examples of such buffers include sodium carbonate, potassium carbonate, sodium bicarbonate, potassium bicarbonate, tri-sodium phosphate, tri-potassium phosphate, di-sodium phosphate, di-potassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the invention is not limited to these compounds.

The amount of the buffer added to the color development bath is preferably at least 0.1 mol/liter, and most desirably from 0.1 to 0.4 mol/liter.

Various chelating agents can also be used in the color development baths to prevent the precipitation of calcium and magnesium in the color development bath, or to improve the stability of the color development bath.

Examples of the chelating agents include: nitrilotriacetic acid, diethylenetriamine pentaacetic acid, ethylenediamine tetraacetic acid, N,N,N-tri-methylmethylenephosphonic acid, ethylenediamine-N,N,N',N'-tetramethylenesulfonic acid, trans cyclohexanediamine tetraacetic acid, 1,2-diaminopropane tetraacetic acid, glycol ether diamine tetraacetic acid, glycol ether diamine tetraacetic acid, ethylenediamine o-hydroxyphenylacetic acid, 2-phosphonobutan-1,2,4-tricarboxylic acid, 1-hydroxyethylidene-1,1-diphosphonic acid, N,N'-bis(2-hydroxybenzyl)ethylenediamine-N,N'-diacetic acid.

Two or more of these chelating agents can be used conjointly, as required.

The amount of the chelating agent used should be sufficient to chelate the metal ions which are present in the color development bath. For example, they can be used at a concentration of from 0.1 gram to 10 grams per liter.

Various development accelerators can be added to the color development bath, as required.

For example, the thioether compounds shown, for example, in JP-B-37-16088, JP-B-37-5987, JP-B-38 7826, JP-B-44-12380, JP-B-45-9019 and U.S. Pat. No. 3,813,247, the p-phenylenediamine based compounds shown in JP-A-52-49829 and JP-B-50-15554, the quaternary ammonium salts shown, for example, in JP-A-50-137726, JP-B-44-30074, JP-A 56-156826 and JP-A-52-43429, the amine based compounds disclosed, for example, in U.S. Pat. Nos. 2,494,903, 3,128,182, 4,230,796 and 3,253,919, JP-B-41-11431, and U.S. Pat. Nos. 2,482,546, 2,596,926 and 3,582,346, the poly(alkylene oxides) shown, for example, in JP-B-37-16088, JP-B-42-25201, U.S. Pat. No. 3,128,183, JP-B-41-11431, JP-B-42-23883 and U.S. Pat. No. 3,532,501, and 1-phenyl-3-pyrazolidones and imidazoles, can be added as development accelerators, as required.

Anti-foggants can be added, as required, in the present invention. Alkali metal halides, such as sodium chloride, potassium bromide and potassium iodide, and organic anti-foggants can be used as anti-foggants. Typical examples of organic anti-foggants include nitrogen containing heterocyclic compounds such as benzotriazole, 6-nitrobenzimidazole, 5-nitroisoindazole, 5-methylbenzotriazole, 5-nitrobenzotriazole, 5-chloro benzotriazole, 2-thiazolylbenzimidazole, 2-thiazolylmethylbenzimidazole, indazole, hydroxyazaindolidine and adenine.

The inclusion of fluorescent whiteners is preferred in the color development baths which can be used in the present invention. 4,4'-Diamino 2,2'-di-sulfostilbene based compounds are preferred as fluorescent whiteners. The amount added is 0 to 5 g/l, and preferably 0.1 to 4 g/l.

Furthermore, various surfactants, such as alkylsulfonic acids, arylsulfonic acids, aliphatic carboxylic acids and aromatic carboxylic acids, can be added, as required.

The processing temperature of the color development baths which can be used in the present invention is 20° C. to 50° C., and preferably 30° C. to 40° C. The processing time is 20 seconds to 5 minutes, and preferably 30 seconds to 2 minutes.

A low rate of replenishment is preferred, and replenishment can be carried out at a rate of 20 to 600 ml, and preferably of 50 to 300 ml, per square meter of photosensitive material. Replenishment at a rate of 60 to 200 ml is preferred and replenishment at a rate of 60 to 150 ml is most desirable.

The de-silvering processes which can be carried out in the present invention are described below. The de-silvering process normally comprises a bleaching process and a fixing process, a fixing process and a bleach-fixing process, a bleaching process and a bleach-fixing process, or a bleach-fixing process.

The bleach baths, bleach-fix baths and fixing baths which can be used in the present invention are described below.

Any bleaching agent can be used as the bleaching agent which is used in the bleach bath or bleach-fix bath, but organic complex salts of iron(III) (for example, complex salts with amino-polycarboxylic acids, such as ethylenediamine tetraacetic acid and diethylenetriamine pentaacetic acid, amino-polyphosphonic acids, phosphonocarboxylic acids and organic phosphonic acids), or with organic acids such as citric acid, tartaric acid or malic acid, persulfates, and hydrogen peroxide are preferred.

Of these, the organic complex salts of iron(III) are preferred from the viewpoints of rapid processing and the prevention of environmental pollution. Examples of the amino-polycarboxylic acids, amino-polyphosphonic acids and organic phosphonic acids or the salts thereof which are useful for forming organic complex salts of iron(III) include ethylenediamine tetraacetic acid, diethylenetriamine pentaacetic acid, 1,3-diaminopropane tetraacetic acid, propylenediamine tetraacetic acid, nitrilotriacetic acid, cyclohexanediamine tetaaacetic acid, methyliminodiacetic acid, iminodiacetic acid and glycol ether diamine tetraacetic acid. These compounds may take the form of sodium, potassium, lithium or ammonium salts. Of these compounds, the iron(III) complex salts of ethylenediamine tetraacetic acid, diethylenetriamine pentaacetic acid, cyclohexanediamine tetraacetic acid, 1,3-diaminopropane tetraacetic acid and methyliminodiacetic acid are preferred from the viewpoint of their high bleaching power.

These ferric ion complex salts may be used in the form of the complex salts, or the ferric ion complex salts can be formed in solution using, for example, ferric sulfate, ferric chloride, ferric nitrate, ferric ammonium sulfate, or ferric phosphate and a chelating agent such as an amino-polycarboxylic acid, amino-polyphosphonic acid or phosphonocarboxylic acid. Furthermore, the chelating agent may be used in excess of the amount required to form the ferric ion complex salt. Among the iron complex salts, the aminopolycarboxylic acid iron complex salts are preferred, and the amount added is from 0.01 to 1.0 mol/liter, and preferably from 0.05 to 0.50 mol/liter.

Various compounds can be used as bleaching accelerators in the bleach baths, bleach-fix baths or bleach or bleach-fix pre-baths.

For example, the compounds which have a mercapto group or a disulfide bond disclosed in U.S. Pat. No. 3,893,858, West German Patent 1,290,812, JP-A-53-95630 and *Research Disclosure*, No. 17129 (July 1978); the thiourea derivatives disclosed JP B-45-8506, JP-A-52-20832, JP-A-53-32735 and U.S. Pat. No. 3,706,561; or halides, such as iodide or bromide ions, are preferred in view of their excellent bleaching power.

Re-halogenating agents, such as bromides (for example, potassium bromide, sodium bromide, ammonium bromide), or chlorides (for example, potassium chloride, sodium chloride, ammonium chloride), or iodides (for example, ammonium iodide) can be included in the bleach baths or bleach-fix baths which are used in the present invention. One or more inorganic acid or organic acid, or the alkali metal or ammonium salts thereof, which have a pH buffering action, such as borax, sodium metaborate, acetic acid, sodium acetate, sodium carbonate, potassium carbonate, phosphorous acid, phosphoric acid, sodium phosphate, citric acid, sodium citrate or tartaric acid, and corrosion inhibitors such as ammonium nitrate and guanidine, can be added as required.

Known fixing agents, which is to say thiosulfates such as sodium thiosulfate and ammonium thiosulfate, thiocyanates such as sodium thiocyanate and ammonium thiocyanate, thioether compounds such as ethylenebisthioglycolic acid and 3,6-dithia-1,8-octanediol, and water soluble silver halide solvents such as the thioureas, can be used either singly or in combination as the fixing agent in the bleach-fix baths and fixing baths. Special bleach-fix baths consisting of a combination of large quantities of a halide such as potassium iodide and a fixing agent, as disclosed in JP-A-55-155354 can also be used. The use of thiosulfates, and especially ammonium thiosulfate, is preferred in the present invention. The amount of fixing agent per liter is preferably from 0.3 to 2 mol, and most desirably from 0.5 to 1.0 mol.

The pH range of the bleach-fix bath or fixing bath in the present invention is preferably 3 to 10, and most desirably 5 to 9.

Furthermore, various fluorescent whiteners, anti-foaming agents or surfactants, polyvinylpyrrolidone and organic solvents such as methanol can also be included in the bleach-fix baths.

Sulfite ion releasing compounds, such as sulfites (for example, sodium sulfite, potassium sulfite, ammonium sulfite), bisulfites (for example, ammonium bisulfite, sodium bisulfite, potassium bisulfite) and metabisulfites (for example, potassium metabisulfite, sodium metabisulfite, ammonium metabisulfite) can be used as preservatives in the bleach-fix baths and fixing baths. These compounds are preferably used at a concentration, calculated as sulfite ion, of about 0.02 to 0.50 mol/liter, and most desirably at a concentration, as sulfite ion, of 0.04 to 0.40 mol/liter.

Sulfites are generally added as the preservative, but ascorbic acid and carbonyl/bisulfite addition compounds or carbonyl compounds, for example, can be added.

Buffers, fluorescent whiteners, chelating agents, and anti-foaming agents and fungicides, for example, can also be added, as required.

A water washing process and/or stabilization process is generally carried out after the de-silvering process, such as a fixing or bleach-fix process.

The amount of wash water used in a washing process can be fixed within a wide range, depending on the characteristics (such as the materials such as couplers which have been used) of the photosensitive material and the application, the wash water temperature, the number of water washing tanks (the number of water washing stages), the replenishment system, (i.e. whether a counter-flow or sequential flow system is used), and various other factors. The relationship between the amount of water used and the number of washing tanks in a multi-stage counter-flow system can be obtained using the method outlined on pages 248–253 of the *Journal of the Society of Motion Picture and Television Engineers,* Vol. 64 (May 1955). The number of stages in a normal multi-stage counter-current system is preferably 2 to 6, and most desirably 2 to 4.

The amount of wash water can be greatly reduced by using a multi-stage counter-flow system, and use can be made of from 0.5 to 1 liter per square meter of photosensitive material, for example. The effect of the present invention is pronounced, but bacteria proliferate due to the increased residence time of the water in the tanks and problems arise with the suspended matter which is produced becoming attached to the photosensitive material. The method in which the calcium ion and magnesium ion concentrations are reduced, as disclosed in JP-A-62-288838, can be used very effectively as a means of overcoming these problems. Furthermore, the isothiazolone compounds and thiabendazoles disclosed in JP-A-57-8542, the chlorine based disinfectants such as chlorinated sodium isocyanurate disclosed in JP-A-61-120145, the benzotriazole disclosed in JP-A-61-267761, copper ions, and the disinfectants disclosed in *The Chemistry of Biocides and Fungicides* by Horiguchi (1986), in *Killing Microoranisms, Biocidal and Fungicidal Techniques* published by the Health and Hygiene Technical Society (1982), and in *A dictionary of Biocides and Fungicides* published by the Japanese Biocide and Fungicide Society (1986), can also be used in this connection.

Moreover, surfactants can be used as drying agents, and chelating agents (typified by EDTA) can be used as hard water softening agents in the water washing water.

A direct stabilization process can be carried out following, or in place of, the above-mentioned water washing process. Organic compounds which have an image stabilizing function can be added to the stabilizing bath, and aldehydes (typified by formaldehyde for example), buffers for adjusting the film pH to a level which is suitable for providing dye stability, and ammonium compounds can be added for this purpose. Furthermore, the aforementioned biocides and fungicides can be used to prevent the proliferation of bacteria in the bath and to provide the processed photosensitive material with biocidal properties.

Moreover, surfactants, fluorescent whiteners and film hardening agents can also be added. All of the methods disclosed, for example, in JP-A-57-8543, JP-A-58-14834 and JP-A-60-220345 can be used in those cases in which, in the processing of photosensitive materials of this present invention, stabilization is carried out directly without carrying out a water washing process.

The preferred embodiments are those in which use is also made of chelating agents, such as 1-hydroxyethylidene-1,1-diphosphonic acid or ethylenediamine tetramethylenephosphonic acid for example, and magnesium and bismuth compounds.

The so-called rinse baths are used in the same way as the water wash baths or stabilizing baths which are used after the de-silvering process.

The preferred pH value in the water washing process or the stabilizing process is 4 to 10, and preferably 5 to 8. The temperature can be set variously in accordance with the characteristics and application of the photosensitive material. But generally, a temperature of 15° C. to 45° C., and preferably of 20° C. to 40° C., is selected. The process time can be any time, but shorter times are preferred for shortening the overall processing time. A time of 15 seconds to 1 minute 45 seconds is preferred, and a processing time of 30 seconds to 1 minute 30 seconds is most desirable. A low replenishment rate is preferred from the viewpoints of the running costs, the reduced amount of effluent, and handling characteristics, for example.

In practical terms, the preferred rate of replenishment is 0.5 to 50 times, and most desirably 3 to 40 times, the carry over from the previous bath per unit area of photosensitive material. Furthermore, it is not more than 1 liter, and preferably not more than 500 ml, per square meter of photosensitive material. Moreover, replenishment can be carried out continuously or intermittently.

The liquid which has been used in the water washing and/or stabilizing processes can, moreover, be used in the preceding processes. As an example, the washing water overflow can be fed into the preceding bleach-fix bath, the bleach-fix bath can be replenished using a concentrated liquid and the amount of effluent can be reduced.

The preferred cyan couplers, magenta couplers and yellow couplers for use in the present invention are those which can be represented by the general formulae (C-I), (C-II), (M-I), (M-II) and (Y) which are indicated below.

General Formula (C-I)

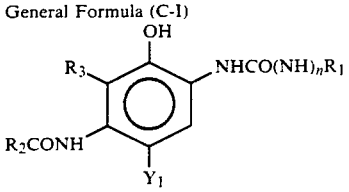

General Formula (C-II)

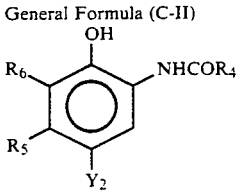

General Formula (M-I)

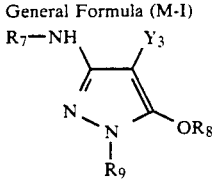

General Formula (M-II)

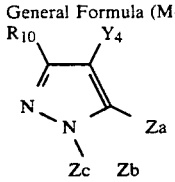

General Formula (Y)

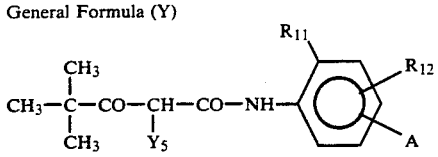

In general formulae (C-I) and (C-II), $R_1$, $R_2$ and $R_4$ represent substituted or unsubstituted aliphatic, aromatic, or heterocyclic groups; $R_3$, $R_5$ and $R_6$ represent hydrogen atoms, halogen atoms, aliphatic groups, aromatic groups or acylamino groups; and $R_3$ may represent a group of non-metal atoms which, together with $R_2$, is required to form a 5- or 6-membered nitrogen containing ring. $Y_1$ and $Y_2$ represent hydrogen atoms or groups which can be eliminated during a coupling reaction with the oxidized form of a developing agent. Finally, n represents 0 or 1.

$R_5$ in general formula (C-II) is preferably an aliphatic group, for example, methyl, ethyl, propyl, butyl, pentadecyl, tert-butyl, cyclohexyl, cyclohexylmethyl, phenylthiomethyl, dodecyloxyphenylthiomethyl, butanamidomethyl or methoxymethyl.

Preferred examples of the cyan couplers which are represented by the aforementioned general formulae (C-I) and (C-II) are indicated below.

$R_1$ in general formula (C-I) is preferably an aryl group or a heterocyclic group. The aryl groups which are substituted with halogen atoms, alkyl groups, alkoxy groups, aryloxy groups, acylamino groups, acyl groups, carbamoyl groups, sulfonamido groups, sulfamoyl groups, sulfonyl groups, sulfamido groups, oxycarbonyl groups and cyano groups are most desirable.

In those cases in which $R_3$ and $R_2$ do not form a ring in general formula (C-I), $R_2$ is preferably a substituted or unsubstituted alkyl group or aryl group, and most desirably a substituted aryloxy substituted alkyl group, and $R_3$ is preferably a hydrogen atom.

$R_4$ in general formula (C-II) is preferably a substituted or unsubstituted alkyl group or aryl group, and most desirably it is a substituted aryloxy substituted alkyl group.

$R_5$ in general formula (C-II) is preferably an alkyl group which has 2 to 15 carbon atoms, and a methyl group which has a substituent group which has at least 1 carbon atom. The preferred substituent groups for the methyl group are arylthio groups, alkylthio groups, acylamino groups, aryloxy groups and alkyloxy groups.

$R_5$ in general formula (C-II) is most desirably an alkyl group which has from 2 to 15 carbon atoms, alkyl groups which have from 2 to 4 carbon atoms being especially desirable.

$R_6$ in general formula (C-II) is preferably a hydrogen atom or a halogen atom, and most desirably it is a chlorine atom or a fluorine atom. $Y_1$ and $Y_2$ in general formulae (C-I) and (C-II) each preferably represents a hydrogen atom, a halogen atom, an alkoxy group, an aryloxy group, an acyloxy group or a sulfonamido group.

In general formula (M-I), $R_7$ and $R_9$ represent aryl groups, $R_8$ represents a hydrogen atom, an aliphatic or aromatic acyl group, or an aliphatic or aromatic sulfonyl group, and $Y_3$ represents a hydrogen atom or a leaving group. The substituent groups permitted for the aryl groups (preferably phenyl groups) represented by $R_7$ and $R_9$ are the same as those permitted as substituent groups for $R_1$. When there are two or more substituent groups these may be the same or different. $R_8$ is preferably a hydrogen atom, an aliphatic acyl group or a sulfonyl group, and most desirably it is a hydrogen atom. $Y_3$ is preferably a group of the type which is eliminated at a sulfur, oxygen or nitrogen atom, and most desirably it is a sulfur atom leaving group of the type disclosed, for example, in U.S. Pat. No. 4,351,897 or International Patent W088/04795.

In general formula (M-II), $R_{10}$ represents a hydrogen atom or a substituent group. $Y_4$ represents a hydrogen atom or a leaving group, and it is preferably a halogen atom or a arylthio group. Za, Zb and Zc represent methine groups, substituted methine groups, =N— groups or —NH— groups. One of the bonds Za—Zb and Zb—Zc is a double bond and the other is a single bond. Cases where Zb—Zc is a carbon-carbon double bond include those in which this bond is part of an aromatic ring. Cases where a dimer or larger oligomer is formed via $R_{10}$ or $Y_4$, and cases in which, when Za, Zb or Zc is a substituted methine group, a dimer or larger oligomer is formed via the substituted methine group are included.

Among the pyrazoloazole based couplers represented by general formula (M-II), the imidazo[1,2-b]pyrazoles disclosed in U.S. Pat. No. 4,500,630 are preferred because of the slight absorbance on the yellow side and the light fastness of the colored dye. The pyrazolo[1,5-b][1,2,4]triazole disclosed in U.S. Pat. No. 4,540,654 is especially desirable.

The use of the pyrazolotriazole couplers in which a branched alkyl group is bonded directly to the 2-, 3- or 6-position of the pyrazolotriazole ring as disclosed in JP-A-61-65245, the pyrazoloazole couplers which have a sulfonamide group within the molecule as disclosed in JP-A-61-65246, the pyrazoloazole couplers which have alkoxyphenylsulfonamido ballast groups as disclosed in JP-A-61-147254, and the pyrazolotriazole couplers which have an alkoxy group or an aryloxy group in the 6-position as disclosed in European Patents (laid open) 226,849 and 294,785 is also desirable.

In general formula (Y), $R_{11}$ represents a halogen atom, an alkoxy group, a trifluoromethyl group or an aryl group, and $R_{12}$ represents a hydrogen atom, a halogen atom or an alkoxy group. A represents —$NHCOR_{13}$, —$NHSO_2$—$R_{13}$, —$SO_2NHR_{13}$, —$COOR_{13}$, or —$SO_2NHR_{13}$, —$COOR_{13}$ or $$-SO_2\underset{\underset{R_{14}}{|}}{N}-R_{13}.$$

$R_{13}$ and $R_{14}$ each represents an alkyl, an aryl group or an acyl group. $Y_5$ represents a leaving group. The substituent groups for $R_{12}$, and for $R_{13}$ and $R_{14}$, are the same as the substituent groups for $R_1$. The leaving groups $Y_5$ is preferably a group of the type at which elimination occurs at an oxygen atom or nitrogen atom, and it is most desirably of the nitrogen atom elimination type.

Specific examples of couplers which can be represented by general formulae (C-I), (C-II), (M-I), (M-II) and (Y) are indicated below.

(C-1)

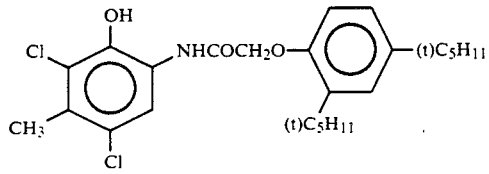

(C-2)

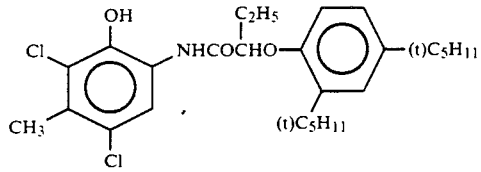

(C-3)

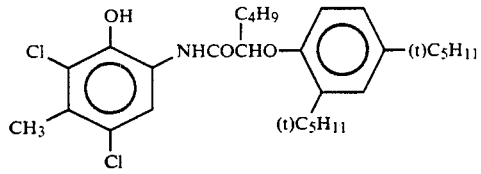

(C-4)

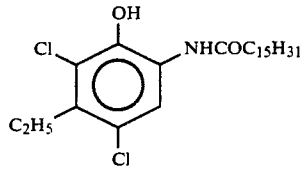

(C-5)

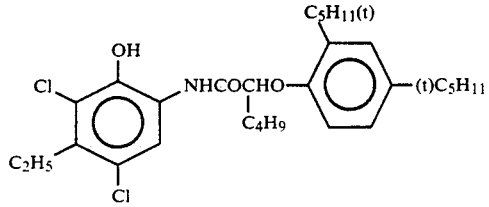

-continued
(C-6)
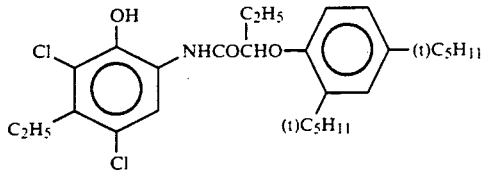
(C-7)
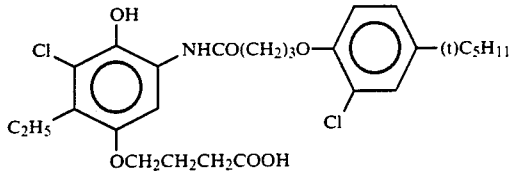
(C-8)
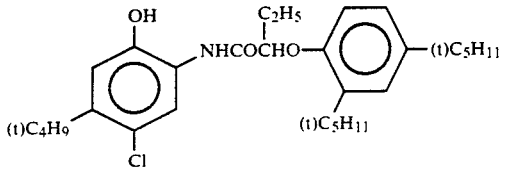
(C-9)
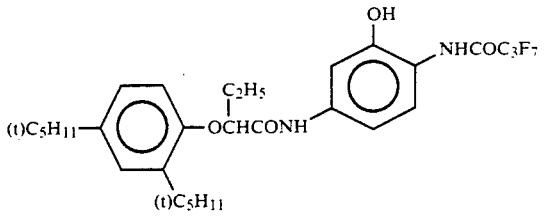
(C-10)
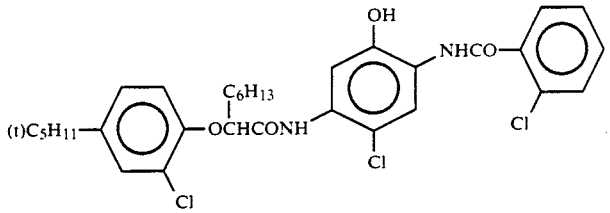
(C-11)
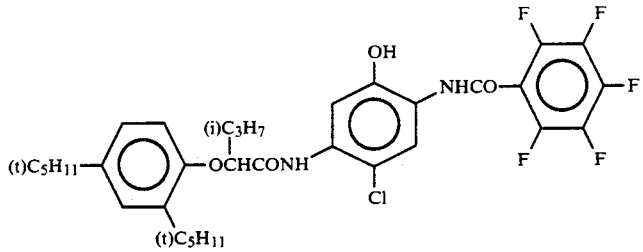
(C-12)
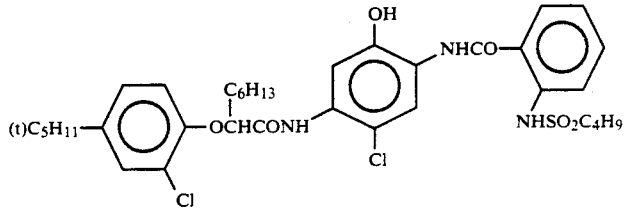

-continued
(C-13)
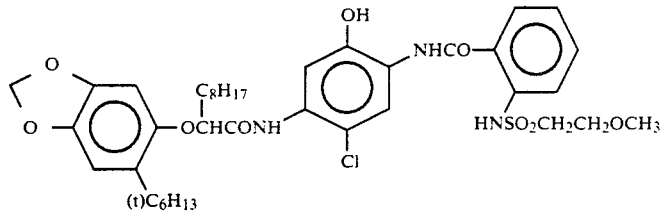
(C-14)
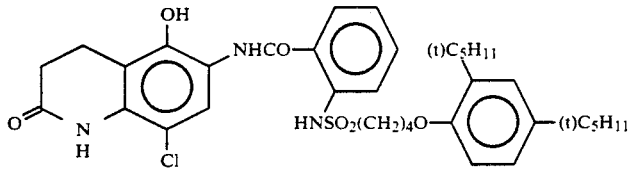
(C-15)
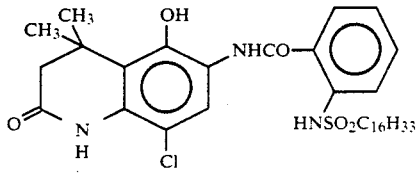
(C-16)
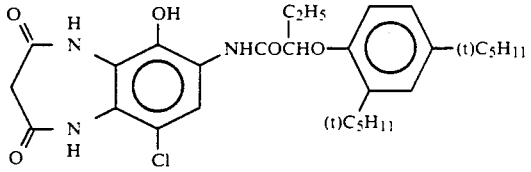
(C-17)
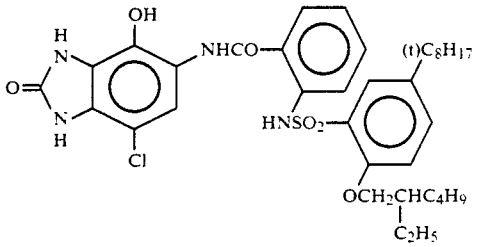
(C-18)
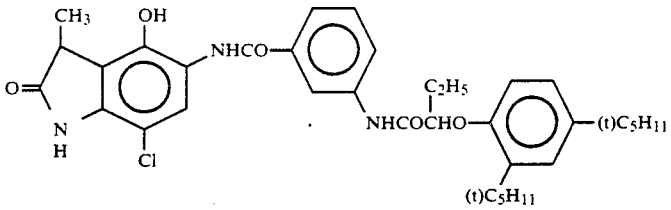
(C-19)
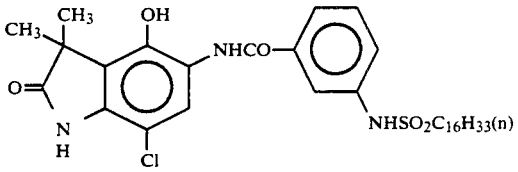
(C-20)
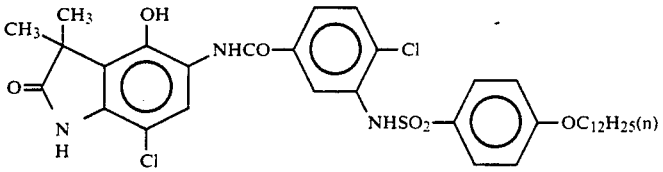

-continued
(C-21)
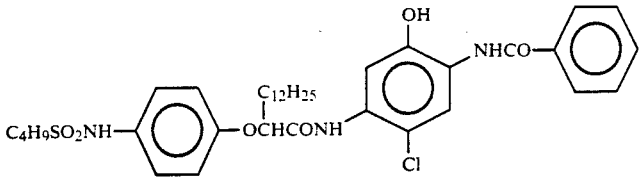
(C-22)
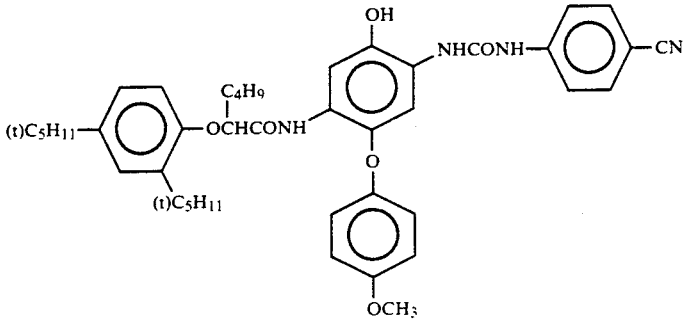
(M-1)
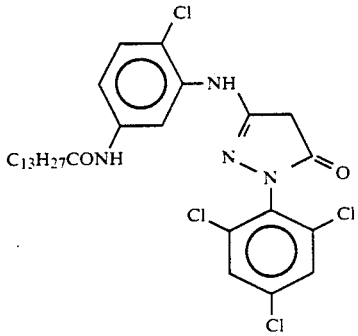
(M-2)
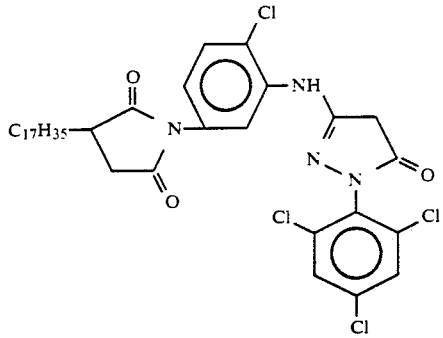
(M-3)
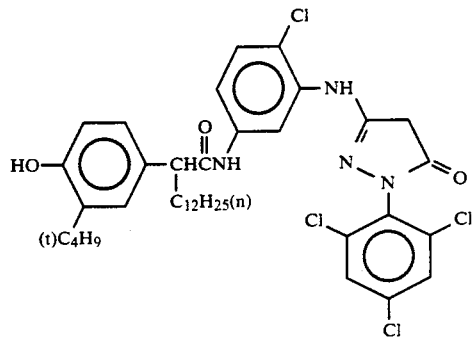

-continued
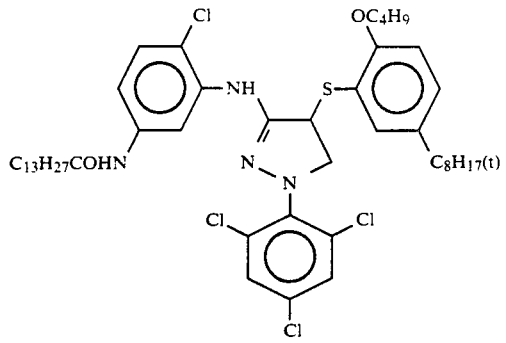
(M-4)
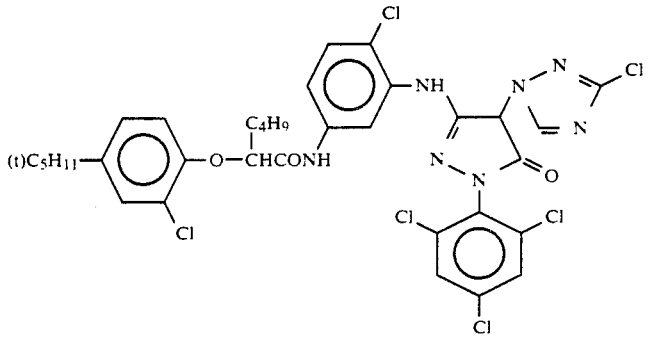
(M-5)
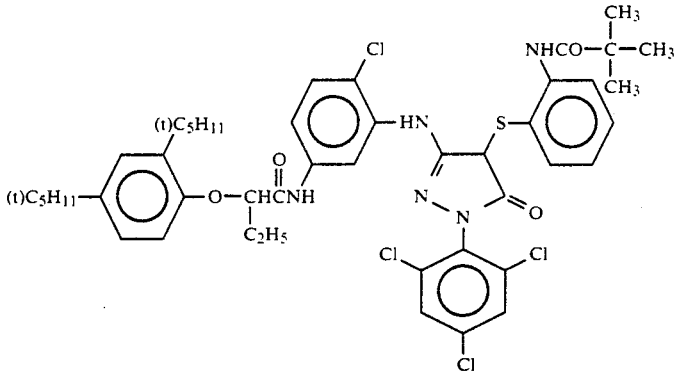
(M-6)
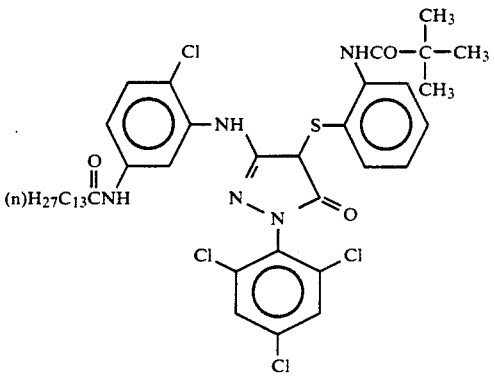
(M-7)

-continued
(M-8)
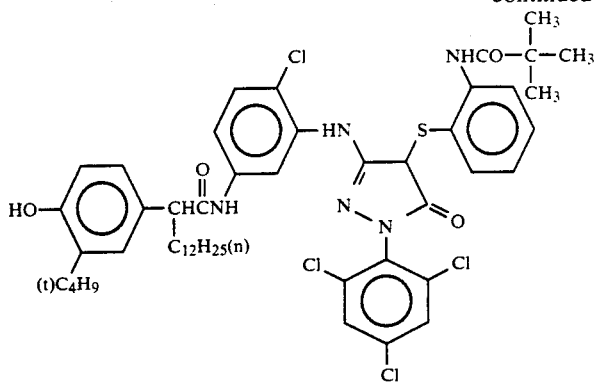
| Compound | $R_{10}$ | $R_{15}$ | $Y_4$ |
|---|---|---|---|
| M-9 | $CH_3$— | 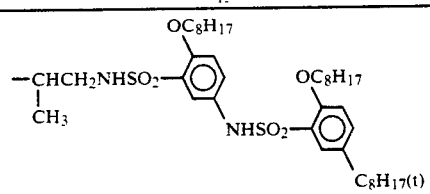 | Cl |
| M-10 | $CH_3$— | 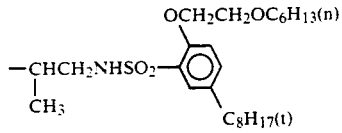 | Cl |
| M-11 | $(CH_3)_3C$— | 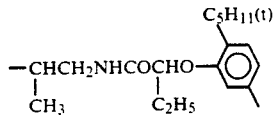 | 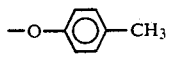 |
| M-12 | 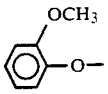 | 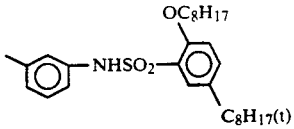 | 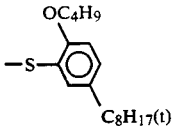 |
| M-13 | $CH_3$— | 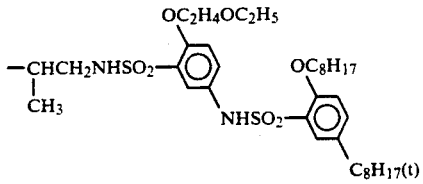 | Cl |
| M-14 | $CH_3$— | 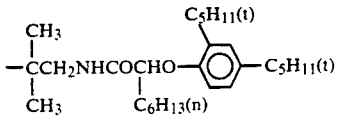 | Cl |

-continued
| | | | |
|---|---|---|---|
| M-15 | $CH_3$— | 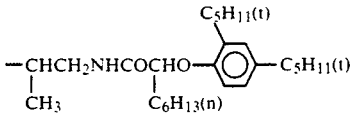 | Cl |
| M-16 | $CH_3$— | 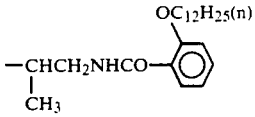 | Cl |
| M-17 | $CH_3$— | 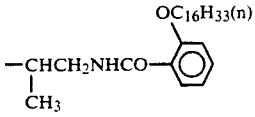 | Cl |
| M-18 | 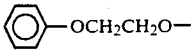 | 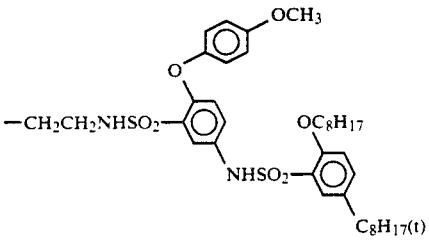 | 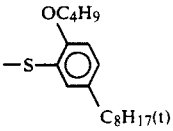 |
| M-19 | $CH_2CH_2O$— | As above | As above |
| M-20 | 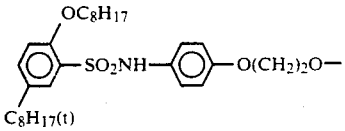 | 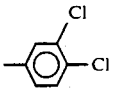 | 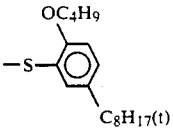 |
| M-21 | 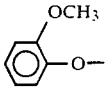 | 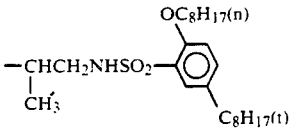 | Cl |
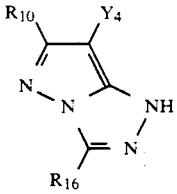
| Compound | $R_{10}$ | $R_{16}$ | $Y_4$ |
|---|---|---|---|
| M-22 | $CH_3$— | 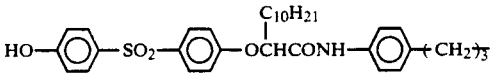 | Cl |
| M-23 | $CH_3$— | 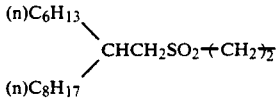 | Cl |
| M-24 | 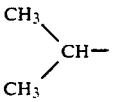 | 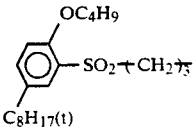 | Cl |

-continued
| | | | |
|---|---|---|---|
| M-25 | $\leftarrow CH-CH_2 \rightarrow_{50} \leftarrow CH_2-C \rightarrow_{50}$ (CH3 on C; COOCH2CH2OCH3; CONH—) | $CH_3-CH-$ ($CH_2NHSO_2CH_3$) | Cl |
(Y-1)
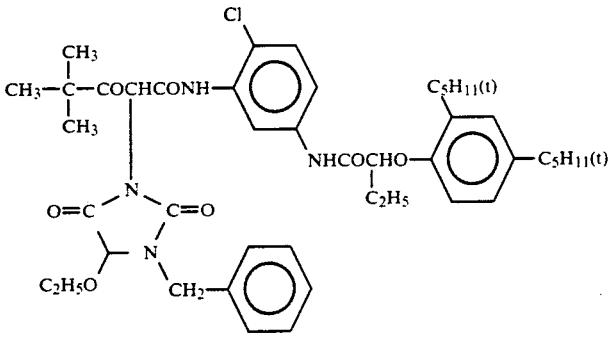
(Y-2)
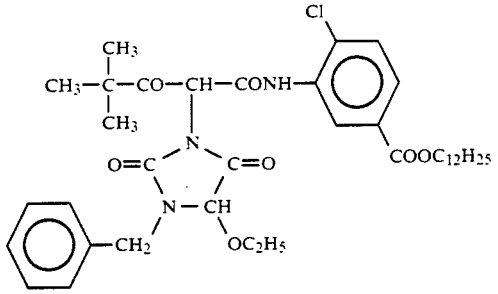
(Y-3)
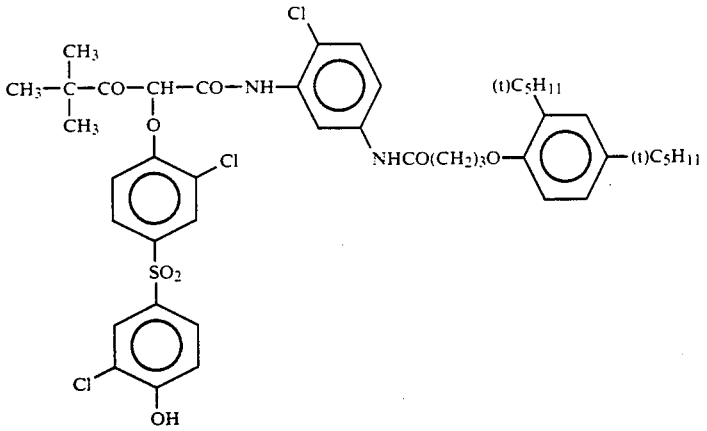
(Y-4)
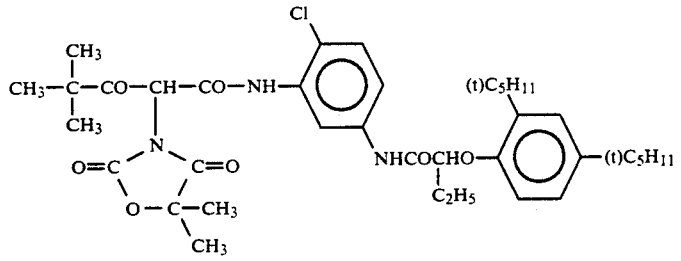

-continued (Y-5)

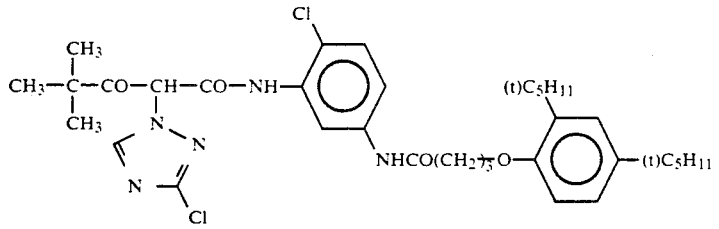

(Y-6)

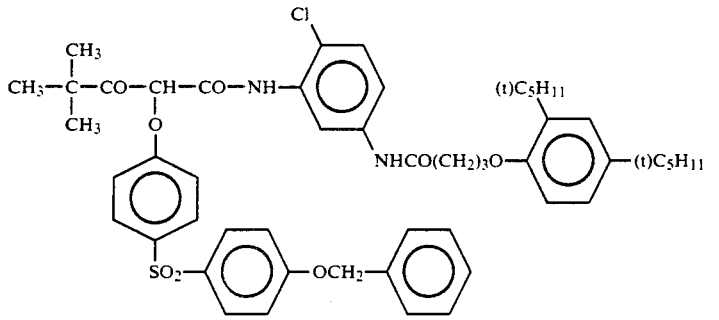

(Y-7)

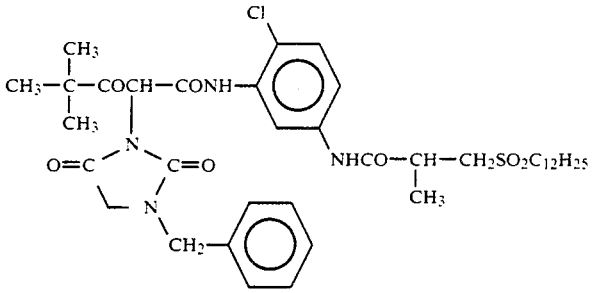

(Y-8)

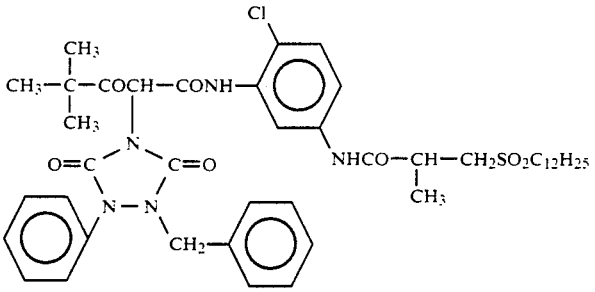

(Y-9)

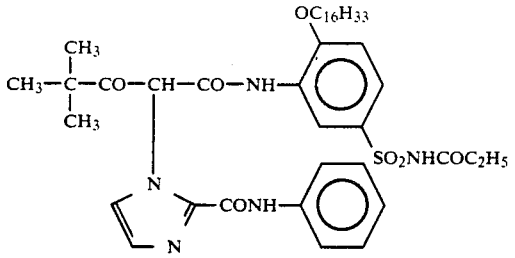

The couplers represented by the aforementioned general formulae (C-I) to (Y) are normally included in the silver halide emulsion layers which form the photosensitive layer at rates of 0.1 to 1.0 mol, and preferably of 0.1 to 0.5 mol, per mol of silver halide.

Various known techniques can be used in the present invention for adding the aforementioned couplers to the photosensitive layers. Normally, they can be added by means of the oil in water dispersion method using the oil protection method where, after being dissolved in a solvent, the solution is emulsified and dispersed in an aqueous gelatin solution which contains a surfactant. Alternatively, water or an aqueous gelatin solution can be added to a coupler solution which contains a surfactant, and an oil in water dispersion can be formed by phase reversal. Furthermore, alkali soluble couplers can also be dispersed using the so-called Fischer dispersion method. The coupler dispersions can be mixed with the photographic emulsions after the removal of low boiling point organic solvents by distillation, noodle washing or ultrafiltration for example.

The use of high boiling point organic solvents which have a dielectric constant (25° C.) of 2 to 20 and a refractive index (25° C.) of 1.5 to 1.7 and/or water insoluble polymeric compounds for coupler dispersion media is preferred.

The use of high boiling point organic solvents which are represented by the general formulae (A) to (E) indicated below is preferred.

General Formula (A)

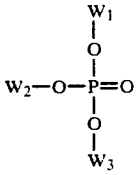

General Formula (B)

$W_1—COO—W_2$

General Formula (C)

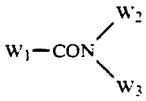

General Formula (D)

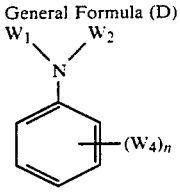

General Formula (E)

$W_1—O—W_2$

In these formulae, $W_1$, $W_2$ and $W_3$ each represents a substituted or unsubstituted alkyl group, cycloalkyl group, alkenyl group, aryl group or heterocyclic group, $W_4$ represents $W_1$, $—O—W_1$ or $—S—W_1$, and n represents an integer of value from 1 to 5. When n has a value of 2 or more the $W_4$ groups may be the same or different. Moreover, $W_1$ and $W_2$ in general formula (E) may form a condensed ring.

Water immiscible compounds of a melting point below 100° C. and a boiling point at least 140° C., other than those of general formulae (A) to (E) can be used as the high boiling point organic solvents which are used in the present invention provided that they are good solvents for the coupler. The melting point of the high boiling point organic solvent is preferably not more than 80° C. Moreover, the boiling point of the high boiling point organic solvent is preferably at least 160° C., and most desirably at least 170° C.

Details of these high boiling point organic solvents have been disclosed between the lower right column on page 137 and the upper right column on page of the specification of JP-A-62-215272.

Furthermore, these couplers can be loaded onto a loadable latex polymer (for example, U.S. Pat. No. 4,203,716) in the presence or absence of the aforementioned high boiling point organic solvents, or they can be dissolved in a water insoluble but organic solvent soluble polymer and emulsified and dispersed in an aqueous hydrophilic colloid solution.

The use of the homopolymers and copolymers disclosed on pages 12 to 30 of the specification of International Patent W088/00723 is preferred, and the use of acrylamide based polymers is especially desirable from the viewpoint of colored image stabilization, for example.

Photosensitive materials which have been prepared according to the present invention may contain hydroquinone derivatives, aminophenol derivatives, gallic acid derivatives and ascorbic acid derivatives, for example, as anti-color fogging agents.

Various anti-color fading agents can be used in the photosensitive materials of the present invention That is to say, hydroquinones, 6-hydroxychromans, 5-hydroxycoumarans, spirochromans, p-alkoxyphenols, hindered phenols based on bisphenols, gallic acid derivatives, methylenedioxybenzenes, aminophenols, hindered amines, and ether and ester derivatives in which the phenolic hydroxyl groups of these compounds have been silylated or alkylated, are typical organic anti-color mixing agents which can be used to make cyan, magenta and/or yellow images. Furthermore, metal complexes typified by (bis-salicylaldoximato)nickel and (bis-N,N-dialkyldithiocarbamato)nickel complexes, can also be used for this purpose.

Specific examples of the organic anti-color fading agents have been disclosed in the patent specifications indicated below.

Thus, hydroquinones have been disclosed, for example, in U.S. Pat. Nos. 2,360,290, 2,418,613, 2,700,453, 2,701,197, 2,728,659, 2,732,300, 2,735,765, 3,982,944 and 4,430,425, British Patent 1,363,921, and U.S. Pat. Nos. 2,710,801 and 2,816,028, 6-hydroxychromans, 5-hydroxychromans and spirochromans have been disclosed, for example, in U.S. Pat. Nos. 3,432,300, 3,573,050, 3,574,627, 3,698,909 and 3,764,337, and JP-A-52-152225, spiroindanes have been disclosed in U.S. Pat. No. 4,360,589, p-alkoxyphenols have been disclosed, for example, in U.S. Pat. No. 2,735,765, British Patent 2,066,975, JP-A-59-10539 and JP-B-57-19765, hindered phenols have been disclosed, for example, in U.S. Pat. No. 3,700,455, JP-A-52-72224, U.S. Pat. No. 4,228,235, and JP-B-52-6623, gallic acid derivatives, methylenedioxybenzenes and aminophenols have been disclosed, for example, in U.S. Pat. Nos. 3,457,079 and 4,332,886, and JP-B-56-21144 respectively, hindered amines have been disclosed, for example, in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78344, and metal complexes have been disclosed, for example, U.S. Pat. Nos. 4,050,938 and 4,241,155, and British Patent 2,027,731(A). These compounds can be used to achieve the intended purpose by adding them to the photosensitive layer after co-emulsification with the corresponding color coupler, usually at a rate of from 5 to 100 wt% with respect to the coupler. The inclusion of ultraviolet absorbers in the cyan color forming layer and in the layers on both sides adjacent thereto is effective for preventing degradation of the cyan dye image by heat, and especially by light.

For example, benzotriazole compounds substituted with aryl groups (for example, those disclosed in U.S. Pat. No. 3,533,794), 4-thiazolidone compounds (for example, those disclosed in U.S. Pat. Nos. 3,314,794 and 3,352,681), benzophenone compounds (for example, those disclosed in JP-A-46-2784), cinnamic acid ester compounds (for example, those disclosed in U.S. Pat. Nos. 3,705,805 and 3,707,395), butadiene compounds (for example, those disclosed in U.S. Pat. No.

4,045,229), or benzoxidol compounds (for example, those disclosed in U.S. Pat. No. 3,700,455) can be used as ultraviolet absorbers. Ultraviolet absorbing couplers (for example, α-naphthol based cyan dye forming couplers) and ultraviolet absorbing polymers, for example, can also be used for this purpose. These ultraviolet absorbers can be mordanted in a specified layer.

Among these compounds, the aforementioned benzotriazole compounds which are substituted with aryl groups are preferred.

The use, together with the couplers described above, of compounds such as those described below is preferred in this present invention. The conjoint use of these compounds with pyrazoloazole couplers is especially desirable.

Thus, the use of compounds (F) which bond chemically with the aromatic amine based developing agents remaining after color development processing and form compounds which are chemically inert and essentially colorless and/or compounds (G) which bond chemically with the oxidized form of the aromatic amine based color developing agents remaining after color development processing and form compounds which are chemically inert and essentially colorless either simultaneously or individually, is desirable for preventing the occurrence of staining and other side effects on storage due to colored dye formation resulting from the reaction between couplers and color developing agents or oxidized forms thereof which remain in the film after processing for example.

Compounds which react with p-anisidine with a second order reaction rate constant $k_2$ (measured intrioctyl phosphate at 80° C.) within the range from 1.0 liter/mol.sec to $1\times10^{-5}$ liter/mol.sec are preferred for the compound (F). The second order reaction rate constant can be measured using the method disclosed in JP-A-63-158545.

The compounds themselves are unstable if $k_2$ has a value above this range, and they will react with gelatin or water and be decomposed. If, on the other hand, the value of $k_2$ is below this range, reaction with the residual aromatic amine based developing agent is slow and consequently it is not possible to prevent the occurrence of the side effects of the residual aromatic amine based developing agent.

The preferred compounds (F) of this type can be represented by the general formulae (FI) and (FII) which are shown below.

General Formula (FI)

$R_1-(A)_n-X$

General Formula (FII)

$R_2-\underset{\underset{B}{|}}{C}=Y$

In these formulae, $R_1$ and $R_2$ each represents an aliphatic group, an aromatic group or a heterocyclic group. Moreover, n represents 1 or 0. A represents a group which reacts with an aromatic amine based developing agents and forms a chemical bond. X represents a group which is eliminated by reaction with an aromatic amine based developing agent. B represents a hydrogen atom, an aliphatic group, an aromatic group, a heterocyclic group, an acyl group or a sulfonyl group. Y represents a group which promotes the addition of an aromatic amine based developing agent to the compound of general formula (FII). Here, $R_1$ and X, and Y and $R_2$ or B, can be joined together to form a cyclic structure.

Substitution reactions and addition reactions are typical of the reactions by which the residual aromatic amine based developing agent is chemically bound.

Specific examples of compounds represented by the general formulae (FI) and (FII) disclosed, for example, in JP-A-63-158545, JP-A-62-283338, Japanese Patent Application No. 62-158342 and European Patents (laid open) 277,589 and 298,321 are preferred.

On the other hand, the preferred compounds (G) which chemically bond with the oxidized forms of the aromatic amine based developing agents which remain after color development processing and form compounds which are chemically inert and colorless are represented by the general formula (GI) indicated below.

$R-Z$ General Formula (GI)

R in this formula represents an aliphatic group, an aromatic group or a heterocyclic group. Z represents a nucleophilic group or a group which breaks down in the photosensitive material and releases a nucleophilic group. The compounds represented by the general formula (GI) are preferably compounds in which Z is a group in which the Pearson nucleophilicity $^{n}CH_3I$ value (R. G. Pearson et al., *J. Am. Chem. Soc.*, 90, 319 (1968)) is at least 5, or a group derived therefrom.

The specific examples of compounds which can be represented by general formula (GI) disclosed, for example, in European Patent laid open 255,722, JP A-62-143048, JP-A-62-229145, Japanese Patent Application Nos. 63-136724, 62-214681 and 62-158342, and European Patents (laid open) 277,589 and 298,321 are preferred. Specific examples are shown below.

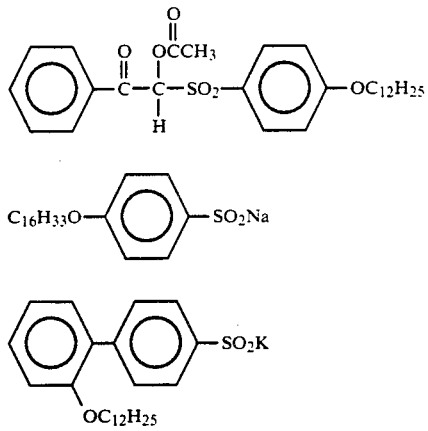

Furthermore, details of combinations of the aforementioned compounds (G) and compounds (F) have been disclosed in European Patent Laid Open No. 277,589.

Colloidal silver and dyes can be used in the full color recording materials of the present invention for anti irradiation purposes, anti-halation purposes, and especially for separation of the spectral sensitivity distributions of the photosensitive layers and for ensuring safety under safe-lighting in the visible wavelength region. Dyes of this type include oxonol dyes, hemi-oxonol dyes, styryl dyes, merocyanine dyes, cyanine dyes and azo dyes. The oxonol dyes, hemioxonol dyes and merocyanine dyes from among these dyes are especially useful.

In particular, the decolorizable dyes disclosed, for example, in JP-A-62-3250, JP-A-62-181381, JP-A-62-123454 and JP-A-63-197947 can be used as dyes for red or infrared purposes, and the dyes disclosed, for example, in JP-A-62-39682, JP-A-62-123192, JP-A-62-158779 and JP-A-62-174741 or these same dyes into which water soluble groups have been introduced so that they can be washed out during processing can be used in backing layers. If the dyes for infrared purposes of the present invention are mixed with a silver halide emulsion which has been spectrally sensitized to the red or infrared region, problems arise with desensitization, the occurrence of fogging and subsequent adsorption of the dyes themselves on the silver halide grains and a weakening and broadening of the spectral sensitization. The inclusion of these dyes only in colloid layers other than the photosensitive layers is preferred. Consequently, dyes may be included in a specified colored layer in a form in which they are fast to diffusion. In the first place, the dyes can be rendered fast to diffusion by the introduction of ballast groups, but this is likely to give rise to the occurrence of residual coloration and process staining. In the second place, the anionic dyes of the present invention can be mordanted with the conjoint use of a polymer or polymer latex which provides cation sites. Thirdly, fine particle dispersions of dyes which are insoluble in water at pH 7 or below and which are decolorized and washed out during the processing operation can be used. These can be dissolved in a low boiling point organic solvent or in a surfactant and the resulting solution can be dispersed in an aqueous hydrophilic protective colloid solution, such as a gelatin solution, for example. The solid dye is preferably milled with an aqueous surfactant solution to form fine dye particles mechanically in a mill, and these particles can be dispersed in an aqueous hydrophilic colloid solution such as a gelatin solution for use.

The use of gelatin, as the binding agent or protective colloid which is used in the photosensitive layers of photosensitive materials of the present invention is convenient, but other hydrophilic colloids, either alone or in conjunction with gelatin, can be used for this purpose.

The gelatin used in the invention may be a lime treated gelatin, or it may be a gelatin which has been treated using acids. Details of the preparation of gelatins have been disclosed by Arthur Weise in *The Macromolecular Chemistry of Gelatin* (published by Academic Press, 1964).

The color photosensitive materials of the present invention have on a support, a photosensitive layer (YL) which contains yellow couplers, a photosensitive layer (ML) which contains magenta couplers, a photosensitive layer (CL) which contains cyan couplers, with protective layers (PL), interlayers (IL), and colored layers which can be decolorized during development processing, and especially anti-halation layers (AH), as required. The YL, ML and CL have spectral sensitivities corresponding to at least three light sources which have different principal wavelengths. The principal sensitive wavelengths of the YL, the ML and the CL are separated from one another by at least 30 nm, and preferably by from 50 nm to 100 nm, and at the principal wavelength of any one sensitive layer there is a difference in photographic speed from the other layers of at least 0.8 LogE (exposure), and preferably of at least 1.0. At least one of the photosensitive layers is sensitive in the region of wavelength longer than 670 nm, and most desirably at least one layer is sensitive in the region of wavelength longer than 750 nm.

For example, any photosensitive layer structure such as those indicated in the following table can be adopted. In this table, R signifies red sensitization and IR-1 and IR-2 signify layers which have been spectrally sensitized to different infrared wavelength regions.

| | (1) | (2) | (3) | (4) | (5) | (6) | (7) | (8) | (9) |
|---|---|---|---|---|---|---|---|---|---|
| Protective Layer | PL | PL | PL | PL | PL | PL | PL | PL | PL |
| Photosensitive Layer Unit | YL = R<br>ML = IR-1<br>CL = IR-2<br>(AH) | YL = IR-2<br>ML = IR-1<br>CL = R<br>(AH) | YL = R<br>CL = IR-1<br>ML = IR-2<br>(AH) | ML = R<br>YL = IR-1<br>CL = IR-2<br>(AH) | CL = R<br>YL = IR-1<br>ML = IR-2<br>(AH) | CL = R<br>ML = IR-1<br>YL = IR-2<br>(AH) | CL = IR-2<br>ML = IR-1<br>YL = R<br>(AH) | ML = IR-2<br>CL = IR-1<br>YL = R<br>(AH) | ML = R<br>CL = IR-1<br>YL = IR-2<br>(AH) |
| Support | | | | | | | | | |

In the present invention, the photosensitive layer which has a spectral sensitivity in the wavelength region above 670 nm can be image exposed using a laser light beam. Hence, the spectral sensitivity distribution is preferably in a wavelength range of ±25 nm of the principal wavelength, and most desirably of ±15 nm of the principal wavelength. On the other hand, the spectral sensitivity of the present invention in the infrared wavelength region at wavelengths above 670 nm or more is likely to become comparatively broad. Hence, the spectral sensitivity distribution of the photosensitive layer may be corrected using dyes, preferably dyes which are included nd fixed in a specified layer. Dyes which can be included in a colloid layer in a form which is fast to diffusion, and which can be decolorized during the course of development processing, are used for this purpose. First, fine particle dispersions of solid dyes which are essentially insoluble in water at pH 7 or less and soluble in water at pH greater than 7 can be used. Second, acidic dyes can be used together with a polymer, or polymer latex, which provides cation sites. Dyes represented by the general formulae (VI) and (VII) in the specification of JP-A 63-197947 are useful in the first and second methods described above. Dyes which have carboxyl groups are especially useful in the first method.

The transparent films, such as cellulose nitrate films and poly(ethylene terephthalate) films, and reflective supports normally used in photographic photosensitive materials can be used as the supports which are used in the present invention. The use of reflective supports is preferred in view of the aims of the invention.

The "reflective supports" used in the present invention have a high reflectivity and the dye image which is formed in the silver halide emulsion layer is bright. Supports which have been covered with a hydrophobic resin which contains a dispersion of light reflecting material, such as titanium oxide, zinc oxide, calcium carbonate or calcium sulfate for increasing the reflectance in the visible wavelength region, and supports comprising a hydrophobic resin which contains a dispersion of a light reflecting substance, are included among such reflective supports. Examples of such supports include baryta paper, polyethylene coated paper, polypropylene based synthetic paper and transparent supports, such as glass plates, polyester films, such as poly(ethylene terephthalate), cellulose triacetate and cellulose nitrate films, polyamide films, polycarbonate films, polystyrene films, and polyvinyl films, on which a reflective layer has been established or with which a reflective substance is combined. These supports can be selected appropriately according to the intended application of the material.

The use of a white pigment which has been milled adequately in the presence of a surfactant and in which the particle surfaces have been treated with a dihydric -tetrahydric alcohol for the light reflecting substance is preferred.

The occupied surface ratio of fine white pigment particles per specified unit area (%) can be determined most commonly by dividing the area under observation into adjoining $6\times6$ j$\mu$m unit areas and measuring the occupied area ration (%) ($R_i$) for the fine particles projected in each unit area. The variation coefficient of the occupied area ratio (%) can be obtained by means of the ratio $s/\overline{R}$ of the standard deviation s for $R_i$ with respect to the average value ($\overline{R}$) of $R_i$. The number of unit areas taken for observation (n) is preferably at least six. Hence, the variation coefficient can be obtained from the following expression:

$$\sqrt{\frac{\sum_{i=1}^{n}(Ri-\overline{R})^2}{n-1}} \Big/ \frac{\sum_{i=1}^{n} Ri}{n}$$

In the present invention, the variation coefficient of the occupied area ratio (%) of the fine pigment particles is not more than 0.15, and preferably not more than 0.12.

Metal films, for example, films of aluminum or alloys thereof, which have mirror surface reflection properties or type two diffuse reflection properties as disclosed, for example, in JP-A-63-118154, JP-A-63-24247, JP-A-63-24251 to JP-A-63-24253, and JP-A-63-245255 can be used for the light reflecting substance.

The supports used in the invention should be light in weight, thin and strong since they are used for hard copy after image formation. They should also be cheap. Polyethylene coated papers and synthetic papers of thickness from 10 to 250 $\mu$m, and preferably of thickness from 30 to 180 $\mu$m, are preferred as reflective supports.

The color photographic photosensitive materials of the present invention can be used, for example, as camera color negative films (for general purpose and cinematographic purposes for example), as color reversal films (for slides and cinematographic purposes for example), as color printing papers, as color positive films (for cinematographic purposes for example), as color reversal papers, as heat developable color photosensitive materials, as color photographic photosensitive materials for plate making purposes (lith films, scanner films for example), as color X-ray photographic photosensitive materials (for direct and indirect medical and industrial purposes for example), and as color diffusion transfer photosensitive materials (DTR).

ILLUSTRATIVE EXAMPLES

The invention is described below in practical terms by means of illustrative examples, but the invention is not limited to these examples.

EXAMPLE 1

Lime treated gelatin (32 grams) was added to 1000 ml of distilled water and dissolved at 40° C., after which 3.3 grams of sodium chloride was added and the temperature was raised to 52° C. A 1% aqueous solution (3.2 ml) of N,N'-dimethylimidazolin-2-thione was then added to the solution. Next, a solution obtained by dissolving 32.0 grams of silver nitrate in 200 ml of distilled water and a solution obtained by dissolving 11.0 grams of sodium chloride in 200 ml of distilled water were added to, and mixed with, the aforementioned solution over a period of 14 minutes while maintaining a temperature of 52° C. Moreover, a solution obtained by dissolving 128.0 grams of silver nitrate in 560 ml of water and a solution obtained by dissolving 44.0 grams of sodium chloride and 0.1 mg of potassium hexachloroiridate in 560 ml of distilled water were added to, and mixed with, the aforementioned mixture over a period of 20 minutes while maintaining a temperature at 52° C. The mixture was subsequently maintained at 52° C. for a period of 15 minutes, after which the temperature was reduced to 40° C. and the mixture was desalted and washed with water. Lime treated gelatin was then added to provide emulsion (A). This emulsion obtained contained cubic silver chloride grains of average particle size 0.45 $\mu$ with a particle size variation coefficient of 0.08.

Silver chlorobromide emulsion (B) which contained 2 mol% of silver bromide was obtained in the same way as emulsion (A) except that the aqueous solutions of sodium chloride added together with the aqueous silver nitrate solutions were replaced by mixed aqueous solutions of sodium chloride and potassium bromide (with the same total number of mol as before, mol ratio 98:2). The addition times for the reactants were adjusted so that the average grain size of the silver halide grains contained in this emulsion was the same as that in emulsion (A). The grains obtained were cubic grains, and the grains size variation coefficient was 0.08.

Silver chlorobromide emulsion (C) which contained 10 mol% silver bromide was obtained in the same as was emulsion (A) except that the aqueous solutions of sodium chloride added together with the aqueous silver nitrate solutions were replaced by mixed aqueous solutions of sodium chloride and potassium bromide (with the same total number of mol as before, mol ratio 9:1). The addition times for the reactants were adjusted in such a way that the average grain size of the silver halide grains contained in this emulsion was the same as that in emulsion (A). The grains obtained were cubic grains, and the grains size variation coefficient was 0.09.

The pH and pAg values of the three types of emulsion so obtained were adjusted, after which triethylthiourea was added and each emulsion was chemically sensitized optimally to provide emulsions.(A-1), (B-1) and (C-1).

A fine grained silver bromide emulsion (a-1) of average grains size 0.05 μ was prepared separately from the above-mentioned emulsions.

An amount of the emulsion (a-1) corresponding to 2 mol% as silver halide was added to emulsion (A), after which triethylthiourea was added and the emulsion was chemically sensitized optimally to provide the emulsion (A-2).

The compound indicated below was added as a stabilizer at a rate of $5.0\times10^{-4}$ mol/per mol of silver halide to each of these four types of emulsion.

Stabilizer (I-1)

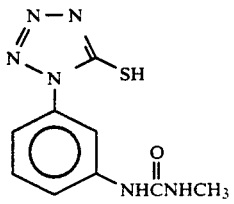

The halogen compositions and distributions of the four types of silver halide emulsion so obtained were investigated using X-ray diffraction methods.

The results obtained showed single diffraction peaks for 100% silver chloride with emulsion (A-1), for 98% silver chloride (2% silver bromide) with emulsion (B-1) and for 90% silver chloride (10% silver bromide) with emulsion (C-1). On the other hand, the result for emulsion (A-2) showed a broad peak centered on 70% silver chloride (30% silver bromide) with a spread to the side of 60% silver chloride (40% silver bromide) as well as a main peak for 100% silver chloride.

Next, emulsified dispersion of color couplers etc. were prepared and combined with each of the aforementioned silver halide emulsions and the mixtures were coated onto paper supports which had been laminated on both sides with polyethylene to provide multilayer photosensitive materials in which the layer structure was as indicated below.

Layer Structure

The composition of each layer is indicated below. The numerical values indicate coated weights (g/m$^2$; or ml/m$^2$ in the case of solvents). The coated weights of silver halide emulsions are shown as coated weights of silver.

| | |
|---|---|
| Support | |
| Polyethylene laminated paper [White pigment ($TiO_2$) and blue dye (ultramarine) were included in the polyethylene on the emulsion layer side] | |
| First Layer: Yellow Color Forming Layer | |
| Silver halide emulsion (Table 1) | 0.30 |
| Spectrally sensitizing dye (Table 1) | |
| Yellow coupler (Y-1) | 0.82 |
| Colored image stabilizer (Cpd-7) | 0.09 |
| Solvent (Solv-6) | 0.28 |
| Gelatin | 1.75 |
| Second Layer: Anti-color Mixing Layer | |
| Gelatin | 1.25 |
| Filter dye (Filter DYE-1) | 0.01 |
| Anti-color mixing agent (Cpd-4) | 0.11 |
| Solvents (Solv-2) | 0.24 |
| Solvents (Solv-5) | 0.26 |
| Third Layer: Magenta Color Forming Layer | |
| Silver halide emulsions (Table 1) | 0.12 |
| Spectrally sensitizing dye (Table 1) | |
| Magenta coupler (M-1) | 0.13 |
| Magenta coupler (M-2) | 0.09 |
| Colored image stabilizers (Cpd-1) | 0.15 |
| Colored image stabilizers (Cpd-2) | 0.02 |
| Colored image stabilizers (Cpd-8) | 0.02 |
| Colored image stabilizers (Cpd-9) | 0.03 |
| Solvents (Solv-1) | 0.34 |
| Solvents (Solv-2) | 0.17 |
| Gelatin | 1.25 |
| Fourth Layer: Ultraviolet Absorbing Layer | |
| Gelatin | 1.58 |
| Filter dye (Filter DYE-2) | 0.03 |
| Ultraviolet absorber (UV-1) | 0.47 |
| Anti-color mixing agent (Cpd-4) | 0.05 |
| Solvent (Solv-3) | 0.26 |
| Fifth Layer: Cyan Color Forming Layer | |
| Silver halide emulsions (Table 1) | 0.23 |
| Spectrally sensitizing dye (Table 1) | |
| Cyan coupler (C-1) | 0.32 |
| Colored image stabilizers (Cpd-5) | 0.17 |
| Colored image stabilizers (Cpd-6) | 0.04 |
| Colored image stabilizers (Cpd-7) | 0.40 |
| Solvent (Solv-4) | 0.15 |
| Gelatin | 1.34 |
| Sixth Layer: Ultraviolet Absorbing Layer | |
| Gelatin | 0.53 |
| Ultraviolet absorber (UV-1) | 0.16 |
| Anti-color mixing agent (Cpd-4) | 0.02 |
| Solvent (Solv-3) | 0.09 |
| Seventh Layer: Protective Layer | |
| Gelatin | 1.33 |
| Acrylic modified poly(vinyl alcohol) (17% modification) | 0.17 |
| Liquid paraffin | 0.03 |

1-Oxy-3,5-dichloro-s-triazine sodium salt, was used at a rate of 14.0 mg per gram of gelatin in each layer as a gelatin hardening agent.

Yellow Coupler (Y-1)

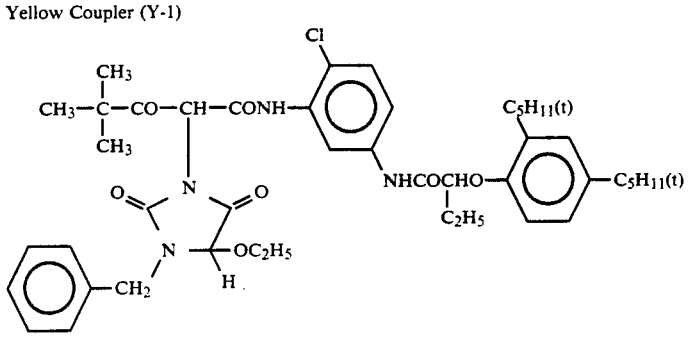

Cyan Coupler (C-1)

-continued
A 1:1 (mol ratio) mixture of:
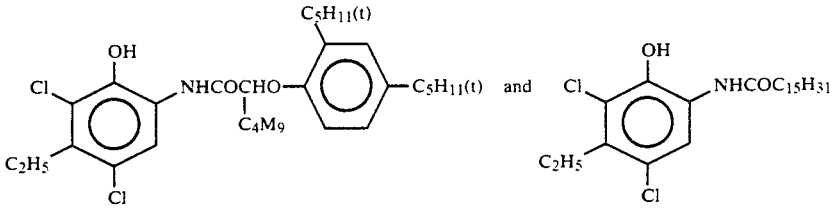
Magenta Coupler (M-1)
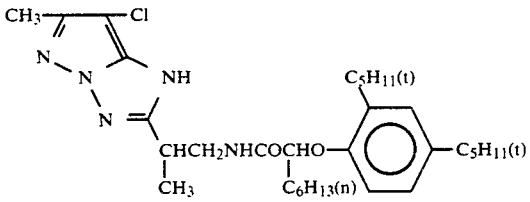
Magenta Coupler (M-2)
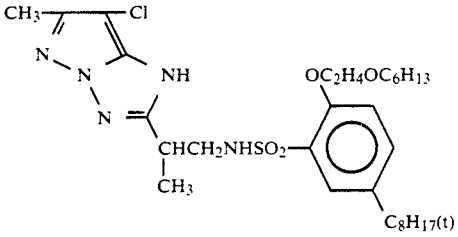
Colored Image Stabilizer (Cpd-1)
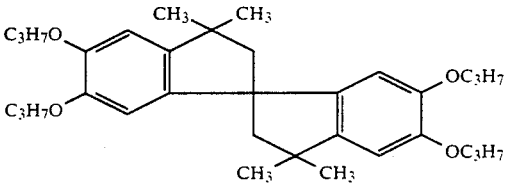
Colored Image Stabilizer (Cpd-2)
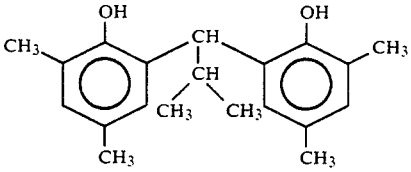
Colored Image Stabilizer (Cpd-3)
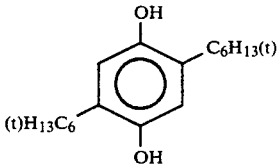
Anti-color Mixing Agent (Cpd-4)
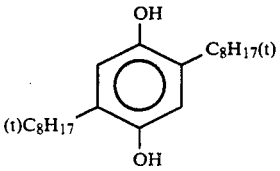
Colored Image Stabilizer (Cpd-5)
A 2:4:4 mixture (by weight) of:

-continued
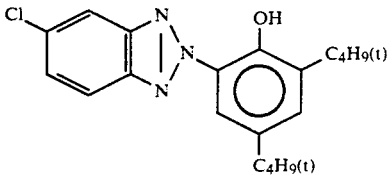
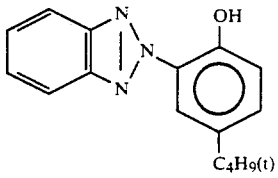
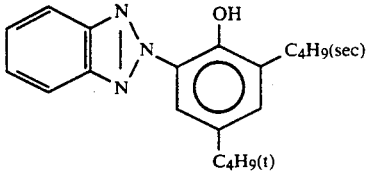
Colored Image Stabilizer (Cpd-6)
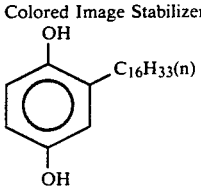
Colored Image Stabilizer (Cpd-7)
$$\left(CH_2-\underset{\substack{|\\ CONHC_4H_9(t)}}{CH}\right)_n$$
(Molecular weight 80.000)
Colored Image Stabilizer (Cpd-8)
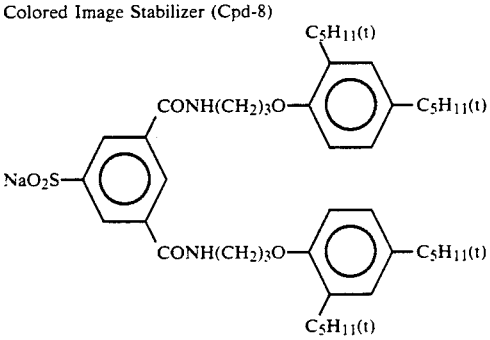
Colored Image Stabilizer (Cpd-9)
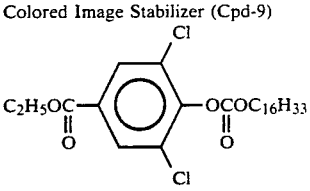
Solvent (Solv-1)
$$O{=}P\left(OCH_2\overset{\substack{C_2H_5\\ |}}{C}HC_4H_9\right)_3$$
Solvent (Solv-2)
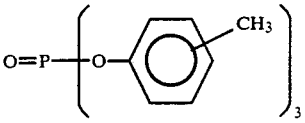
Solvent (Solv-3)
$$\begin{array}{l} COOC_8H_{17} \\ | \\ (CH_2)_8 \\ | \\ COOC_8H_{17} \end{array}$$

-continued
Solvent (Solv-4 )
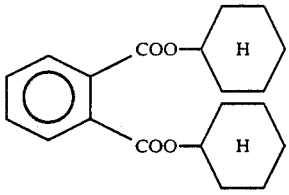
Solvent (Solv-5)
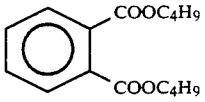
Solvent (Solv-6)
$O{=}P{\leftarrow}O{-}C_9H_{19}(iso))_3$
Ultraviolet absorber (UV-1)
A 4:2:4 (by weight) mixture of:
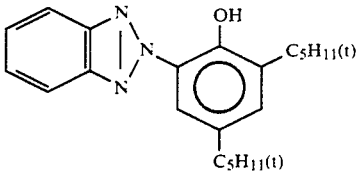
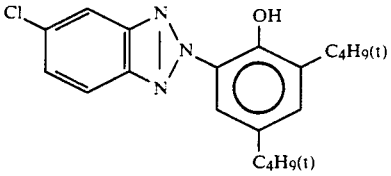
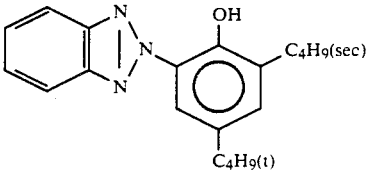
(FILTER DYE-1)
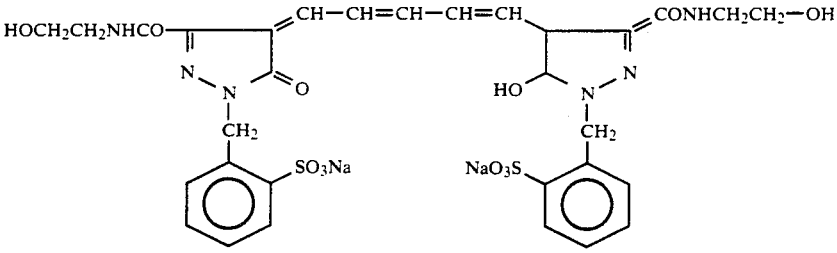
10 mg per square meter of coated film (For filter and anti-irradiation purposes)
(FILTER DYE-2)
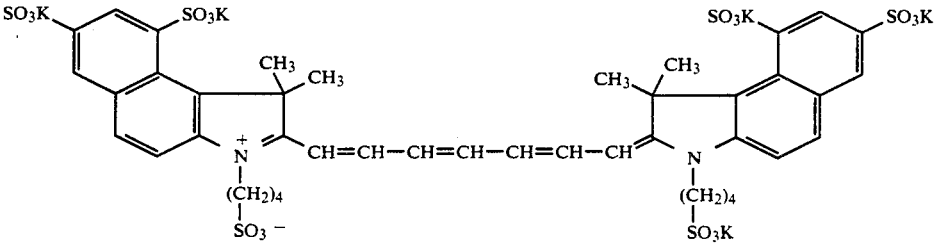
30 mg per square meter of coated film (For filter and anti-irradiation purposes)
(Dye-1)

-continued
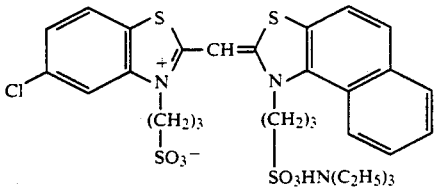
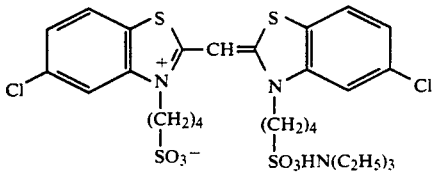
(2.0 × $10^{-4}$ mol of each per mol of silver halide)
(Dye-2)
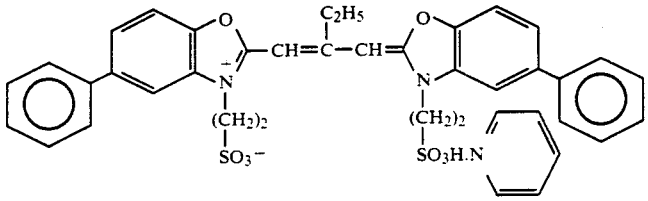
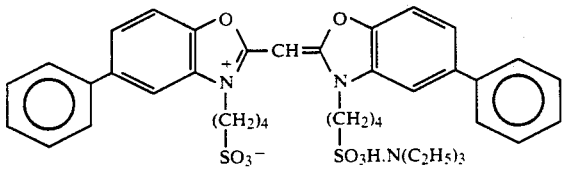
(4.0 × $10^{-4}$ mol/7.0 × $10^{-5}$ mol per mol of silver halide)
(Dye-3)
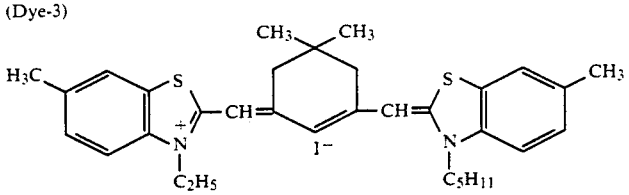
(0.9 × $10^{-4}$ mol per mol of silver halide)
The compound (III-1) indicated below was added at a rate of 2.6×$10^{-3}$ mol per mol of silver halide when the above-mentioned sensitizing dyes were used.
(III-1)
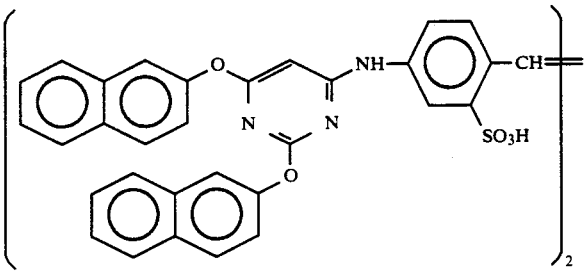

-continued
(Dye-4)
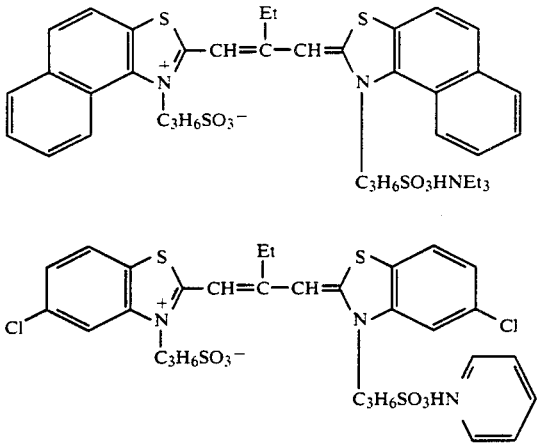
(3.2 × $10^{-5}$ mol/2.7 × $10^{-5}$ mol per mol of silver halide)
(Dye-5)
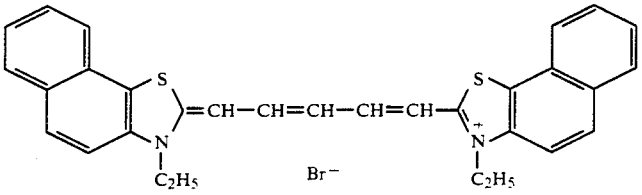
Added at the rate of 3.5 × $10^{-5}$ mol per mol of silver halide and (III-1) was used conjointly at a rate of 2.6 × $10^{-3}$ mol/mol.Ag
(Dye-6)
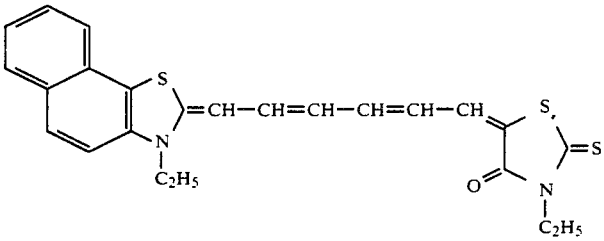
1.7 × $10^{-5}$ mol per mol of silver halide, used conjointly with 2.6 × $10^{-3}$ mol/mol.Ag (III-1)
(Dye-7)
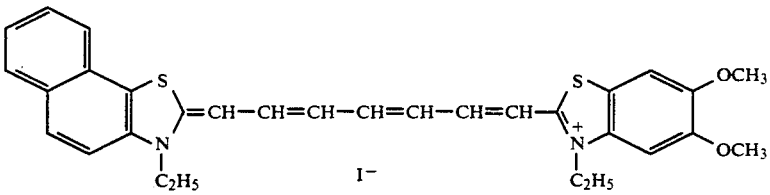
(Dye-8)
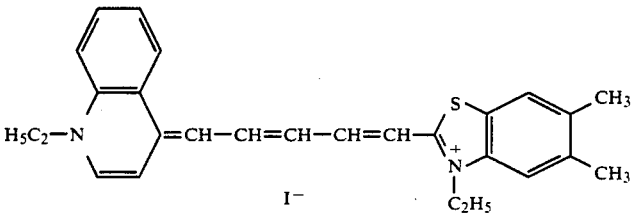

-continued (Dye-9)

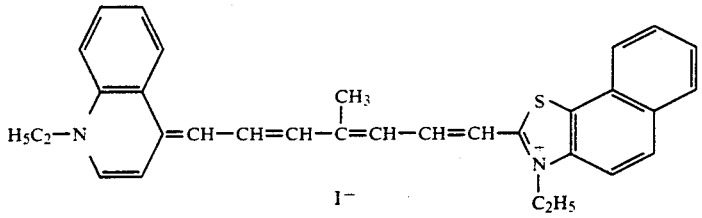

(Dye-10)

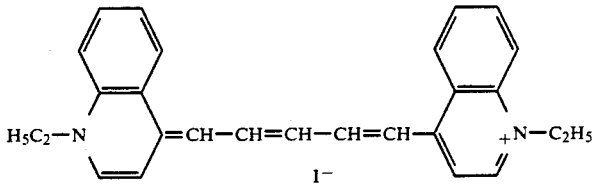

(Dye-11)

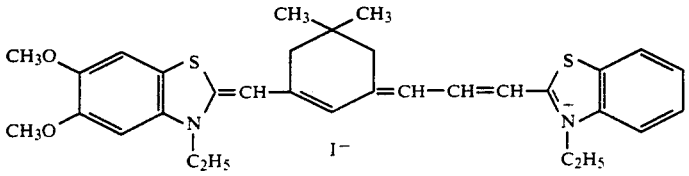

Dye-7, Dye-8, Dye-9, Dye-10 and dyes (68), (65), (71), (73), (53), (79), (54), (78), (66), (70) of the present invention were used conjointly at the rate of $3.5\times10^{-5}$ mol per mol of silver halide with $2.6\times10^{-3}$ mol/mol·Ag of (III-1).

Dyes (2), (16), (1), (44), (20), (49), (31), (32), (12), (5), (26), (27), (51), (46) and (13) of the present invention were used conjointly at the rate of $1.7\times10^{-5}$ mol per mol of silver halide with $2.6\times10^{-3}$ mol/mol·Ag of (III-1).

TABLE 1

| | | Yellow Forming Layer | | Magenta Forming Layer | | Cyan Forming Layer | | |
|---|---|---|---|---|---|---|---|---|
| Sample | Emulsion Used | Dye Used | Exposing Wavelength (mm) | Dye Used | Exposing Wavelength (mm) | Dye Used | Exposing Wavelength (mm) | Remarks |
| 1 | A-1 | Dye-4 | 670 | Dye-5 | 750 | Dye-6 | 830 | Comp. Ex. |
| 2 | A-1 | Dye-4 | 670 | Dye-5 | 750 | Dye-7 | 830 | Comp. Ex. |
| 3 | B-1 | Dye-4 | 670 | Dye-5 | 750 | Dye-6 | 830 | Comp. Ex. |
| 4 | B-1 | Dye-4 | 670 | Dye-5 | 750 | Dye-7 | 830 | Comp. Ex. |
| 5 | C-1 | Dye-4 | 670 | Dye-5 | 750 | Dye-6 | 830 | Comp. Ex. |
| 6 | C-1 | Dye-4 | 670 | Dye-5 | 750 | Dye-7 | 830 | Comp. Ex. |
| 7 | A-2 | Dye-4 | 670 | Dye-5 | 750 | Dye-6 | 830 | Comp. Ex. |
| 8 | A-2 | Dye-4 | 670 | Dye-5 | 750 | Dye-7 | 830 | Comp. Ex. |
| 9 | A-2 | Dye-3 | 650 | Dye-5 | 750 | Dye-7 | 830 | Comp. Ex. |
| 10 | A-2 | Dye-1 | 450 | Dye-2 | 532 | Dye-7 | 830 | Comp. Ex. |
| 11 | A-2 | Dye-4 | 670 | Dye-8 | 780 | Dye-6 | 830 | Comp. Ex. |
| 12 | A-2 | Dye-4 | 670 | Dye-8 | 780 | Dye-9 | 880 | Comp. Ex. |
| 13 | A-2 | Dye-4 | 670 | Dye-8 | 780 | Dye-10 | 880 | Comp. Ex. |
| 14 | A-2 | Dye-4 | 670 | Dye-8 | 780 | Dye-11 | 830 | Comp. Ex. |
| 15 | A-2 | Dye-4 | 670 | Dye-5 | 750 | Dye-9 | 880 | Comp. Ex. |
| 16 | A-1 | Dye-4 | 670 | Dye-5 | 750 | (2) | 830 | Invention |
| 17 | A-1 | Dye-4 | 670 | Dye-5 | 750 | (68) | 830 | Invention |
| 18 | B-1 | Dye-4 | 670 | Dye-5 | 750 | (2) | 830 | Invention |
| 19 | B-1 | Dye-4 | 670 | Dye-5 | 750 | (68) | 830 | Invention |
| 20 | C-1 | Dye-4 | 670 | Dye-5 | 750 | (2) | 830 | Invention |
| 21 | C-1 | Dye-4 | 670 | Dye-5 | 750 | (68) | 830 | Invention |
| 22 | A-2 | Dye-4 | 670 | Dye-5 | 750 | (2) | 830 | Invention |
| 23 | A-2 | Dye-4 | 670 | Dye-5 | 750 | (68) | 830 | Invention |
| 24 | A-2 | Dye-3 | 650 | Dye-5 | 750 | (68) | 830 | Invention |
| 25 | A-2 | Dye-1 | 450 | Dye-2 | 532 | (68) | 830 | Invention |
| 26 | A-2 | Dye-4 | 670 | Dye-8 | 780 | (16) | 830 | Invention |
| 27 | A-2 | Dye-4 | 670 | (1) | 780 | (44) | 830 | Invention |
| 28 | A-2 | Dye-4 | 670 | (2) | 780 | (65) | 830 | Invention |
| 29 | A-2 | Dye-4 | 670 | (49) | 780 | (31) | 880 | Invention |
| 30 | A-2 | Dye-4 | 670 | (71) | 780 | (32) | 880 | Invention |
| 31 | A-2 | Dye-4 | 670 | (73) | 780 | (53) | 880 | Invention |
| 32 | A-2 | Dye-4 | 670 | (79) | 780 | (54) | 830 | Invention |
| 33 | A-2 | Dye-4 | 670 | (12) | 750 | (5) | 830 | Invention |
| 34 | A-2 | Dye-4 | 670 | (26) | 750 | (27) | 830 | Invention |
| 35 | A-2 | Dye-4 | 670 | (51) | 750 | (46) | 830 | Invention |
| 36 | A-2 | Dye-4 | 670 | (78) | 750 | (66) | 830 | Invention |

TABLE 1-continued

| Sample | Emulsion Used | Yellow Forming Layer Dye Used | Yellow Forming Layer Exposing Wavelength (mm) | Magenta Forming Layer Dye Used | Magenta Forming Layer Exposing Wavelength (mm) | Cyan Forming Layer Dye Used | Cyan Forming Layer Exposing Wavelength (mm) | Remarks |
|---|---|---|---|---|---|---|---|---|
| 37 | A-2 | Dye-4 | 670 | (13) | 750 | (70) | 880 | Invention |

The exposing device used in this example is described below.

The lasers used in this device were a GaAs laser (oscillating wavelength about 900 nm), an LD excited YAG laser (oscillating wavelength about 1064 nm) and an InGaAs laser (oscillating wavelength about 1300 nm). A nonlinear optical element was used in each case to extract the second harmonic (wavelengths 450 nm, 532 nm and 650 nm, respectively).

Furthermore, laser light obtained using an AlGaInP semiconductor laser (oscillating wavelength about 670 nm), a GaAlAs semiconductor laser (oscillating wavelength about 750 nm), A GaAlAs semiconductor laser (oscillating wavelength about 810 nm), a GaAlAs semiconductor laser (oscillating wavelength about 780), a Ga AlAs semiconductor laser (oscillating wavelength about 830 nm) and a GaAlAs semiconductor laser (oscillating wavelength about 880 nm) were used in a device so that the laser light was directed sequentially by means of a rotating multi-surfaced body as a scanning exposure light onto the color printing paper which was being moved in the direction at right angles to the scanning direction. The exposure was controlled by controlling the semiconductor laser light outputs electrically.

The exposure wavelengths were as shown in Table 1, above.

The exposure was adjusted so that when development was started after 10 seconds the laser exposure the yellow, magenta and cyan densities were 1.0. The time required from the commencement to the completion of the exposure was about 1 minute.

The development processing operation was a indicated below.

| Processing Operation | Temperature | Time |
|---|---|---|
| Color Development | 35° C. | 45 seconds |
| Bleach-fix | 30–35° C. | 45 seconds |
| Rinse (1) | 30–35° C. | 20 seconds |
| Rinse (2) | 30–35° C. | 20 seconds |
| Rinse (3) | 30–35° C. | 20 seconds |
| Rinse (4) | 30–35° C. | 30 seconds |
| Drying | 70–80° C. | 60 seconds |

(A four tank counter-flow system from rinse (4) to rinse (1)).

The composition of each processing bath was as indicated below.

| | |
|---|---|
| Color Development Bath | |
| Water | 800 ml |
| Ethylenediamine-N,N,N,N-tetramethyl-phosphonic acid | 1.5 g |
| Triethylenediamine(1,4-diazabicyclo-[2,2,2]octane | 5.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |

-continued

| | |
|---|---|
| N,N-Diethylhydroxylamine | 4.2 g |
| Fluorescent whitener (UVITEX CK, made by Ciba Geigy) | 2.0 g |
| Water to make up to | 1000 ml |
| pH (25° C.) | 10.10 |
| Bleach-fix Bath | |
| Water | 400 ml |
| Ammonium thiosulfate (70%) | 100 ml |
| Sodium sulfite | 18 g |
| Ethylenediamine tetra-acetic acid, Fe(III) ammonium salt | 55 g |
| Ethylenediamine tetra-acetic acid | 3 g |
| Ammonium bromide | 40 g |
| Glacial acetic acid | 8 g |
| Water to make up to | 1000 ml |
| pH (25° C.) | 5.5 |
| Rinse Bath | |
| Ion exchanged water (Both calcium and magnesium less than 3 ppm) | |

The evaluation of photographic performance was carried out on the basis of two considerations, namely photographic speed and fogging. Photographic speed was indicated by the relative value of the logarithm of the exposure required to provide a yellow, magenta and cyan density of 1.0. Relative values obtained by taking the speed of each layer of sample No. 1 without ageing (fresh) to be 100 were used for convenience. Furthermore, the evaluation of storage properties was carried out by observing the change in photographic speed and the change in fog level on comparing samples aged for 2 days at 60° C., 40% RH (storage-1) and samples aged for 2 days at 50° C., 80% RH (storage-2) with unaged (fresh) samples. The storage sensitivities are shown Table 2 below as relative values taking the values of the unaged sample to be 100.

The principal items for comparison in Table 2 are described below.

(1) Comparison of Dyes

* Comparison of Cyan Color Forming Layers:

No. 1, 2⟷No. 16,17
No. 3, 4⟷No. 18, 19
No. 5, 6⟷No. 20, 21
No. 7, 8⟷No. 22, 23
No. 9⟷No. 24
No. 10⟷No. 25
No. 11, 14⟷No. 26

* Comparison of Magenta Color Forming Layers, Cyan Color Forming Layers:

No. 12, 13⟷No. 29, 30, 31, 32
No. 11, 14⟷No. 27, 28
No. 15⟷No. 33, 34, 35, 36
No. 7, 8⟷No. 37

(2) Comparison of Emulsions

No. 16, 17, 18, 19, 20, 21⟷No. 22, 23

It is clear from the results above that the samples of the present invention had higher speeds and lower fog levels that the comparative samples, and that the change in speed and fog level on storage was lower.

TABLE 2

| Sample No. | Yellow Layer Fresh Speed | Yellow Layer Fresh Fog | Yellow Layer Storage-1 Speed | Yellow Layer Storage-1 Fog | Yellow Layer Storage-2 Speed | Yellow Layer Storage-2 Fog | Magenta Layer Fresh Speed | Magenta Layer Fresh Fog | Magenta Layer Storage-1 Speed | Magenta Layer Storage-1 Fog | Magenta Layer Storage-2 Speed | Magenta Layer Storage-2 Fog |
|---|---|---|---|---|---|---|---|---|---|---|---|---|
| 1 | 100 | 0.12 | 95 | 0.14 | 75 | 0.13 | 100 | 0.14 | 73 | 0.16 | 40 | 0.15 |
| 2 | 100 | 0.12 | 95 | 0.14 | 75 | 0.13 | 100 | 0.14 | 73 | 0.16 | 40 | 0.15 |
| 3 | 105 | 0.12 | 105 | 0.13 | 75 | 0.13 | 102 | 0.16 | 75 | 0.16 | 51 | 0.15 |
| 4 | 105 | 0.12 | 105 | 0.13 | 75 | 0.13 | 102 | 0.16 | 75 | 0.16 | 51 | 0.15 |
| 5 | 107 | 0.12 | 92 | 0.13 | 73 | 0.13 | 104 | 0.16 | 73 | 0.16 | 47 | 0.17 |
| 6 | 107 | 0.12 | 92 | 0.13 | 73 | 0.13 | 104 | 0.16 | 73 | 0.16 | 47 | 0.17 |
| 7 | 104 | 0.12 | 107 | 0.12 | 84 | 0.12 | 103 | 0.15 | 80 | 0.16 | 45 | 0.16 |
| 8 | 104 | 0.12 | 107 | 0.12 | 84 | 0.12 | 103 | 0.15 | 80 | 0.16 | 45 | 0.16 |
| 9 | 120 | 0.11 | 104 | 0.13 | 93 | 0.12 | 103 | 0.15 | 80 | 0.16 | 45 | 0.16 |
| 10 | 140 | 0.12 | 103 | 0.12 | 95 | 0.11 | 110 | 0.14 | 90 | 0.14 | 63 | 0.13 |
| 11 | 100 | 0.12 | 106 | 0.12 | 95 | 0.13 | 105 | 0.15 | 75 | 0.17 | 50 | 0.15 |
| 12 | 100 | 0.12 | 106 | 0.12 | 95 | 0.13 | 105 | 0.15 | 75 | 0.17 | 50 | 0.15 |
| 13 | 100 | 0.12 | 106 | 0.12 | 95 | 0.13 | 105 | 0.15 | 75 | 0.17 | 50 | 0.15 |
| 14 | 100 | 0.12 | 106 | 0.12 | 95 | 0.13 | 105 | 0.15 | 75 | 0.17 | 50 | 0.15 |
| 15 | 100 | 0.12 | 106 | 0.12 | 95 | 0.13 | 100 | 0.14 | 80 | 0.16 | 45 | 0.15 |
| 16 | 100 | 0.12 | 90 | 0.12 | 75 | 0.13 | 100 | 0.14 | 80 | 0.16 | 45 | 0.15 |
| 17 | 100 | 0.12 | 90 | 0.12 | 75 | 0.13 | 100 | 0.14 | 80 | 0.16 | 45 | 0.15 |
| 18 | 105 | 0.12 | 105 | 0.13 | 75 | 0.13 | 102 | 0.16 | 75 | 0.16 | 51 | 0.15 |
| 19 | 105 | 0.12 | 105 | 0.13 | 75 | 0.13 | 102 | 0.16 | 75 | 0.16 | 51 | 0.15 |
| 20 | 107 | 0.12 | 92 | 0.13 | 85 | 0.13 | 104 | 0.16 | 73 | 0.16 | 47 | 0.17 |
| 21 | 107 | 0.12 | 92 | 0.13 | 85 | 0.13 | 104 | 0.16 | 73 | 0.16 | 47 | 0.17 |
| 22 | 125 | 0.12 | 96 | 0.12 | 93 | 0.12 | 121 | 0.15 | 85 | 0.16 | 55 | 0.16 |
| 23 | 125 | 0.12 | 96 | 0.12 | 93 | 0.12 | 121 | 0.15 | 85 | 0.16 | 55 | 0.16 |
| 24 | 120 | 0.11 | 104 | 0.13 | 93 | 0.12 | 121 | 0.15 | 85 | 0.16 | 55 | 0.16 |
| 25 | 140 | 0.12 | 103 | 0.12 | 95 | 0.11 | 110 | 0.14 | 90 | 0.14 | 63 | 0.13 |
| 26 | 100 | 0.12 | 106 | 0.12 | 95 | 0.13 | 105 | 0.15 | 75 | 0.17 | 50 | 0.15 |
| 27 | 100 | 0.12 | 106 | 0.12 | 95 | 0.13 | 204 | 0.12 | 103 | 0.12 | 89 | 0.13 |
| 28 | 100 | 0.12 | 106 | 0.12 | 95 | 0.13 | 202 | 0.12 | 98 | 0.12 | 92 | 0.13 |
| 29 | 100 | 0.12 | 106 | 0.12 | 95 | 0.13 | 251 | 0.12 | 105 | 0.12 | 91 | 0.13 |
| 30 | 100 | 0.12 | 106 | 0.12 | 95 | 0.13 | 310 | 0.12 | 94 | 0.13 | 90 | 0.14 |
| 31 | 100 | 0.12 | 106 | 0.12 | 95 | 0.13 | 210 | 0.13 | 97 | 0.13 | 94 | 0.13 |
| 32 | 100 | 0.12 | 106 | 0.12 | 95 | 0.13 | 195 | 0.12 | 96 | 0.13 | 89 | 0.13 |
| 33 | 100 | 0.12 | 106 | 0.12 | 95 | 0.13 | 240 | 0.12 | 94 | 0.12 | 87 | 0.13 |
| 34 | 100 | 0.12 | 106 | 0.12 | 95 | 0.13 | 235 | 0.12 | 93 | 0.13 | 87 | 0.12 |
| 35 | 100 | 0.12 | 106 | 0.12 | 95 | 0.13 | 180 | 0.12 | 102 | 0.12 | 94 | 0.13 |
| 36 | 100 | 0.12 | 106 | 0.12 | 95 | 0.13 | 242 | 0.12 | 103 | 0.12 | 95 | 0.13 |
| 37 | 100 | 0.12 | 106 | 0.12 | 95 | 0.13 | 205 | 0.12 | 96 | 0.12 | 87 | 0.13 |

| Sample No. | Cyan Layer Fresh Speed | Cyan Layer Fresh Fog | Cyan Layer Storage-1 Speed | Cyan Layer Storage-1 Fog | Cyan Layer Storage-2 Speed | Cyan Layer Storage-2 Fog | Remarks |
|---|---|---|---|---|---|---|---|
| 1 | 100 | 0.15 | 60 | 0.17 | 40 | 0.16 | Comp. Ex. |
| 2 | 105 | 0.15 | 62 | 0.16 | 45 | 0.17 | Comp. Ex. |
| 3 | 104 | 0.14 | 55 | 0.18 | 43 | 0.16 | Comp. Ex. |
| 4 | 116 | 0.14 | 58 | 0.18 | 45 | 0.17 | Comp. Ex. |
| 5 | 108 | 0.17 | 65 | 0.18 | 45 | 0.17 | Comp. Ex. |
| 6 | 125 | 0.17 | 66 | 0.17 | 54 | 0.17 | Comp. Ex. |
| 7 | 108 | 0.15 | 65 | 0.16 | 45 | 0.16 | Comp. Ex. |
| 8 | 118 | 0.14 | 68 | 0.15 | 53 | 0.16 | Comp. Ex. |
| 9 | 118 | 0.14 | 68 | 0.15 | 53 | 0.16 | Comp. Ex. |
| 10 | 118 | 0.14 | 68 | 0.15 | 53 | 0.16 | Comp. Ex. |
| 11 | 100 | 0.14 | 60 | 0.17 | 40 | 0.16 | Comp. Ex. |
| 12 | 80 | 0.14 | 50 | 0.17 | 33 | 0.17 | Comp. Ex. |
| 13 | 93 | 0.15 | 54 | 0.16 | 41 | 0.16 | Comp. Ex. |
| 14 | 105 | 0.14 | 60 | 0.16 | 34 | 0.15 | Comp. Ex. |
| 15 | 80 | 0.14 | 50 | 0.17 | 33 | 0.17 | Comp. Ex. |
| 16 | 152 | 0.12 | 103 | 0.13 | 92 | 0.13 | Invention |
| 17 | 165 | 0.12 | 104 | 0.13 | 91 | 0.13 | Invention |
| 18 | 155 | 0.13 | 104 | 0.13 | 94 | 0.13 | Invention |
| 19 | 166 | 0.13 | 105 | 0.13 | 91 | 0.13 | Invention |
| 20 | 158 | 0.13 | 104 | 0.13 | 93 | 0.13 | Invention |
| 21 | 169 | 0.13 | 104 | 0.13 | 94 | 0.13 | Invention |
| 22 | 204 | 0.12 | 102 | 0.12 | 95 | 0.13 | Invention |
| 23 | 208 | 0.12 | 101 | 0.12 | 97 | 0.13 | Invention |
| 24 | 209 | 0.12 | 103 | 0.12 | 97 | 0.13 | Invention |
| 25 | 208 | 0.12 | 101 | 0.12 | 97 | 0.13 | Invention |
| 26 | 215 | 0.12 | 103 | 0.12 | 95 | 0.13 | Invention |
| 27 | 221 | 0.12 | 106 | 0.12 | 96 | 0.13 | Invention |
| 28 | 251 | 0.12 | 104 | 0.12 | 94 | 0.13 | Invention |
| 29 | 270 | 0.12 | 98 | 0.12 | 93 | 0.12 | Invention |
| 30 | 261 | 0.12 | 96 | 0.13 | 87 | 0.12 | Invention |
| 31 | 342 | 0.12 | 103 | 0.13 | 95 | 0.13 | Invention |
| 32 | 205 | 0.12 | 94 | 0.12 | 96 | 0.14 | Invention |
| 33 | 195 | 0.12 | 101 | 0.13 | 97 | 0.14 | Invention |
| 34 | 230 | 0.12 | 96 | 0.13 | 94 | 0.13 | Invention |
| 35 | 221 | 0.12 | 98 | 0.12 | 95 | 0.13 | Invention |
| 36 | 195 | 0.12 | 97 | 0.12 | 94 | 0.13 | Invention |

TABLE 2-continued

| | | | | | | | |
|---|---|---|---|---|---|---|---|
| 37 | 272 | 0.12 | 96 | 0.12 | 90 | 0.13 | Invention |

Similar results were obtained with the aforementioned comparative dyes when the compounds disclosed in JP-A-61-137149, the dyes indicated below, were used as comparative compounds.

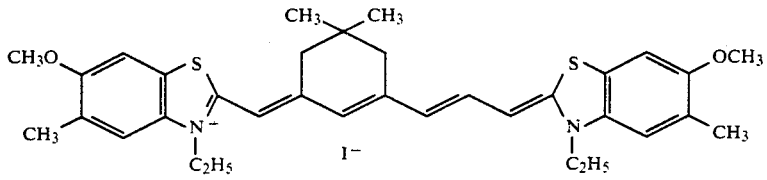

1

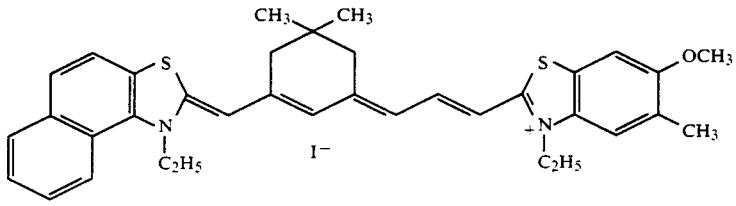

2

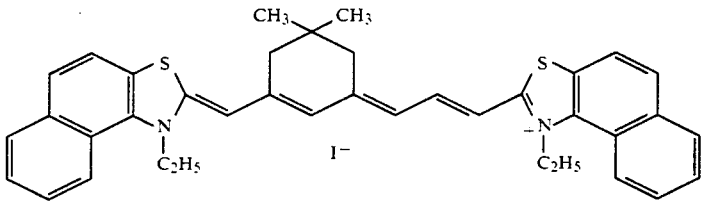

3

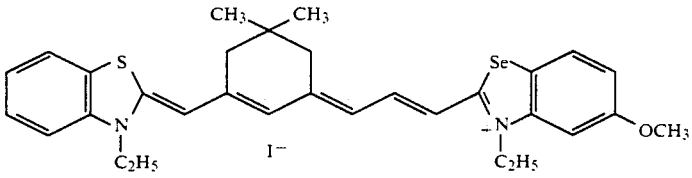

4

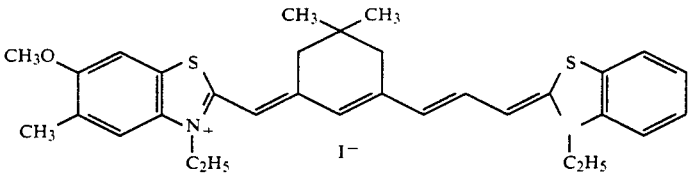

5

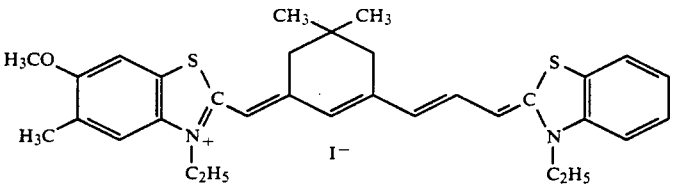

6

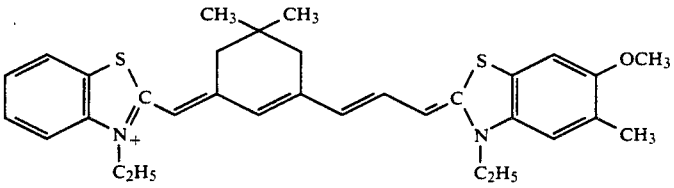

7

EXAMPLE 2

Samples 38, 39, 40, 41 and 42 were prepared in the same way as samples 11, 12, 26, 27 and 28 in Example 1 except that $1.5\times^{-3}$mol/mol·Ag of the super-sensitizing agent (IV-6) was used conjointly in the fifth layer. The photographic performance was tested in the same way as in Example 1 using these samples. The results obtained for the cyan color forming layer are shown in Table 3.

TABLE 3

| Sample No. | Cyan Color Forming Layer Fresh Speed | Fresh Fog | Storage-1 Speed | Storage-1 Fog | Storage-2 Speed | Storage-2 Fog | Remarks |
|---|---|---|---|---|---|---|---|
| 38 | 105 | 0.14 | 64 | 0.16 | 45 | 0.16 | Comp. Ex. |
| 39 | 83 | 0.14 | 57 | 0.16 | 37 | 0.17 | " |
| 40 | 250 | 0.12 | 101 | 0.12 | 98 | 0.13 | Invention |
| 41 | 245 | 0.12 | 103 | 0.12 | 97 | 0.13 | " |
| 42 | 280 | 0.12 | 102 | 0.12 | 95 | 0.13 | " |

It is clear from the results shown in Table 3 that a pronounced improvement in speed and stability is achieved with emulsions in which the super-sensitizing agent (VI-6) of this present invention is used with the sensitizing dyes of this present invention.

EXAMPLE 3

Preparation of Silver Halide Emulsion D

Lime treated gelatin (32 grams) was added to 1000 cc of distilled water and a solution was obtained at 40° C., after which 3.3 grams of sodium chloride was added and the temperature was raised to 60° C. A 1% aqueous solution (3.2 cc) of N,N'-dimethylimidazolidine-2-thione was then added to the solution. Next, a solution obtained by dissolving 32.0 grams of silver nitrate in 200 ml of distilled water and a solution obtained by dissolving 9.0 grams of potassium bromide and 6.6 grams of sodium chloride in 200 ml of distilled water were added to, and mixed with, the aforementioned solution over a period of 12 minutes while maintaining a temperature of 60° C. Moreover, a solution obtained by dissolving 128.0 grams of silver nitrate in 560 ml of water and a solution obtained by dissolving 35.9 grams of potassium bromide and 26.4 grams of sodium chloride in 560 ml of distilled water were added to, and mixed with, the aforementioned mixture over a period of 20 minutes while maintaining a temperature of 60° C. The temperature was reduced to 40° C. after the addition of the aqueous solutions of silver nitrate and alkali metal halides had been completed and the mixture was desalted and washed with water. Lime treated gelatin (90.0 grams) was then added and, after adjusting to pAg 7.2 using sodium chloride solution, 60.0 mg of the sensitizing dye shown in Table 4 and 2.0 mg of triethylthiourea were added and the emulsion was chemically sensitized optimally at 58° C. The silver chlorobromide emulsion so obtained (silver bromide content 40 mol%) was Emulsion D.

Preparation of Silver Halide Emulsion E

Lime treated gelatin (32 grams) was added to 1000 cc of distilled water and a solution was obtained at 40° C., after which 3.3 grams of sodium chloride was added and the temperature was raised to 60° C. A 1% aqueous solution (3.2 cc) of N,N'-dimethylimidazolidine-2-thione was then added to the solution. Next, a solution obtained by dissolving 32.0 grams of silver nitrate in 200 ml of distilled water and a solution obtained by dissolving 2.26 grams of potassium bromide and 9.95 grams of sodium chloride in 200 ml of distilled water were added to, and mixed with, the aforementioned solution over a period of 12 minutes while maintaining a temperature of 60° C. Moreover, a solution obtained by dissolving 128.0 grams of silver nitrate in 560 ml of water and a solution obtained by dissolving 8.93 grams of potassium bromide and 39.7 grams of sodium chloride in 560 ml of distilled water were added to, and mixed with, the aforementioned mixture over a period of 20 minutes while maintaining a temperature of 60° C. The temperature was reduced to 40° C. after the addition of the aqueous solutions of silver nitrate and alkali metal halides had been completed and the mixture was desalted and washed with water. Lime treated gelatin (90.0 grams) was then added and, after adjusting to pAg 7.2 using sodium chloride solution, 60.0 mg of the sensitizing dye shown in Table 4 and 2.0 mg of triethylthiourea were added and the emulsion was optimally chemically sensitized at 58° C. The silver chlorobromide emulsion so obtained (silver bromide content 10 mol%) was Emulsion E.

Preparation of Silver Halide Emulsion F

Lime treated gelatin (32 grams) was added to 1000 cc of distilled water and a solution was obtained at 40° C., after which 3.3 grams of sodium chloride was added and the temperature was raised to 60° C. A 1% aqueous solution (3.2 cc) of N,N'-dimethylimidazolidine-2-thione was then added to the solution. Next, a solution obtained by dissolving 32.0 grams of silver nitrate in 200 ml of distilled water and a solution obtained by dissolving 11.0 grams of sodium chloride in 200 ml of distilled water were added to, and mixed with, the aforementioned solution over a period of 8 minutes while maintaining a temperature of 60° C. Moreover, a solution obtained by dissolving 128.0 grams of silver nitrate in 560 ml of water and a solution obtained by dissolving 44.0 grams of sodium chloride in 560 ml of distilled water were added to, and mixed with, the aforementioned mixture over a period of 20 minutes while maintaining a temperature of 60° C. The temperature was reduced to 40° C. after the addition of the aqueous solutions of silver nitrate and alkali metal halides had been completed and the mixture was desalted and washed with water. Lime treated gelatin (90.0 grams) was then added and, after adjusting to pAg 7.2 using sodium chloride solution, 60.0 mg of the sensitizing dye shown in Table 4 and 2.0 mg of triethylthiourea were added and the emulsion was chemically sensitized optimally at 58° C. The silver chlorobromide emulsion so obtained was Emulsion F.

Preparation of Silver Halide Emulsion G

Lime treated gelatin (32 grams) was added to 1000 cc of distilled water and a solution was obtained at 40° C., after which 3.3 grams of sodium chloride was added and the temperature was raised to 60° C. A 1% aqueous solution (3.2 cc) of N,N'-dimethylimidazolidinethione was then added to the solution. Next, a solution obtained by dissolving 32.0 grams of silver nitrate in 200 ml of distilled water and a solution obtained by dissolving 11.0 grams of sodium chloride in 200 ml of distilled water were added to, and mixed with, the aforementioned solution over a period of 8 minutes while maintaining a temperature of 60° C. Moreover, a solution obtained by dissolving 125.6 grams of silver nitrate in 560 ml of water and a solution obtained by dissolving 41.0 grams of sodium chloride in 560 ml of distilled water were added to, and mixed with, the aforementioned mixture over a period of 20 minutes while maintaining a temperature of 60° C. The sensitizing dye shown in Table 4 (60.0 mg) was added 1 minute after the addition of the aqueous solutions of silver nitrate and alkali metal halide had been completed. After maintaining at 60° C. for a period of 10 minutes, the temperature was reduced to 40° C. and a solution obtained by dissolving 2.4 grams of silver nitrate in 20 cc of distilled water and a solution obtained by dissolving 1.35 grams of potassium bromide and 0.17 grams of sodium chloride in 20 cc of distilled water were added to, and mixed with, the mixture over a period of 5 minutes while maintaining at a temperature of 40° C., after which the mixture was desalted and washed with water. Lime treated gelatin treated gelatin (90.0 grams) was then added and, after adjusting to pAg 7.2 using sodium chloride solution, 2.0 mg of triethylthiourea was added and the emulsion was chemically sensitized optimally at 58° C. The silver chlorobromide emulsion (silver bromide content 1.2 mol%) was Emulsion G.

The form of the grains, the grain size and the grain size distribution for each of the four types of silver halide emulsion D to G prepared in this way were obtained from electron micrographs. The silver halide grains contained in the emulsions D to G were all cubic grains. The grain size was indicated in terms of the average value of the diameters of circles which had the same areas as the projected areas of the grains, and the value obtained by dividing the standard deviation of the grain diameters by the average grain size was used for the grain size distribution. Moreover, the halogen composition of the emulsion grains was determined by measuring X-ray diffraction from the silver halide crystals. The results obtained were as shown in Table 6. below.

As shown in Table 4, various super-sensitizing agents and additives (III-3) ($3\times10^{-3}$ mol/mol·Ag), (IV 3) ($1\times10^{-3}$ mol/mol·Ag), (V-8) ($0.5\times10^{-3}$ mol/mol·Ag), (VI-8) ($1\times10^{-3}$ mol/mol·Ag), (VIIa-7) ($1\times10^{-3}$ mol/mol·Ag) were added to the silver halide emulsions (D) to (G). These were formed into mixed solutions with emulsified dispersions which contained cyan coupler and coated with the composition shown in Table 5 onto paper supports which had been laminated on both sides with polyethylene, to prepare photosensitive material samples 43 to 73. Moreover, 1-oxy-3,5-dichloro-s-triazine, sodium salt, was used as a gelatin hardening agent.

TABLE 4

| Sample No. | Emulsion | Sensitizing Dye | Super-sensitizing Agent Additive Present | Remarks |
|---|---|---|---|---|
| 43 | D | Dye-7 | No | Comp. Ex. |
| 44 | D | Dye-7 | Yes | " |
| 45 | E | Dye-7 | No | " |
| 46 | E | Dye-7 | Yes | " |
| 47 | F | Dye-7 | No | " |
| 48 | F | Dye-7 | Yes | " |
| 49 | G | Dye-7 | No | " |
| 50 | G | Dye-7 | Yes | " |
| 51 | G | Dye-6 | Yes | " |
| 52 | G | Dye-8 | Yes | " |
| 53 | G | Dye-11 | Yes | " |
| 54 | D | (61) | No | Invention |
| 55 | D | (61) | Yes | " |
| 56 | E | (61) | No | " |

TABLE 4-continued

| Sample No. | Emulsion | Sensitizing Dye | Super-sensitizing Agent Additive Present | Remarks |
|---|---|---|---|---|
| 57 | E | (61) | Yes | " |
| 58 | F | (61) | No | " |
| 59 | F | (61) | Yes | " |
| 60 | G | (61) | No | " |
| 61 | G | (61) | Yes | " |
| 62 | G | (7) | Yes | " |
| 63 | G | (11) | Yes | " |
| 64 | G | (23) | Yes | " |
| 65 | G | (29) | Yes | " |
| 66 | G | (36) | Yes | " |
| 67 | G | (40) | Yes | " |
| 68 | G | (49) | Yes | " |
| 69 | G | (58) | Yes | " |
| 70 | G | (63) | Yes | " |
| 71 | G | (70) | Yes | " |
| 72 | G | (71) | Yes | " |
| 73 | G | (79) | Yes | " |

TABLE 5

| Layer | Principal Composition | Amount Used |
|---|---|---|
| Second Layer (Protective Layer) | Gelatin | 1.5 g/m$^2$ |
| First Layer (Red Sensitive Layer) | Silver halide emulsion | 0.24 g/m$^2$ |
| | Gelatin | 0.96 g/m$^2$ |
| | Cyan coupler (a) | 0.38 g/m$^2$ |
| | Colored image (b) stabilizer | 0.17 g/m$^2$ |
| | Solvent (c) | 0.23 g/m$^2$ |
| Support | Polyethylene laminated paper (Containing $TiO_2$ and ultramarine in polyethylene on the first layer side) | |

The coated amount of silver halide emulsion shown is after calculation as silver.

TABLE 6

| Emulsion | Grain Form | Size (μm) | Distribution | Halogen Composition of the Grains According to X-Ray Diffraction |
|---|---|---|---|---|
| D | Cubic | 0.50 | 0.90 | AgCl Content: 60 mol % Uniform |
| E | Cubic | 0.51 | 0.09 | AgCl Content: 90 mol % Uniform |
| F | Cubic | 0.52 | 0.08 | AgCl Content: 100 mol % Uniform |
| G | Cubic | 0.52 | 0.08 | Local AgBr Phase: 10 to 39 mol % AgBr Content: |

(a) Cyan Coupler

A 1:1 (mol ratio) mixture of:

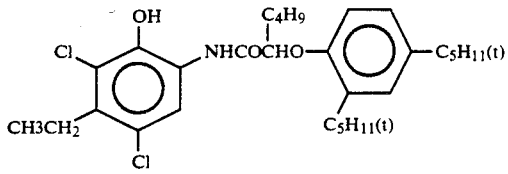

and

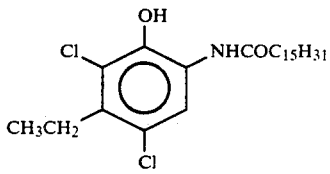

-continued (b) Colored Image Stabilizer

A 1:3:3 (mol ratio) mixture of:

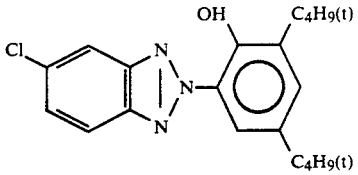

and

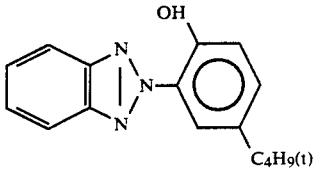

and

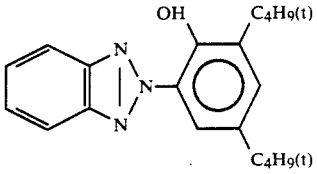

(c) Solvent

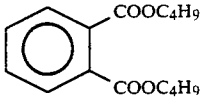

The samples shown in Table 4 were all exposed using a semiconductor laser (oscillating wavelength 830 nm) in accordance with the method described in Example 1. They were also developed and processed in the manner described in Example 1.

The evaluation of photographic performance was carried out in respect of two considerations, namely photographic speed and fogging. The speed was represented by a relative value of the logarithm of the exposure required to provide a cyan density of 1.0. The speeds of the unaged (fresh) samples was represented for convenience by relative values obtained by taking the speed for Sample No. 43 to be 100. The evaluation of storage properties was made by observing the changes in photographic speed and fog level with respect to those of unaged (Fresh) samples after aging for 2 days at 60° C., 40% RH (Storage-1) or for 2 days at 50° C., 80% RH (Storage-2). The photographic speed of the stored materials are shown as relative values for which the speed of each unaged sample was taken to be 100. (Table 7).

It is clear from the results above mentioned that the samples of the present invention had a high speed and low fog level when compared with the comparative samples, and that the change in speed and fog level on storage was small.

TABLE 7

| Sample | Cyan Color Forming Layer | | | | | | |
|---|---|---|---|---|---|---|---|
| | Fresh | | Storage-1 | | Storage-2 | | |
| No. | Speed | Fog | Speed | Fog | Speed | Fog | Remarks |
| 43 | 100 | 0.17 | 68 | 0.18 | 42 | 0.19 | Comp. Ex. |
| 44 | 103 | 0.16 | 65 | 0.18 | 41 | 0.19 | Comp. Ex. |
| 45 | 106 | 0.18 | 65 | 0.18 | 45 | 0.18 | Comp. Ex. |
| 46 | 108 | 0.17 | 70 | 0.18 | 44 | 0.18 | Comp. Ex. |
| 47 | 105 | 0.14 | 60 | 0.15 | 48 | 0.18 | Comp. Ex. |
| 48 | 106 | 0.18 | 68 | 0.18 | 49 | 0.18 | Comp. Ex. |
| 49 | 112 | 0.15 | 71 | 0.17 | 51 | 0.17 | Comp. Ex. |
| 50 | 117 | 0.17 | 72 | 0.17 | 60 | 0.18 | Comp. Ex. |
| 51 | 121 | 0.16 | 73 | 0.18 | 47 | 0.18 | Comp. Ex. |
| 52 | 115 | 0.17 | 71 | 0.17 | 55 | 0.18 | Comp. Ex. |
| 53 | 131 | 0.17 | 65 | 0.17 | 48 | 0.18 | Comp. Ex. |
| 54 | 181 | 0.12 | 108 | 0.13 | 90 | 0.13 | Invention |
| 55 | 205 | 0.12 | 107 | 0.13 | 92 | 0.13 | Invention |
| 56 | 190 | 0.12 | 109 | 0.13 | 91 | 0.13 | Invention |
| 57 | 215 | 0.12 | 105 | 0.13 | 93 | 0.13 | Invention |
| 58 | 200 | 0.12 | 108 | 0.12 | 90 | 0.13 | Invention |
| 59 | 221 | 0.12 | 104 | 0.12 | 95 | 0.13 | Invention |
| 60 | 230 | 0.12 | 105 | 0.12 | 96 | 0.13 | Invention |
| 61 | 255 | 0.12 | 101 | 0.12 | 98 | 0.12 | Invention |
| 62 | 245 | 0.12 | 103 | 0.12 | 97 | 0.12 | Invention |
| 63 | 312 | 0.12 | 102 | 0.12 | 95 | 0.12 | Invention |
| 64 | 331 | 0.12 | 101 | 0.12 | 98 | 0.13 | Invention |
| 65 | 245 | 0.12 | 101 | 0.13 | 97 | 0.13 | Invention |
| 66 | 280 | 0.12 | 101 | 0.13 | 96 | 0.13 | Invention |
| 67 | 195 | 0.12 | 101 | 0.13 | 95 | 0.13 | Invention |
| 68 | 211 | 0.12 | 103 | 0.13 | 95 | 0.13 | Invention |
| 69 | 182 | 0.12 | 103 | 0.13 | 95 | 0.13 | Invention |
| 70 | 192 | 0.12 | 102 | 0.12 | 98 | 0.12 | Invention |
| 71 | 215 | 0.12 | 103 | 0.12 | 97 | 0.12 | Invention |
| 72 | 271 | 0.12 | 101 | 0.12 | 96 | 0.12 | Invention |
| 73 | 280 | 0.12 | 101 | 0.12 | 99 | 0.12 | Invention |

EXAMPLE 4

To a 3% aqueous solution of lime treated gelatin was added 3.3 g of sodium chloride, and 3.2 ml of a 1% aqueous solution of N,N'-dimethylimidazolidine-2-thione was added thereto. To the aqueous solution were added an aqueous solution containing 0.2 mol of silver nitrate and an aqueous solution containing 0.2 mol of sodium chloride and 15 μg of rhodium trichloride with vigorous stirring at 56° C. Subsequently, an aqueous solution containing 0.780 mol of silver nitrate and an aqueous solution containing 0.780 mol of sodium chloride and 4.2 mg of potassium ferrocyanide were added thereto at 56° C. while vigorously stirring. Five minutes after completion and the addition of the silver nitrate aqueous solution and the alkali halide aqueous solution, an aqueous solution containing 0.020 mol of silver nitrate and an aqueous solution containing 0.015 mol of potassium bromide, 0.005 mol of sodium chloride and 0.8 mg potassium hexachloroiridate (IV) were added to the mixture at 40° C. while vigorously stirring. After the mixture was desalted and washed with water, 90.0 g of lime treated gelatin was added thereto., and triethylthiourea was then added thereto. Finally, the resulting emulsion was subjected to optimal chemical sensitization.

The resulting silver chloride emulsion (designated A) was examined through the electron micrograph to determine the shape, size and size distribution of grains. As a result, it was found that all the silver halide grains were cubic and had a grain size of 0.52 μm with a variation coefficient of 0.08. The grain size as referred to herein was an average of a diameter of a circle equivalent to the projected area of the grain, and the size distribution as referred to herein was obtained by dividing a standard deviation of the grain size by the average grain size.

The halogen composition of the emulsion grains was determined by measuring X-ray diffraction from the silver halide crystals. The angle of diffraction from the (200) plane was closely measured using a monochromatically isolated CuKu ray as a radiation source. A diffraction pattern of a crystal having a uniform halogen composition has a single peak, while that of a crystal having different localized phases shows plural peaks corresponding to these phases. Accordingly, a halogen composition of silver halide constituting crystals can be decided by calculating a lattice constant from the angle of diffraction of the measured peaks. The measurement results of the silver chlorobromide emulsion A revealed a main peak assigned to 100% silver chloride and, in addition, a broad diffraction pattern centered at 70% silver chloride (30% silver bromide) and extending to around 60% silver chloride (40% silver bromide).

Preparation of Light-Sensitive Material

Onto a paper support laminated with polyethylene on both sides thereof were coated the following layers to prepare a multi-layer color light-sensitive material.

The coating compositions were prepared as follows.

Coating Composition for 1st Layer

To 19.1 g of a yellow coupler (ExY), 4.4 g of a colored image stabilizer (Cpd-10), and 1.4 g of a colored image stabilizer (Cpd-11) were added 27.2 g of ethyl acetate and 8.2 g of a solvent (Solv-5) to form a solution. The solution was emulsified and dispersed in 185 cc of a 10% gelatin aqueous solution containing 8 cc of a 10% sodium dodecylbenzenesulfonate. On the other hand, red-sensitizing dyes (Dye-12) shown below was added to the silver chlorobromide emulsion A. The above-prepared dispersion and the emulsion were mixed to prepare a coating composition for the 1st layer having the formulation shown below.

Dye-12

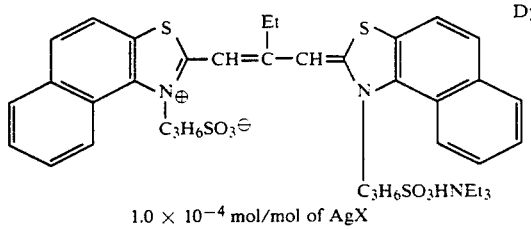

$1.0 \times 10^{-4}$ mol/mol of AgX

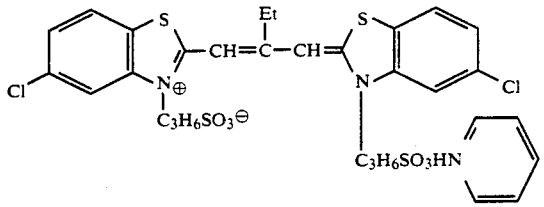

$1.0 \times 10^{-4}$ mol/mol of AgX

Coating compositions for the 2nd to 7th layers were prepared in the same manner as for the coating composition for the 1st layer. To the 3rd layer (infrared-sensitive magenta forming layer) and the 5th layer (infrared-sensitive cyan forming layer) was added $2.5 \times 10^{-5}$ mol and $0.6 \times 10^{-5}$ mol, respectively, of a polymethine dye shown in Tables 7 and 8 each per mol of silver halide. On addition of the polymethine dye, $1.8 \times 10^{-3}$ mol of Compound III-1 was added per mol of silver halide.

Further, to each of the yellow forming emulsion layer, magenta forming emulsion layer, and cyan forming emulsion layer was added $8.0 \times 10^{-4}$ mol of 1-(5-methylureidophenyl)-5-mercaptotetrazole per mol of silver halide.

Furthermore, 2,4-dichloro-6-hydroxy-1,3,5-triazine sodium salt was used as a gelatin hardening agent for each layer.

For the purpose of prevention of irradiation, Dye-1, Dye-2, and Dye-3 were added to the emulsion layers.

Dye-3

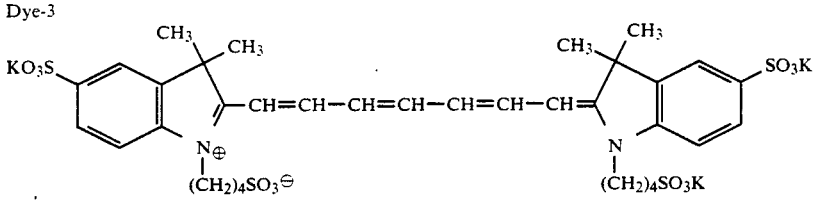

Dye-4

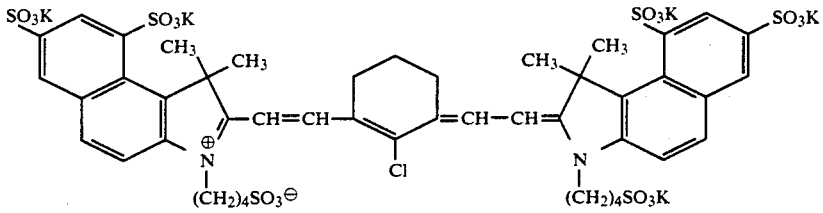

Layer Structure:

Support

Polyethylene laminated paper [polyethylene on the 1st layer side contained a white pigment ($TiO_2$) and a bluing dye (ultramarine)]

1st Layer: Red-Sensitive Yellow Forming Layer

| | |
|---|---|
| Silver chlorobromide emulsion A | 0.30 g of Ag/m$^2$ |
| Gelatin | 1.86 g/m$^2$ |
| Yellow coupler (ExY) | 0.82 g/m$^2$ |

-continued

| | |
|---|---|
| Colored image stabilizer (Cpd-10) | 0.19 g/m$^2$ |
| Solvent (Solv-5) | 0.35 g/m$^2$ |
| Colored image stabilizer (Cpd-11) | 0.06 g/m$^2$ |
| 2nd Layer: Anti-Color Mixing Layer | |
| Gelatin | 0.99 g/m$^2$ |
| Anti-color mixing agent (Cpd-4) | 0.08 g/m$^2$ |
| Solvent (Solv-5) | 0.16 g/m$^2$ |
| Solvent (Solv-2) | 0.08 g/m$^2$ |
| 3rd Layer: Infrared-Sensitive Magenta Forming Layer | |
| Silver chlorobromide emulsion A | 0.12 g of Ag/m$^2$ |
| Gelatin | 1.24 g/m$^2$ |
| Magenta coupler (ExM) | 0.20 g/m$^2$ |
| Colored image stabilizer (Cpd-9) | 0.03 g/m$^2$ |
| Colored image stabilizer (Cpd-1) | 0.15 g/m$^2$ |
| Colored image stabilizer (Cpd-8) | 0.02 g/m$^2$ |
| Colored image stabilizer (Cpd-2) | 0.02 g/m$^2$ |
| Solvent (Solv-7) | 0.40 g/m$^2$ |
| 4th Layer: Ultraviolet Absorbing Layer | |
| Gelatin | 1.58 g/m$^2$ |
| Ultraviolet absorbent (UV-1) | 0.47 g/m$^2$ |
| Anti-color Mixing agent (Cpd-4) | 0.05 g/m$^2$ |
| Solvent (Solv-3) | 0.24 g/m$^2$ |
| 5th Layer: Infrared-Sensitive Cyan Forming Layer | |
| Silver chlorobromide emulsion A | 0.23 g of Ag/m$^2$ |
| Gelatin | 1.34 g/m$^2$ |
| Cyan coupler (ExC) | 0.32 g/m$^2$ |
| Colored image stabilizer (Cpd-5) | 0.17 g/m$^2$ |
| Colored image stabilizer (Cpd-11) | 0.40 g/m$^2$ |
| Colored image stabilizer (Cpd-6) | 0.04 g/m$^2$ |
| Solvent (Solv-4) | 0.15 g/m$^2$ |
| 6th Layer: Ultraviolet Absorbing Layer | |
| Gelatin | 0.53 g/m$^2$ |
| Ultraviolet absorbent (UV-1) | 0.16 g/m$^2$ |
| Anti-color mixing agent (Cpd-4) | 0.02 g/m$^2$ |
| Solvent (Solv-3) | 0.08 g/m$^2$ |
| 7th Layer: Protective Layer | |
| Gelatin | 1.33 g/m$^2$ |
| Acryl-modified polyvinyl alcohol copolymer (degree of modification: 17%) | 0.17 g/m$^2$ |
| Liquid paraffin | 0.03 g/m$^2$ |

Yellow Coupler (ExY)

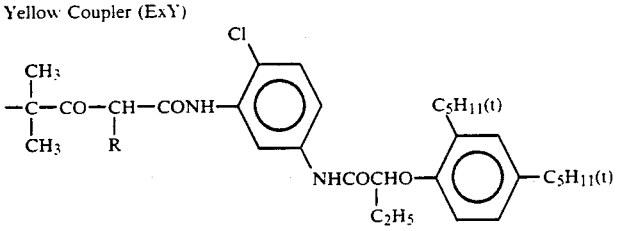

A mixture of R = 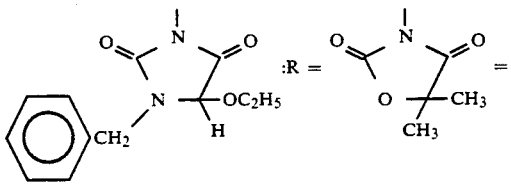 :R =  = 1:1 by mol

Magenta Coupler (ExM)

A 1:1 (by mol) mixture of 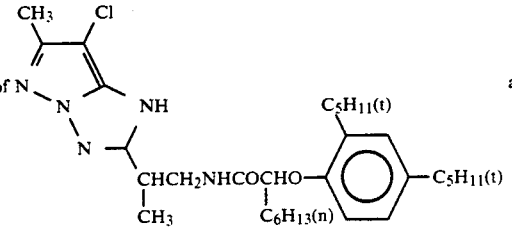 and

-continued

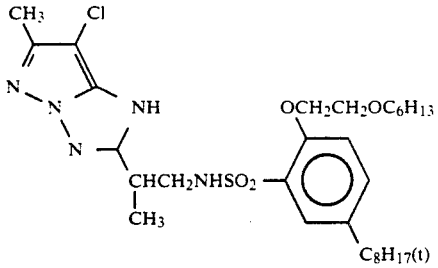

Cyan Coupler (ExC)

A 2:4:4 (by weight) mixture of

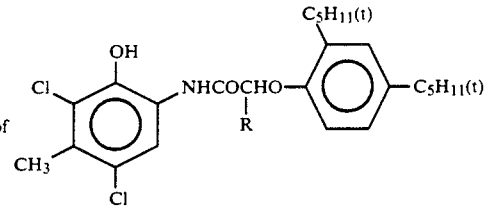

and (R = $C_2H_5$ and $C_4H_9$)

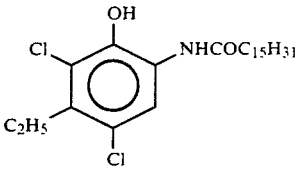

Colored Image Stabilizer (Cpd-10)

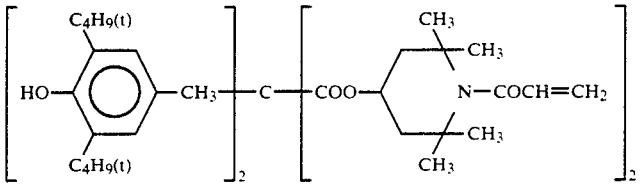

Colored Image Stabilizer (Cpd-11)

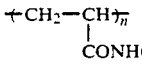

Average molecular weight: 60,000

Solvent (Solv-7)

A 2:1 (by volume) mixture of $O = P[OCH_2CH(C_2H_5)C_4H_9]_3$ and

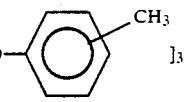

Other compounds whose structural formulae are not shown have been described in Example 1.

Each sample was divided into three portions. The first portion was preserved at room temperature under an oxygen partial pressure of 10 atm for 3 days (storage-1). The second portion was preserved at 50° C. and 80% RH for 3 days (storage-2). The third portion was preserved at −30° C. in a sealed container filled with argon gas for 3 days (storage-3). The thus treated samples were successively exposed to light emitted from an AsGaInP semiconductor laser (oscillating wavelength: about 670 nm), a GaAlAs semiconductor laser (oscillating wavelength: about 750 nm) and a GaAlAs semiconductor laser (oscillating wavelength: about 830 nm) by means of the respective rotating multi-surfaced body, the samples moving in the direction perpendicular to the scanning direction. The exposure amount was adjusted through electrical control of exposure time and amount of emitted light.

The exposed samples were subjected to color development processing according to the following procedure by using a paper processor.

| Processing Step | Temp. (°C.) | Time (sec) | Rate of Replenishment (ml/m²) | Volume of Tank (l) |
|---|---|---|---|---|
| Color development | 35 | 20 | 60 | 2 |
| Bleach-fix | 30–35 | 20 | 60 | 2 |
| Rinse (1)* | 30–35 | 10 | — | 1 |
| Rinse (2)* | 30–35 | 10 | — | 1 |
| Rinse (3)* | 30–35 | 10 | 120 | 1 |
| Drying | 70–80 | 20 | | |

*Rinsing was carried out in a counter-flow system using three tanks from (3) to (1).

The composition of the processing bath used in each step was as follows.

| | Running Solution | Replenisher |
|---|---|---|
| Color Development Bath | | |
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 4.9 g | — |
| Potassium carbonate | 25 g | 37 g |
| 4-Amino-3-methyl-N-ethyl-N-(3-hydroxypropyl)aniline-2-p-toluenesulfonic acid | 12.8 g | 19.8 g |
| N,N-Bis(carboxymethyl)hydrazine | 5.5 g | 7.0 g |
| Fluorescent whitener "WHITEX 4B" (produced by Sumitomo Chemical Co., Ltd.) | 1.0 g | 2.0 g |
| Water to make | 1000 ml | 1000 ml |
| pH (25° C.) | 10.05 | 10.45 |
| Bleach-Fix Bath | | |
| (Running solution and replenisher had the same composition) | | |
| Water | 400 ml | |
| Ammonium thiosulfate (700 g/l) | 100 ml | |
| Sodium sulfite | 17 g | |
| Ammonium (ethylenediaminetetra-acetato)iron (III) | 55 g | |
| Disodium ethylenediaminetetraacetate | 5 g | |
| Ammonium bromide | 40 g | |
| Water to make | 1000 ml | |
| pH (25° C.) | 6.0 | |
| Rinse Bath | | |
| (Running solution and replenisher had the same composition) | | |

-continued

| | Running Solution | Replenisher |
|---|---|---|
| Ion exchanged water containing calcium and magnesium ions each of not more than 3 ppm. | | |

Cyan, magenta, and yellow densities of the processed samples were measured. Photographic speed, i.e., the logarithm of the exposure amount required to provide a density of fog+0.5, was obtained and expressed relatively taking the photographic speed of Sample 7-1 preserved in argon at −30° C. (storage-3) as a standard (100). The results of the magenta forming layer and those of the cyan forming layer are shown in Tables 7 and 8, respectively.

The relative photographic speed of each color forming layer in cases of storage - 1 and storage - 2 is evaluated taking the relative photographic speed of corresponding Sample preserved in argon at −30° C. as a standard (100).

From the results in Tables 7 and 8, it is apparent that the samples according to the present invention have a higher photographic speed, a lower fog, and undergo reduced changes in photographic speed and fog when preserved as compared with the comparative samples.

TABLE 7

| | | Magenta Forming Layer | | | | | | |
|---|---|---|---|---|---|---|---|---|
| | | Storage-3 | | Storage-2 | | Storage-3 | | |
| Sample No. | Polymethine Dye | Relative Sensitivity | Fog | Relative Sensitivity | Fog | Relative Sensitivity | Fog | Remark |
| 7-1 | Dye-5 | 100 (standard) | 0.05 | 65 | 0.06 | 44 | 0.07 | Comparison |
| 7-2 | Dye-5 | 100 | 0.05 | 65 | 0.06 | 44 | 0.07 | Invention |
| 7-3 | Dye-5 | 100 | 0.05 | 65 | 0.06 | 44 | 0.07 | Invention |
| 7-4 | Dye-13 | 92 | 0.05 | 52 | 0.07 | 35 | 0.07 | Comparison |
| 7-5 | Dye-13 | 92 | 0.05 | 52 | 0.07 | 35 | 0.07 | Invention |
| 7-6 | (72) | 115 | 0.04 | 87 | 0.04 | 79 | 0.04 | Invention |
| 7-7 | Dye-14 | 95 | 0.06 | 55 | 0.06 | 37 | 0.07 | Comparison |
| 7-8 | Dye-14 | 95 | 0.06 | 55 | 0.06 | 37 | 0.07 | Invention |
| 7-9 | (12) | 123 | 0.04 | 90 | 0.04 | 85 | 0.05 | Invention |
| 7-10 | (26) | 140 | 0.05 | 79 | 0.05 | 75 | 0.05 | Invention |
| 7-11 | (38) | 135 | 0.03 | 92 | 0.04 | 82 | 0.04 | Invention |
| 7-12 | (57) | 150 | 0.04 | 85 | 0.04 | 80 | 0.04 | Invention |

TABLE 8

| | | Cyan Forming Layer | | | | | | |
|---|---|---|---|---|---|---|---|---|
| | | Storage-3 | | Storage-2 | | Storage-3 | | |
| Sample No. | Polymethine Dye | Relative Sensitivity | Fog | Relative Sensitivity | Fog | Relative Sensitivity | Fog | Remark |
| 7-1 | Dye-7 | 100 (standard) | 0.05 | 55 | 0.07 | 40 | 0.07 | Comparison |
| 7-2 | (58) | 141 | 0.04 | 85 | 0.04 | 75 | 0.05 | Invention |
| 7-3 | (70) | 135 | 0.04 | 91 | 0.04 | 72 | 0.04 | Invention |
| 7-4 | Dye-11 | 105 | 0.05 | 60 | 0.06 | 43 | 0.06 | Comparison |
| 7-5 | (59) | 145 | 0.03 | 83 | 0.04 | 50 | 0.04 | Invention |
| 7-6 | (66) | 151 | 0.04 | 93 | 0.04 | 47 | 0.05 | Invention |
| 7-7 | Dye-6 | 95 | 0.06 | 51 | 0.07 | 35 | 0.08 | Comparison |
| 7-8 | (2) | 135 | 0.04 | 82 | 0.04 | 75 | 0.04 | Invention |
| 7-9 | (11) | 141 | 0.04 | 83 | 0.04 | 72 | 0.04 | Invention |
| 7-10 | (16) | 156 | 0.03 | 79 | 0.04 | 75 | 0.04 | Invention |
| 7-11 | (32) | 125 | 0.04 | 91 | 0.05 | 83 | 0.04 | Invention |
| 7-12 | (45) | 151 | 0.04 | 87 | 0.04 | 82 | 0.05 | Invention |

Dye-13

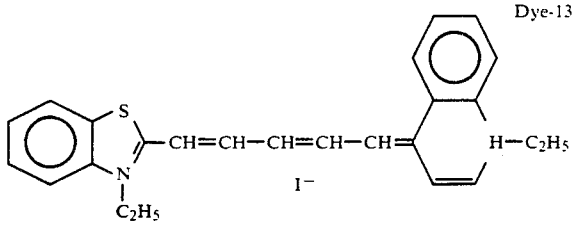

Dye-14

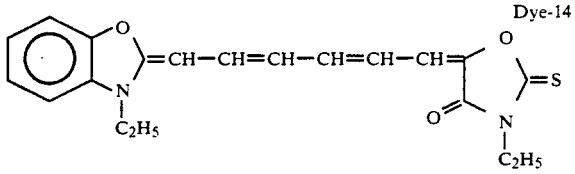

Structural formulae of Dye-5, Dye-7, and Dye-11 have been shown in Example 1.

EFFECT OF THE INVENTION

It is possible by means of the present invention to obtain full color recording materials with which semiconductor laser light beam write-in apparatus can be used, with which write-in can be accomplished in a short period of time (for example, within about 30 seconds for an A4 size sheet), and with which a stable and high quality colored image can be obtained. Moreover, simple rapid development in the short time of not more than 180 seconds can be realized to match the write-in time.

While the invention has been described in detail and with reference to specific embodiments thereof, it will be apparent to one skilled in the art that various changes and modifications can be made therein without departing from the spirit and scope thereof.

What is claimed is:

1. A full color recording material comprising a support having thereon at least three silver halide photosensitive emulsion layers which contain respectively couplers which form yellow, magenta, and cyan colorations and which are sensitive to light of different wavelength regions, at least two of the said layers being spectrally sensitized selectively to match laser light beams of wavelengths of 670 nm or longer, wherein at least one of the at least two silver halide layers contains at least one spectral sensitizing dye selected from among those which are represented by the general formulae (I-a), (I-b), (I-c), (I-d), (II-a), (II-b) and (II-c) indicated below:

(I-a)

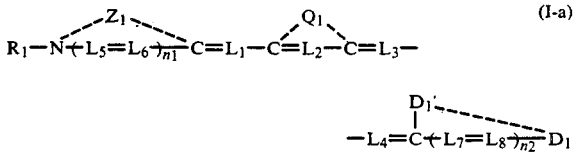

$(M_1)_{m1}$ (I-b)

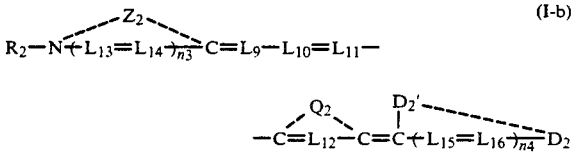

-continued $(M_2)_{m2}$ (I-c)

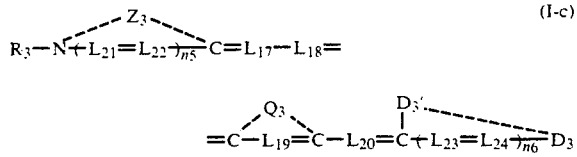

$(M_3)_{m3}$ (I-d)

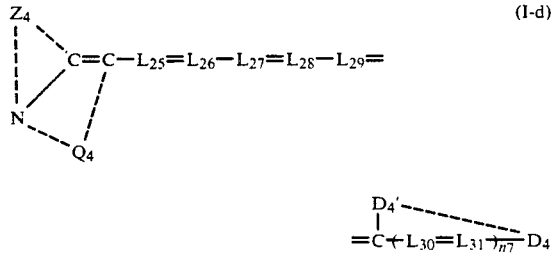

$(M_4)_{m4}$ (II-a)

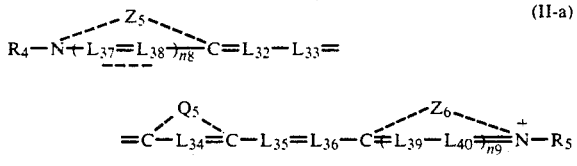

$(M_5)_{m5}$ (II-b)

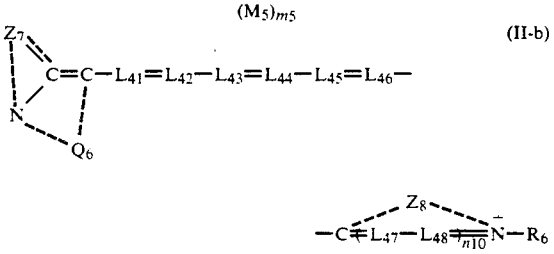

$(M_6)_{m6}$ (II-c)

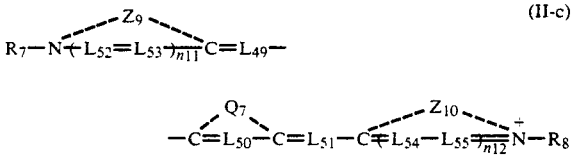

$(M_7)_{m7}$ wherein $Z_1$, $Z_2$, $Z_3$, $Z_4$, $Z_5$, $Z_6$, $Z_7$, $Z_8$, $Z_9$ and $Z_{10}$ represent groups of atoms which are required to form 5- or 6-membered nitrogen containing heterocyclic rings with the proviso that $Z_4$ and $Z_7$ do not form 4-quinoline or 4-pyridine nuclei and the proviso that at least one of $Z_9$ and $Z_{10}$ forms is 4-quinoline nucleus or a 4-pyridine nucleus;

$D_1$ and $D_1'$, $D_2$ and $D_2'$, $D_3$ and $D_3'$, $D_4$ and $D_4'$ represent groups of atoms which are required to form non-cyclic or cyclic acidic $Q_1$, $Q_2$, $Q_3$, $Q_4$, $Q_5$, $Q_6$ and $Q_7$ represent groups of atoms which are required to form 5-, 6- or 7-membered rings;

$R_1$, $R_2$, $R_3$, $R_4$, $R_5$, $R_6$, $R_7$ and $R_8$, represent alkyl groups;

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$, $L_{30}$, $L_{31}$, $L_{32}$, $L_{33}$, $L_{34}$, $L_{35}$, $L_{36}$, $L_{37}$, $L_{38}$, $L_{39}$, $L_{40}$, $L_{41}$, $L_{42}$, $L_{43}$, $L_{44}$, $L_{45}$, $L_{46}$, $L_{47}$, $L_{48}$, $L_{49}$, $L_{50}$, $L_{51}$, $L_{52}$, $L_{53}$, $L_{54}$ and $L_{55}$ represent methine groups or substituted methine groups, which may also form rings with other methine groups, or which may form rings with an auxochrome;

$n_1$, $n_2$, $n_3$, $n_4$, $n_6$, $n_7$, $n_8$, $n_9$, $n_{10}$, $n_{11}$ and $n_{12}$ represent 0 or 1;

$M_1$, $M_2$, $M_3$, $M_4$, $M_5$, $M_6$ and $M_7$ represent charge neutralizing counter ions; and $m_1$, $m_2$, $m_3$, $M_4$, $m_5$, $m_6$ and $m_7$ are zero or larger integers which are required to neutralize the charge of the molecule.

2. A full color recording material of claim 1, wherein the ring formed by $Z_9$ or $Z_{10}$ is a member selected from the group consisting of a benzothiazole nucleus, a naphthothiazole nucleus, a benzoxazole nucleus, a naphthoxazole nucleus, and a benzimidazole nucleus.

3. A full color recording material of claim 1, wherein at least one of the rings formed by $Z_4$ or $Z_7$ is a member selected from the group consisting of a benzothiazole nucleus, a naphthoxazole nucleus, and a benzimidazole nucleus.

4. A full color recording material of claim 1, wherein $D_1$, $D_2$, $D_3$ and $D_4$ may be the same or different and represent thiocarbonyl groups or carbonyl groups.

5. A full color recording material of claim 1, wherein at least one of the non-cyclic or cyclic acidic nuclei formed by $D_1$ and $D_1'$, $D_2$ and $D_2'$, $D_3$ and $D_3'$, and $D_4$ and $D_4'$ is a member selected from the group consisting of a 3-alkylrhodanine nucleus, a 3 alkyl-2-thioazoloidin-2,4-dione and a 3-alkyl-2-thiohydantoin nucleus.

6. A full color recording material of claim 1, wherein at least two of the three silver halide photosensitive emulsion layers are selectively spectrally sensitized so as to match the wavelengths of semiconductor lasers in at least one of the wavelength bands 660 to 690 nm, 740 to 790 nm, 800 to 850 nm and 850 to 900 nm.

7. A full color recording material of claim 1, wherein said silver halide photosensitive emulsion layer or layers containing a spectral sensitizing dye selected from the group consisting of compounds represented by the general formula (I-a), (I-b), (I-c), (I-d), (II-a), (II-b) and (II-c) further contain at least one compound selected from the group consisting of compounds represented by the general formula (III), (IV), (V), (VII-a), (VII-b) and (VII-c) indicated below, in an amount sufficient to provide a supersensitizing effect:

General Formula (III)

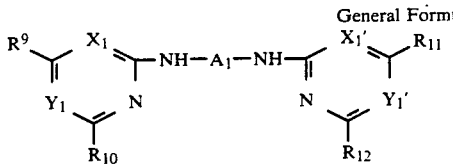

wherein $A_1$ represents a divalent aromatic residual group; $R_9$, $R_{10}$, $R_{11}$ and $R_{12}$ each represents a hydrogen atom, a hydroxyl group, an alkyl group, an alkoxy group, an aryloxy group, a halogen atom, a heterocyclic nucleus, a heterocyclythio group, an arylthio group, an amino group, an alkylamino group, an arylamino group, an aralkylamino group, an aryl group or a mercapto group, these groups may be substituted with substituent groups and at least one of the groups represented by $A_1$, $R_9$, $R_{10}$, $R_{11}$ and $R_{12}$ has a sulfo group; $X_1$ and $Y_1$, and $X_1'$ and $Y_1'$ each represents —CH= or —N=, but at least one of $X_1$ and $Y_1$ represents —N=, and at least one of $X_1'$ and $Y_1'$ represents —N=;

General Formula (IV)

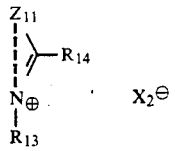

wherein $Z_{11}$ represents a group of non-metal atoms which is required to complete a 5- or 6-membered nitrogen containing heterocyclic ring, $R_{13}$ represents a hydrogen atom, an alkyl group, $R_{14}$ represents a hydrogen atom or a lower alkyl group, $R_{13}$ and $R_{14}$ may also be substituted alkyl groups and $X_2$ represents an acid anion;

General Formula (V)

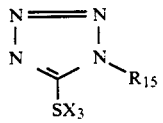

wherein $R_{15}$ represents an alkyl group, an alkenyl group or an aryl group and $X_3$ represents a hydrogen atom, an alkali metal atom, an ammonium group, or a precursor;

General Formula (VI)

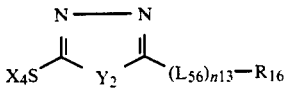

wherein $Y_2$ is an oxygen atom, a sulfur atom, =NH or =N— $(L_{57})_{n14}$—$R_{17}$, $L_{56}$ and $L_{57}$ represent divalent linking groups, and $R_{16}$ and $R_{17}$ represent hydrogen atoms, alkyl groups, alkenyl groups or aryl groups and $X_4$ has the same meaning as $X_3$ in general formula (V);

General Formula (VIIa)

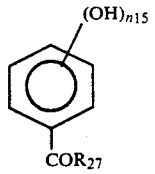

General Formula (VIIb)

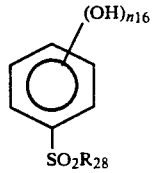

General Formula (VIIc)

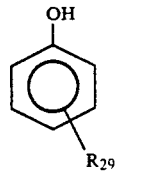

wherein $R_{27}$ and $R_{28}$ each represents —OH, —OM', —$OR_{30}$, —$NH_2$, —$NH_{30}$, —$NH(R_{30})_2$, —$NHNH_2$ or —$NHNHR_{30}$, $R_{30}$ represents an alkyl group, an aryl group or an aralkyl group, M' represents an alkali metal or an alkaline earth metal, $R_{29}$ represents —OH or a halogen atom and $n_{15}$ and $n_{16}$ each represents 1, 2 or 3.

8. A full color recording material of claim 7, wherein said silver halide photosensitive emulsion layers contain a compound represented by the general formula (III) and at least one compound selected from the group consisting of the compounds represented by the general formula (IV), (V), (VII-a), (VII-b) and (VII-c) in an amount sufficient to provide a super-sensitizing effect.

9. A full color recording material of claim 8, wherein said silver halide photosensitive emulsion layers contain a super-sensitizing layer containing compounds represented by the general formula (III) and compounds represented by the general formula (IV).

10. A full color recording material of claim 9, wherein said compounds represented by the general formula (III) are used in amounts from 1/1 to 1/100 by weight with respect to the spectrally sensitizing dye represented by the general formula (I-a), (I-b), (I-c), (I-d), (II-a), (II-a), (II-b) or (II-c), and said compounds represented by formula (IV) are used in amounts from 1/10 to 10/1 by weight with respect to the compounds represented by the general formula (III).

11. A full color recording material of claim 1, wherein 95 mol% or more of all the silver halide composing the silver halide grains which are contained in the silver halide photosensitive emulsion layer containing the crosslinking type spectrally sensitizing dye is silver chloride.

12. A full color recording material of claim 11, wherein said silver halide grains have a local phase which has a different silver bromide content from that contained in the substrate in at least some of interior and surface parts of the grains.

13. A full color recording material of claim 1, wherein the emulsion layer containing at least one spectral sensitizing dye comprises a local phase having a silver bromide content which exceeds 15 mol% based on its silver halide content.

14. A full color recording material of claim 13, wherein the local phase comprises 20 to 609 mol% silver bromide based on its total silver halide content.

15. A full color recording material of claim 13, wherein the local phase comprises 30 to 50 mol% silver bromide based on the its silver halide content.

16. A full color recording material of claim 1, wherein the emulsion layer containing at least one spectral sensitizing dye comprises 2 mol% silver bromide based on the total silver halide content.

17. A full color recording material of claim 1, wherein the emulsion layer containing at least one spectral sensitizing dye comprises 10 mol% silver bromide based on the total silver halide content.

* * * * *